United States Patent [19]

Koya et al.

[11] Patent Number: 5,071,729

[45] Date of Patent: Dec. 10, 1991

[54] SILVER HALIDE COLOR PHOTOGRAPHIC MATERIAL

[75] Inventors: Keizo Koya; Shigeru Ohno; Yoshisada Nakamura, all of Kanagawa, Japan

[73] Assignee: Fuji Photo Film Co., Ltd., Kanagawa, Japan

[21] Appl. No.: 188,778

[22] Filed: Apr. 29, 1988

[30] Foreign Application Priority Data

Apr. 30, 1987 [JP] Japan ..... 62-106886

[51] Int. Cl.[5] ..... G03C 7/305; G03C 1/34

[52] U.S. Cl. ..... 430/223; 430/551; 430/955

[58] Field of Search ..... 430/17, 551, 955, 223

[56] References Cited

U.S. PATENT DOCUMENTS

| | | | |
|---|---|---|---|
| 4,242,429 | 12/1980 | Hara et al. | 430/17 |
| 4,245,018 | 1/1981 | Hara et al. | 430/17 |
| 4,273,854 | 6/1981 | Hara et al. | 430/17 |
| 4,450,223 | 5/1984 | Van Poucke et al. | 430/223 |
| 4,783,396 | 11/1988 | Nakamura et al. | 430/566 |
| 4,820,622 | 4/1989 | Hirai | 430/351 |
| 4,840,887 | 6/1989 | Nakamura | 430/564 |
| 4,877,720 | 10/1989 | Sato et al. | 430/512 |
| 4,886,736 | 12/1989 | Nakamura et al. | 430/359 |
| 4,891,304 | 1/1990 | Nakamura | 430/448 |
| 4,916,047 | 4/1990 | Koya et al. | 430/353 |
| 4,939,066 | 7/1990 | Toriuchi et al. | 430/219 |
| 4,942,114 | 7/1990 | Shiba et al. | 430/434 |
| 4,950,764 | 8/1990 | Nakamura et al. | 248/243 |
| 4,962,017 | 10/1990 | Nakamura | 430/551 |
| 4,965,170 | 10/1990 | Ukai et al. | 430/264 |

FOREIGN PATENT DOCUMENTS

| | | | |
|---|---|---|---|
| 1088257 | 5/1986 | Japan | 430/955 |

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A silver halide photographic material comprising a support having provided thereon at least one silver halide emulsion layer, wherein the silver halide photographic material contains a compound having discoloration inhibitory activity represented by formula (I):

$$\text{PWR}\text{-}(\text{Time})_t\text{-MCAP} \qquad \text{(I)}$$

wherein PWR represents a group capable of releasing $(\text{Time})_t$-MCAP upon being reduced; Time represents a group which is released from PWR in the form of $(\text{Time})_t$-MCAP and then releases MCAP through a subsequent reaction; t represents 0 or 1; and MCAP represents a group having discoloration inhibitory activity.

11 Claims, No Drawings

SILVER HALIDE COLOR PHOTOGRAPHIC MATERIAL

FIELD OF THE INVENTION

This invention relates to a silver halide color photographic material, and more particularly to a silver halide color photographic material which provides a dye image fast to long-term light exposure.

BACKGROUND OF THE INVENTION

In general, a dye image obtained by photographic processing of a silver halide color photographic material comprises an azomethine dye or an indoaniline dye formed by the reaction between a coupler and an oxidation product of an aromatic primary amine developing agent. The thus obtained color photographic image is not always stable against light or wet heat and is liable to suffer discoloration or color change when exposed to light or preserved under high temperature and high humidity conditions for a long time, resulting in serious deterioration of the image quality.

Discoloration of dye images is virtually a fatal defect for recording materials. It has conventionally been proposed to overcome this defect by selection of couplers which are less prove to discoloration, the use of a discoloration inhibitor which prevents discoloration of dye images due to exposure to light, or the use of an ultraviolet absorbent which prevents image deterioration due to ultraviolet radiation.

Among other results, use of discoloration inhibitors produces considerable effects to prevent image deterioration. Known discoloration inhibitors include, for example, hydroquinones, hindered phenols, catechols, gallic esters, aminophenols, hindered amines, etc., as well as ethers or esters of these compounds in which the phenolic hydroxyl group is silylated, acylated or alkylated, and metal complexes, as described in U.S. Pat. Nos.3,935,016, 3,982,944, and 4,254,216, British Patent 2,066,975, U.S. Pat. Nos. 3,700,455, 4,360,589, and 3,457,079, Japanese Patent Publication No. 21144/81, and U.S. Pat. Nos. 3,336,135, 4,268,593, 4,050,938, and 4,241,155.

Although the metal complexes are recognized as highly effective to prevent discoloration or color change of dye images, they inevitably cause coloring of the white background of dye images after development processing due to their own color. Therefore, they have failed to sufficiently meet the increasing demand for high image quality.

SUMMARY OF THE INVENTION

One object of this invention is to provide a color photographic light sensitive material providing a color color image which suffers neither discoloration for a prolonged period of time, nor background stains, and having a high preservability.

Another object of this invention is to provide a photographic discoloration inhibitor which produces sufficient effects to prevent discoloration or color change of a color image without causing hue change or fog.

It has now been found that the above-noted objects can be accomplished by incorporating a compound having discoloration inhibitory activity, as represented by formula (I) below, into a silver halide photographic material.

$$PWR\text{-}(Time)_t\text{-}MCAP \qquad (I)$$

wherein represents a group capable of releasing $(Time)_t$-MCAP upon being reduced; Time represents a group which is released from PWR in the form of $(Time)_t$-MCAP and then releases MCAP through a subsequent reaction; t represents 0 or 1; and MCAP represents a group having discoloration inhibitory activity, and preferably a group which can be dissolved out from a silver halide photographic material after being released.

DETAILED DESCRIPTION OF THE INVENTION

The group represented by PWR may be any group corresponding to a moiety containing an electron accepting center and an intramolecular nucleophilic substitution center in a compound capable of releasing a photographic reagent through reduction followed by intramolecular nucleophilic substitution, such as disclosed in U.S. Pat. Nos. 4,139,389, 4,139,379 and 4,564,577 and Japanese Patent Application (OPI) No. 185333/84 and 84453/82 (the term "OPI" as used herein means "unexamined published Japanese Patent Application); or a group corresponding to a moiety containing an electron accepting quinoid center and a carbon atom connecting the quinoid center to a photographic reagent in a compound capable of releasing a photographic reagent through reduction followed by intramolecular electron transfer, such as disclosed in U.S. Pat. No. 4,232,107, Japanese Patent Application (OPI) No. 101649/84, *Research Disclosure,* (RD No. 24025), IV (1984), and Japanese Patent Application (OPI) No. 88257/86; or a group corresponding to a moiety containing an aryl group substituted with an electron attractive group and an atom (a sulfur, carbon or nitrogen atom) connecting the substituted aryl group to a photographic reagent in a compound capable of releasing a photographic reagent through reduction followed by cleavage of its single bond, such as disclosed in West German Patent Application (OLS) No. 3,008,588, Japanese Patent Application (OPI) No. 142530/81, and U.S. Pat. Nos. 4,343,893 and 4,619,884; or a group corresponding to a moiety containing a nitro group and a carbon atom connecting the nitro group to a photographic reagent in a nitro compound capable of releasing a photographic reagent after electron acceptance, such as disclosed in U.S. Pat. No. 4,450,223; and or a group corresponding to a moiety containing a gem-dinitro group and a carbon atom connecting the dinitro group to a photographic reagent in a dinitro compound capable of $\beta$-releasing a photographic reagent after electron acceptance, such as disclosed in U.S. Pat. No. 4,609,610.

The group represented by $(Time)_t$ is described below.

Of the compounds represented by formula (I), preferred are those represented by formula (II):

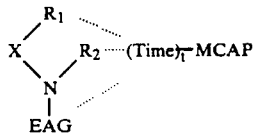

(II)

wherein X represents an oxygen atom, a sulfur atom or a nitrogen-containing group of formula $—N(R_3)—$; $R_1$, $R_2$, and $R_3$ each represents a chemical bond or a group other than a hydrogen atom; EAG represents an electron accepting group; or $R_1$, $R_2$, $R_3$ and EAG may be connected to each other to form a ring; Time represents a group capable of releasing MCAP upon cleavage of the N—X bond as a trigger followed by a subsequent reaction; MCAP and t are as defined above; when t is 0, Time represents a chemical bond; and the dotted lines indicate that at least one thereof represents a chemical bond.

In formula (II),

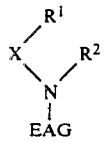

corresponds to PWR of formula (I). $(Time)_t$MCAP is bonded to at least one of $R_1$ $R_2$, and EAG.

The group other than a hydrogen atom as represented by $R_1$, $R_2$, and $R_3$ includes a substituted or unsubstituted alkyl or aralkyl group (e.g., methyl, trifluoromethyl, benzyl, chloromethyl, dimethylaminomethyl, ethoxycarbonylmethyl, aminomethyl, acetylaminomethyl, ethyl, 2-(4 dodecanoylaminophenyl)ethyl, carboxyethyl, allyl, 3,3,3-trichloropropyl, n-propyl, isopropyl, n-butyl, iso-butyl, sec-butyl, t-butyl, n-pentyl, sec-pentyl, t-pentyl, cyclopentyl, n hexyl, sec-hexyl, t-hexyl, cyclohexyl, n-octyl, sec-octyl, t octyl, n-decyl, n-undecyl, n-dodecyl, n-tetradecyl, n-pentadecyl, n-hexadecyl, sec-hexadecyl, t-hexadecyl, n-octadecyl, and t-octadecyl groups); a substituted or unsubstituted alkenyl group (e.g., vinyl, 2-chlorovinyl, 1 methylvinyl, 2-cyanovinyl, and cyclohexen-1-yl groups); a substituted or unsubstituted alkynyl group (e.g., ethynyl, 1-propynyl, and 2-ethoxycarbonylethynyl groups); a substituted or unsubstituted aryl group (e.g., phenyl, naphthyl, 3-hydroxyphenyl, 3 chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, and 4 tetradecyloxyphenyl groups); a substituted or unsubstituted heterocyclic group (e.g., 1-imidazolyl, 2-furyl, 2-pyridyl, 5 nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, and morpholino groups); a substituted or unsubstituted acyl group (e.g., acetyl, propionyl, butyroyl, iso-butyroyl, 2,2-dimethylpropionyl, benzoyl, 3,4-dichlorobenzoyl, 2-acetylamino-4-methoxybenzoyl, 4-methylbenzoyl, and 4-methoxy-3-sulfobenzoyl groups); a substituted or unsubstituted sulfonyl group (e.g., methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, and 4-n-dodecyloxybenzenesulfonyl groups); a substituted or unsubstituted carbamoyl group (e.g., carbamoyl, methylcarbamoyl, dimethylcarbamoyl, bis-(2-methoxyethyl)carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)propylcarbamoyl, 3-octanesulfonylaminophenycarbamoyl, and di-n-octadecylcarbamoyl groups); a substituted or unsubstituted sulfamoyl group (e.g., sulfamoyl, methyl-sulfamoyl, dimethylsulfamoyl, diethylsulfamoyl, bis(2-methoxyethyl)sulfamoyl, di-n-butylsulfamoyl, methyl-n-octylsulfamoyl, n-hexadecylmethysulfamoyl, 3-ethoxypropylmethyl sulfamoyl, N-phenyl-N-methylsulfamoyl, 4-decyloxyphenylsulfamoyl, and methyloctadecylsulfamoyl group), and the like.

$R_1$ and $R_3$ each preferably represents a substituted or unsubstituted alkyl, alkenyl, alkynyl, aryl, heterocyclic, acyl or sulfonyl group, etc. $R_1$ and $R_3$ each preferably contains 1 to 40 carbon atoms, and more preferably contains 1 to 36 carbon atoms.

$R_2$ preferably represents a substituted or unsubstituted acyl or sulfonyl group, and preferably contains 1 to 40 carbon atoms and more preferably contains 1 to 36 carbon atoms.

X preferably represents an oxygen atom. [$R_1$, $R_2$, $R_3$, and EAG may be taken together to form a ring.

EAG is described below.

More preferred among the compounds represented by formula (II) are those represented by formula (III):

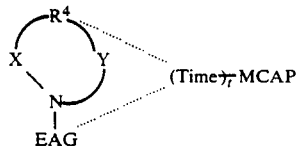

(III)

wherein Y represents a divalent linking group; and preferably

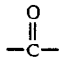

$R_4$ represents an atom group forming a 5- to 8- membered nitrogen-containing monocyclic or condensed heterocyclic ring together with X and Y; and X, EAG, Time, t, MCAP, and the dotted lines are as defined above.

In formula (III),

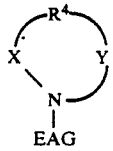

corresponds to PWR in formula (I), and $(Time)_t$MCAP is bonded to at least one of $R_4$ and EAG.

Specific and preferred examples of the heterocyclic ring formed by X, Y, $R_4$, and N are shown below, however the invention should not be construed as being limited thereto.

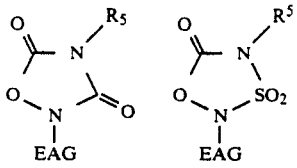

-continued
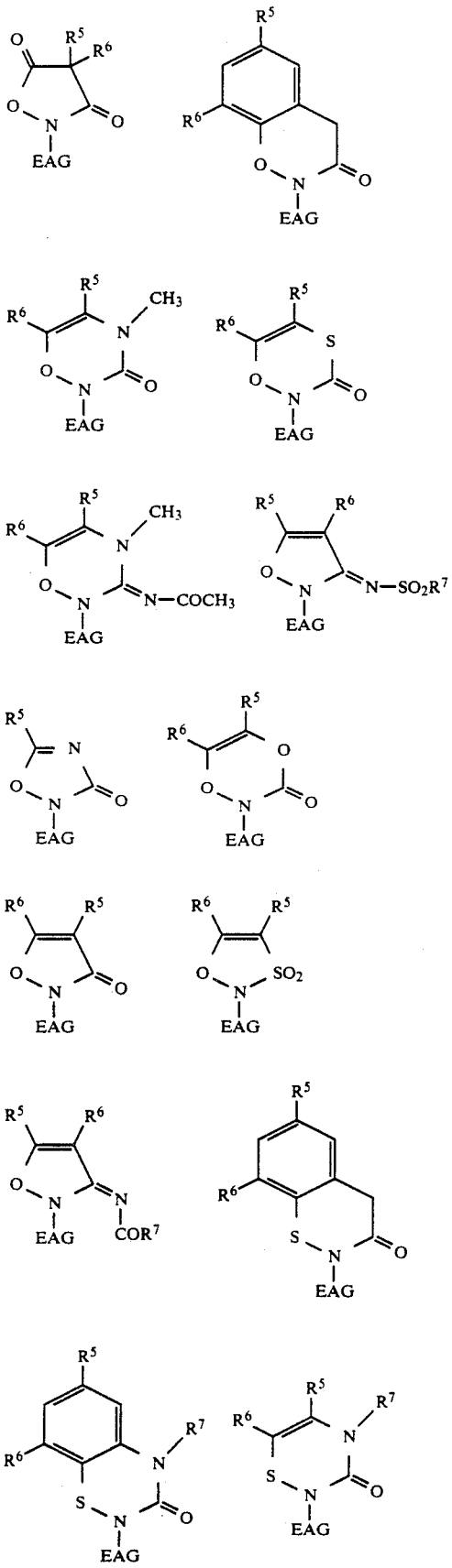
-continued
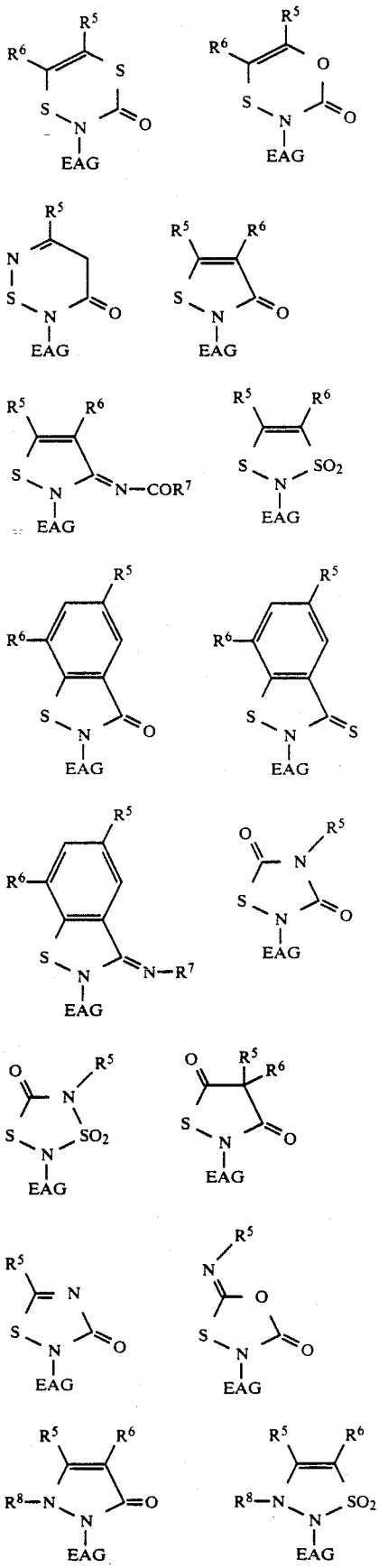

-continued

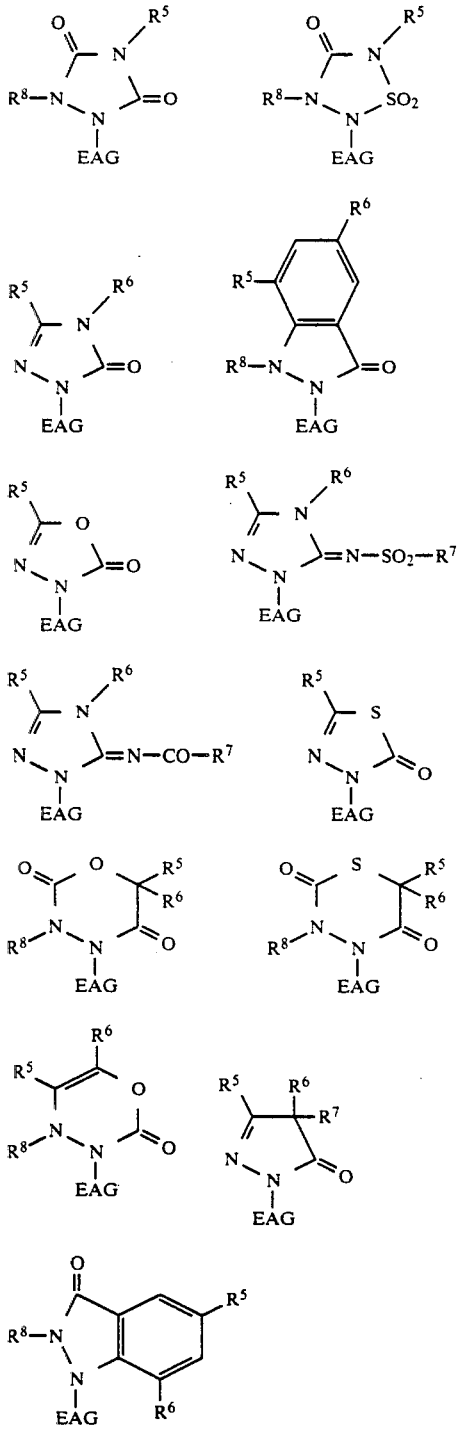

wherein $R_5$, $R_6$, and $R_7$ each represents a hydrogen atom, an alkyl group containing 1 to 40 carbon atoms, preferably 1 to 36 carbon atoms, an aryl group containing 6 to 40 carbon atoms, preferably 6 to 36 carbon atoms or a 5-membered to 8-membered heterocyclic group containing at least one hetero atom selected from S, N and O; and $R_8$ represents an acyl group containing 1 to 20 carbon atoms or a sulfonyl group containing 1 to 20 carbon atoms.

Particularly preferred examples of these heterocyclic rings are shown below, in which the bonding position of ⟨Time⟩$_T$MCAP is also shown, however the invention shall not be construed as being limited thereto.

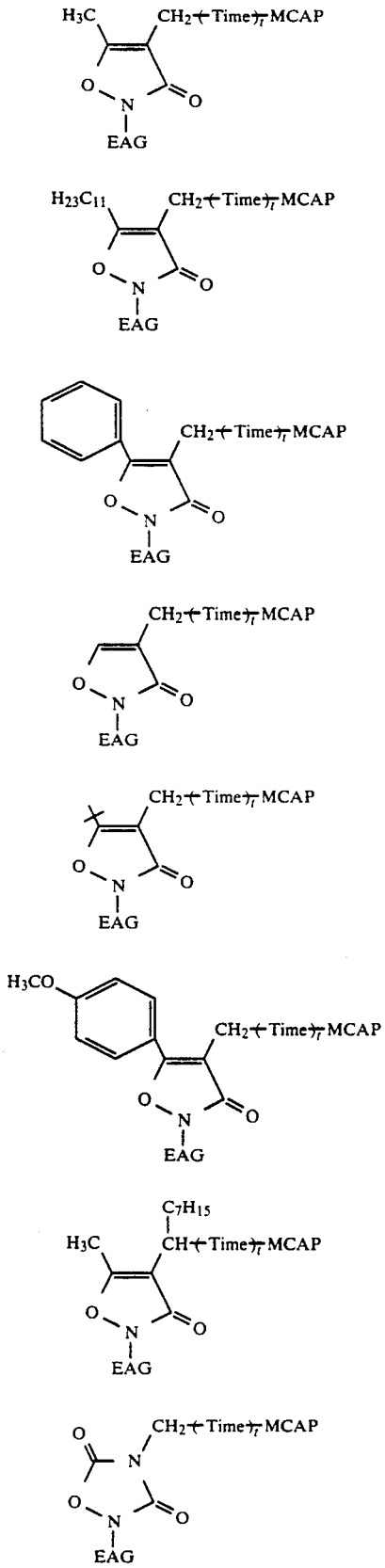

-continued
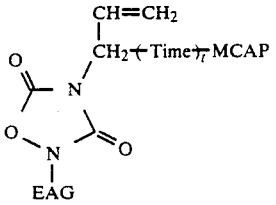
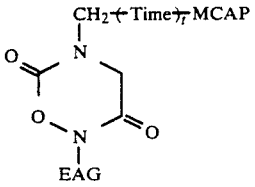
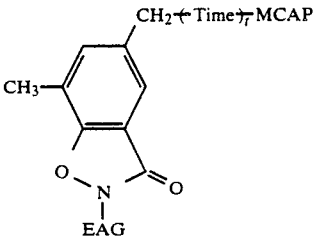
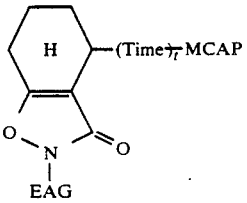
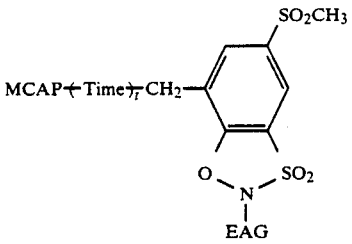
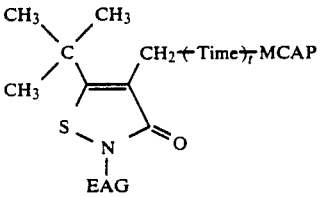
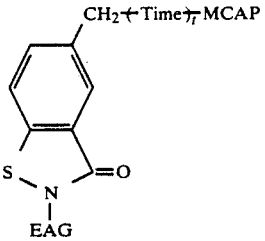
-continued
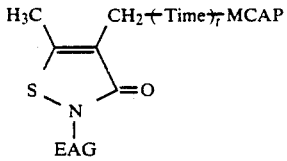
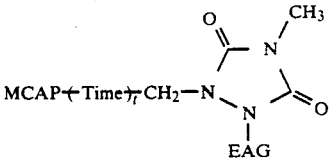
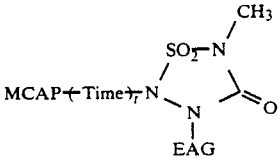
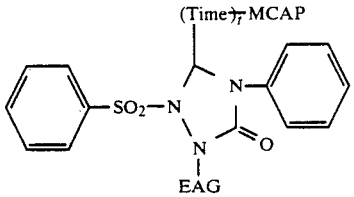
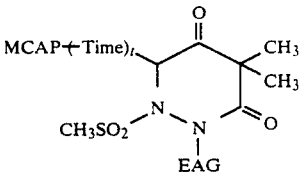
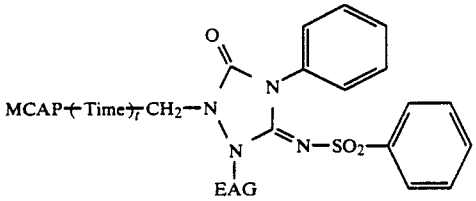
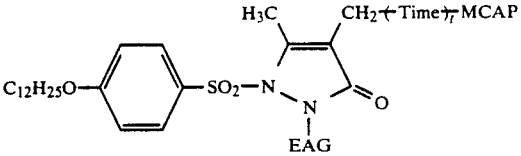
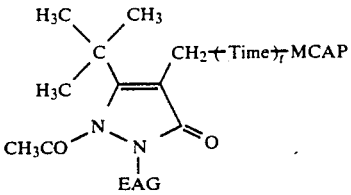

-continued

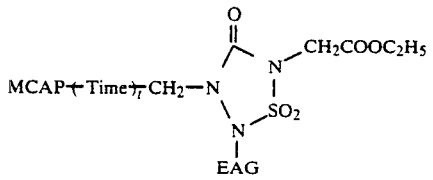

In formula (II), EAG represents an aromatic group which accepts an electron from a reducing substance and is bonded to the nitrogen atom. EAG preferably includes a group represented by formula (A):

(A)

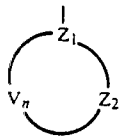

wherein $Z_1$ represents

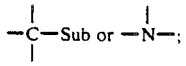

Vn represents an atom group forming a 3- to 8-membered aromatic ring together with $Z_1$ and $Z_2$; and n represents an integer of from 3 to 8; wherein $V_3$ is $—Z_3—$; $V_4$ is $—Z_3—Z4—$; $V_5$ is $—Z_3—Z_4—Z_5—$; $V_6$ is $—Z_3—Z_4—Z_5—Z_6—$; $V_7$ is $—Z_3—Z_4—Z_5—Z_6—Z_7—$; $V_8$ is $—Z_3—Z_4—Z_5—Z_6—Z_7—Z_8—$, wherein $Z_2$, $Z_3$, $Z_4$, $Z_5$, $Z_6$, $Z_7$, and $Z_8$ each represents

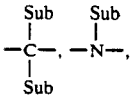

—O—, —S—or $—SO_2—$; plural Sub, which may be the same or different, each represents a chemical bond (η-bond), a hydrogen atom or a substituent hereinafter described, or they are connected to each other to form a 3- to 8-membered saturated or unsaturated carbon ring or heterocyclic ring.

In formula (A), the substituent represented by Sub is selected so that a sum of Hammett's sigma and para values are at least +0.50, preferably at least +0.70, and more preferably at least +0.85.

EAG preferably represents an aryl or heterocyclic group substituted with at least one electron attractive group (e.g., a halogen atom, a sulfonyl group, a cyano group, a nitro group, a trifluoromethyl group, etc.). The substituent on the aryl or heterocyclic group can be taken advantage of for controlling physical properties of the compound as a whole, such as ease of electron acceptance, water solubility, oil solubility, diffusibility, sublimating property, melting point, dispersibility in a binder (e.g., gelatin), reactivity to a nucleophilic group, reactivity to an electrophilic group, and the like.

Specific examples of the aryl group substituted with at least one electron attractive group are 4-nitrophenyl, 2-nitrophenyl, 2-nitro-4-N-methyl-N-n-butylsulfamoylphenyl, 2-nitro-4-N-methyl-N-n-octylsulfamoylphenyl, 2-nitro-4-N-methyl N n-dodecylsulfamoylphenyl, 2-nitro-4-N-methyl-N-n-hexadecylsulfamoylphenyl, 2-nitro-4-N-methyl-N-n-octadecylsulfamoylphenyl, 2-nitro-4-N-methyl-N-(3-carboxypropyl)sulfamoylphenyl, 2-nitro-4-N-ethyl-N-(2-sulfoethyl)sulfamoylphenyl, 2-nitro-4-N-n-hexadecyl-N-(3-sulfopropyl)sulfamoylphenyl, 2-nitro-4-N-(2-cyanoethyl)-N-[(2-hydroxyethoxy)ethyl]sulfamoylphenyl, 2-nitro-4-diethylsulfamoylphenyl, 2-nitro-4-di-n-butylsulfamoylphenyl, 2-nitro-4-di-n-octylsulfamoylphenyl, 2-nitro-4-di-n-octadecylsulfamoylphenyl, 2-nitro-4-methylsulfamoylphenyl, 2-nitro-4-n-hexadecylsulfamoylphenyl, 2-nitro-4-N-methyl-N-(4-dodecylsulfonylphenyl)sulfamoylphenyl, 2-nitro-4-(3-methylsulfamoylphenyl)sulfamoylphenyl, 4-nitro-2-N-methyl-N-n-butylsulfamoylphenyl, 4-nitro-2-N-methyl N-n-octylsulfamoylphenyl, 4-nitro-2-N-methyl-N-n-dodecylsulfamoylphenyl, 4-nitro-2-N-methyl-N-n-hexadecylsulfamoylphenyl, 4-nitro-2-N-methyl-N-n-octadecylsulfamoylphenyl, 4-nitro-2-N-methyl-N-(3-carboxypropyl)sulfamoylphenyl, 4-nitro-2-N-ethyl-N-(2-sulfoethyl)sulfamoylphenyl, 4-nitro-2-N-n-hexadecyl-N-(3-sulfopropyl)sulfamoylphenyl, 4-nitro-2-N-(2-cyanoethyl)-N-[(2-hydroxyethoxy)ethyl]-sulfamoylphenyl, 4-nitro 2-diethylsulfamoylphenyl, 4-nitro-2-di-n-butylsulfamoylphenyl, 4-nitro-2-di-n-octylsulfamoylphenyl, 4-nitro-2-di n-octadecylsulfamoylphenyl, 4-nitro-2-methylsulfamoylphenyl, 4-nitro-2-n-hexadexylsulfamoylphenyl, 4-nitro-2-N-methyl-N-(4-dodecylsulfonylphenyl)sulfamoylphenyl, 4-nitro-2-(3-methylsulfamoylphenyl)sulfamoylphenyl, 4-nitro-2 chlorophenyl, 2-nitro-4-chlorophenyl, 2-nitro-4-N-methyl-N-n-butylcarbamoylphenyl, 2-nitro-4-N-methyl-N-n-octylcarbamoylphenyl, 2-nitro-4-N-methyl N n-dodecylcarbamoylphenyl, 2-nitro-4-N-methyl-N-n-hexadecylcarbamoylphenyl, 2-nitro-4-N-methyl-N-n octadecylcarbamoylphenyl, 2-nitro-4-N-methyl-N-(3 carboxypropyl)carbamoylphenyl, 2-nitro-4-N-ethyl-N-(2-sulfoethyl)carbamoylphenyl, 2-nitro-4-N-n-hexadecyl-N-(3-sulfopropyl)carbamoylphenyl, 2-nitro-4-N-(2-cyanoethyl)-N-[(2-hydroxyethoxy)ethyl]carbamoylphenyl, 2-nitro-4-diethylcarbamoylphenyl, 2-nitro-4-di-n-butylcarbamoylphenyl, 2-nitro-4-di-n-octylcarbamoylphenyl, 2-nitro-4-di-n-octadecylcarbamoylphenyl, 2-nitro-4-methyl-carbamoylphenyl, 2-nitro-4-n-hexadecylcarbamoylphenyl, 2-nitro-4-N-methyl-N (4-dodecylsulfonylphenyl}carbamoylphenyl, 2-nitro-4-(3-methylsulfamoylphenyl)carbamoylphenyl, 4-nitro-2-N-methyl-N-n-butylcarbamoylphenyl, 4-hexadecylcarbamoylphenyl, 4-nitro-2-N-methyl-N-n-octadecylcarbamoylphenyl, 4-nitro-2-N-methyl-N-(3-carboxyphenyl, propyl)carbamoylphenyl, 4-nitro-2-N-ethyl-N-(2-sulfoethyl)carbamoylphenyl, 4-nitro-2-N-n-hexadecyl-N-(3-sulfopropyl)carbamoylphenyl, 4-nitro 2-N-(2-cyanoethyl)-N-[(2-hydroxyethoxy)ethyl]carbamoylphenyl, 4-nitro-2-diethylcarbamoylphenyl, 4-nitro-2-di-n-butylcarbamoylphenyl, 4-nitro-2-di-n-octylcarbamoylphenyl, 4-nitro-2-di-n-octadecylcarbamoylphenyl, 4-nitro-2-methylcarbamoylphenyl, 4-nitro-2-n-hexadecylcarbamoylphenyl, 4-nitro-2-N-methyl-N-(4-dodecylsulfonylphenyl)carbamoylphenyl, 4-nitro-2-(3-methylsulfamoylphenyl)carbamoylphenyl, 2,4-dimethanesulfonylphenyl, 2-methanesulfonyl-4-benzenesulfonylphenyl, 2-n-octanesulfonyl-4-methanesulfonylphenyl, 2-n-tetradecanesulfonyl-4-methanesulfonylphenyl, 2-n-hexadecanesulfonyl-4 methanesulfonylphenyl, 2,4-di-n-dodecanesulfonylphenyl, 2,4-didodecanesulfonyl-5-trifluoromethylphenyl, 2-n-decanesulfonyl-4-cyano-5-trifluoromethylphenyl, 2-cyano-4-methanesulfonylphenyl, 2,4,6-tricyanophenyl, 2,4-dicyanophenyl, 2-nitro-4-methanesulfonylphenyl, 2-nitro-4-n-dodecanesulfonylphenyl, 2-nitro-4-(2-sulfoethylsulfonyl)phenyl, 2-nitro-4-carboxymethylsulfonylphenyl, 2-nitro-4-carboxyphenyl, 2-nitro-4-ethoxycarbonyl-5-n-butoxyphenyl, 2-nitro-4-ethoxycarbonyl-5-n-hexadecyloxyphenyl, 2-nitro-4-diethylcarbamoyl-5-n-hexadecyloxyphenyl, 2-nitro-4 cyano-5-n-dodecylphenyl, 2,4-dinitrophenyl, 2-nitro-4-n-decylthiophenyl, 3,5-dinitrophenyl, 2 nitro-3,5-dimethyl-4-n-hexadecanesulfonylphenyl, 4-methanesulfonyl-2-benzene-sulfonylphenyl, 4-n-octane-2-methanesulfonylphenyl, 4-n-hexadecanesulfonyl-2-methane-sulfonylphenyl, 2,5-didodecanesulfonyl-4-trifluoromethylphenyl, 4-n-decanesulfonyl-2-cyano-5-trifluoromethylphenyl, 4-cyano-2-methanesulonylphenyl, 4-nitro-2-methanesulfonylophenyl, 4-nitro-2-n-dodecanesulfonylphenyl, 4-nitro-2-(2-sufoethylsulfonyl)phenyl, 4-nitro-2-carboxymethylsulfonylphenyl, 4-nitro-2-carboxyphenyl, 4-nitro-2-ethoxycarbonyl-5-n -butoxyphenyl, 4-nitro-2-ethoxycarbonyl-5-n-hexadecyloxyphenyl, 4-nitro-2-diethylcarbamoyl-5-n-hexadecyloxyphenyl, 4-nitro-2-cyano-5-n-dodecylphenyl, 4-nitro-2-n-decylthiophenyl, 4-nitro-3,5-dimethyl-2-n-hexadecanesulfonylphenyl, 4-nitronaphthyl, 2,4-dinitronaphthyl, 4-nitro-2-n-octadecylcarbamoylnaphthyl, 4-nitro-2-dioctylcarbamoyl-5-(3-sufobenzenesulfonylamino)naphthyl, 2,3,4,5,6-pentafluorophenyl, 2-nitro-4-benzoylphenyl, 2,4-diacetylphenyl, 2-nitro-4-trifluoromethylphenyl, 4-nitro-2-trifluoromethylphenyl, 4-nitro-3 trifluoromethylphenyl, 2,4,5-tricyanophenyl, 3,4-dicyanophenyl, 2-chloro-4,5-dicyanophenyl, 2-bromo-4,5-dicyanophenyl, 4-methanesulfonylphenyl, 4-n-hexadecanesulfonylphenyl, 2-decane-sulfonyl-5-trifluoromethylphenyl, 2-nitro-5-methylphenyl, 2-nitro-5-n-octadecyloxyphenyl, 2-nitro-4-N-(vinylsulfonylethyl)-N-methylsulfamoylphenyl, and 2-methyl-6-nitrobenzoxazol 5-yl groups.

Specific examples of the heterocyclic group substituted with at least one electron attractive group are 2-pryridyl, 3-pyridyl, 4-pyridyl, 5-nitro-2-pyridyl, 5-nitro-N-hexadecylcarbamoyl-2-pyridyl, 3,5-dicyano-2-pyridyl, 5-dodecanesulfonyl-2-pyridyl, 5-cyano-2-pyrazyl, 4-nitrothiophen-2-yl, 5-nitro-1,2-dimethylimidazol-4-yl, 3,5-diacetyl-2-pyridyl, 2-dodecyl-5-carbamoylpyridinium-2-yl, 5-nitro-2-furyl, and 5-nitrobenzothiazol-2-yl groups.

The group represented by —Time)$_t$MCAP is described below.

Time represents a group capable of releasing MCAP upon cleavage of a nitrogen-oxygen bond, a nitrogen-nitrogen bond or a nitrogen-sulfur bond and through the subsequent reaction.

Various known groups, e.g., those described in Japanese Patent Application (OPI) Nos. 147244/86 (pp. 5–6) and 236549/86 (pp. 8–14), European Patent 220,746 A2 (pp. 11–22) and U.S. Ser. No. 925,350 filed Oct. 30, 1986, can be employed as the Time group.

Specific preferred examples of Time are shown below. In the following formulae, (*) indicates the position to which PWR in formula (I) or the dotted line in formulae (II) or (III) is connected, and (*)(*) indicates the position to which MCAP is bonded.

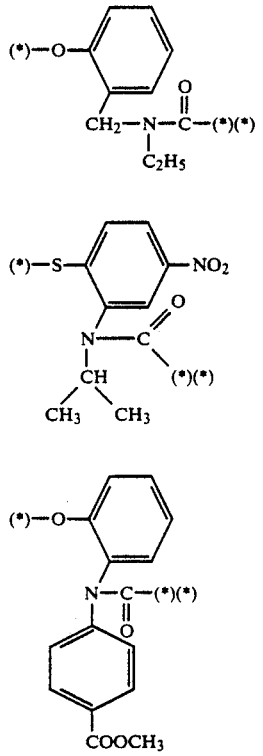

(3)

-continued
(4)
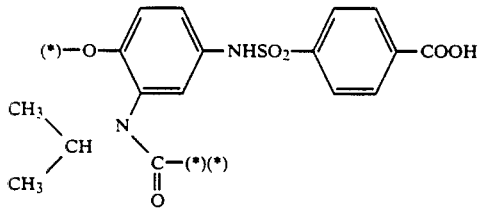
(5)
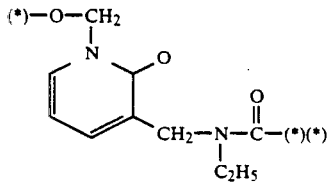
(6)
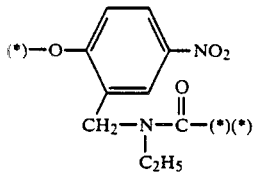
(7)
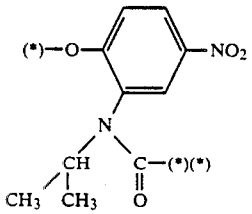
(8)
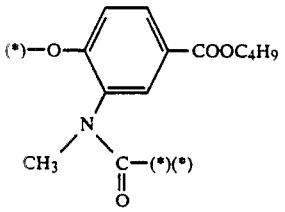
(9)
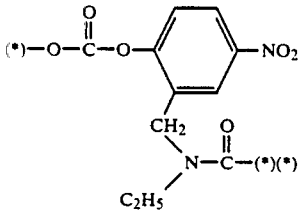
(10)
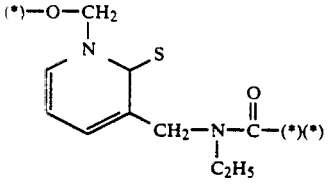

-continued
(11)
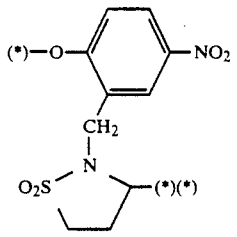
(12)
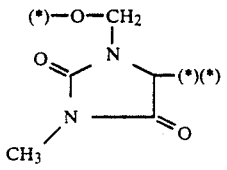
(13)
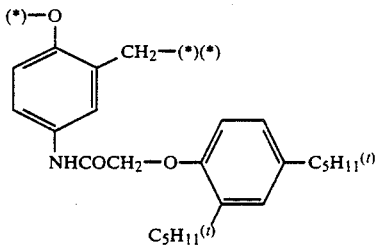
(14)
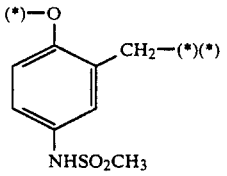
(15)
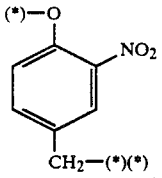
(16)
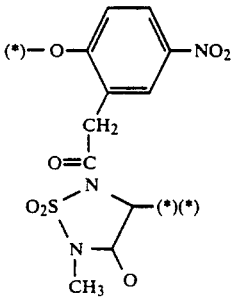
(17)
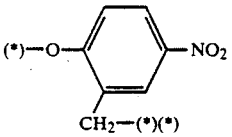

-continued
(18)
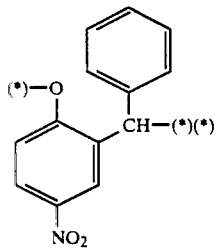
(19)
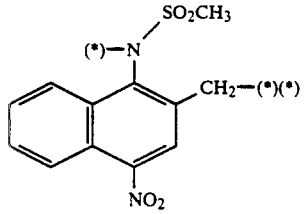
(20)
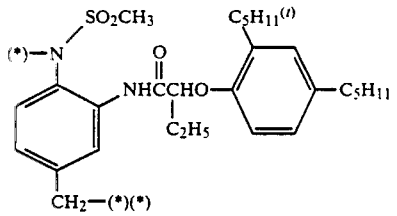
(21)
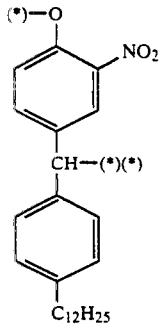
(22)
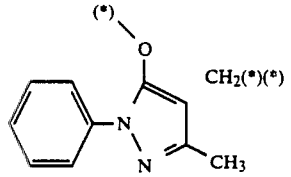
(23)
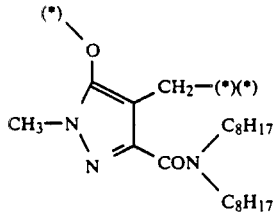
(24)
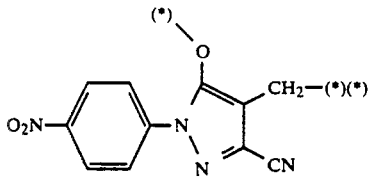

-continued
(25)
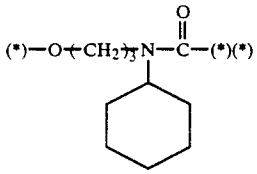
(26)
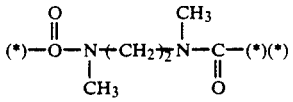
(27)
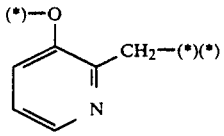
(28)
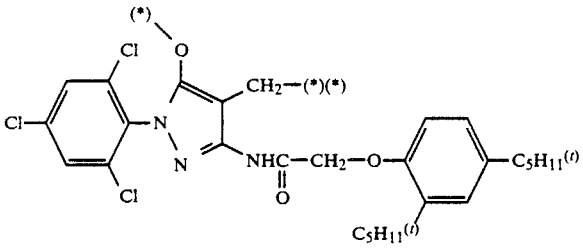
(29)
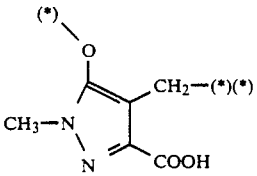
(30)
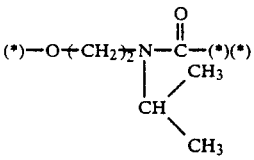
(31)
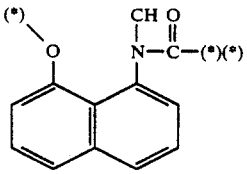
(32)
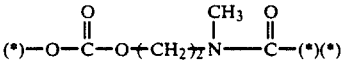
(33)
(34)
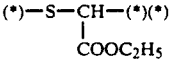
(35)
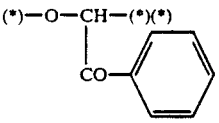

-continued (36)

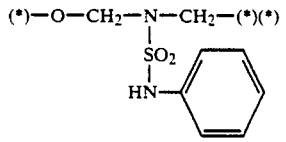

(37)

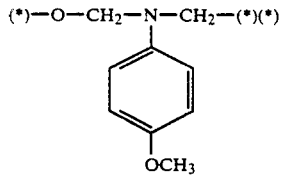

(38)

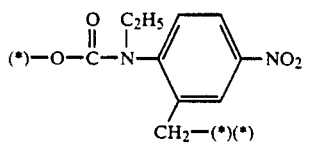

(39)

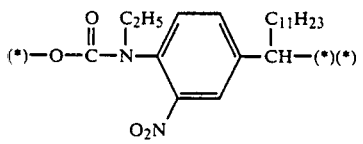

(40)

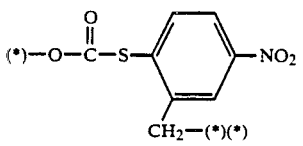

(41)

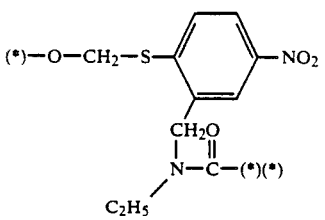

(42)

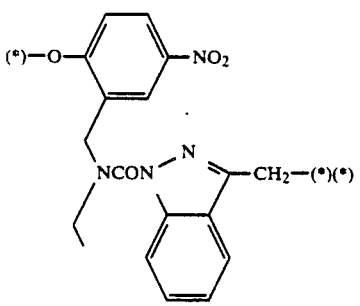

It is preferable that the compounds of formula (I) are immobile in the layers where they are incorporated. Since MCAP released from the compound of formula (I) upon cleavage is discharged from the light-sensitive system, for example, into a processing solution (e.g., a developer, or into a transfer sheet), a group providing the above-described immobility to the compound (I), preferably an organic group having at least 8 carbon atoms (i.e., a ballast group), is preferably added to the PWR moiety.

MCAP is a group having a capability of inhibiting dye image discoloration, and is preferably a group which is water soluble after being released. Preferred as MCAP, is a transition metal complex having discoloration inhibitory activity, more preferably a transition metal complex which is dissolved out of a silver halide material during development processing, and most preferably a transition metal complex having at least one carboxyl group or sulfo group.

The transition metal complex having discoloration inhibitory activity includes those described in Japanese Patent Application (OPI) Nos. 12129/80, 168652/81, 83162/84, 62826/79, 62987/79, 65185/79, 69580/79, 72780/79, 82234/79, 82384/79, 82385/79, 82386/79, and 136581/79; Japanese Patent Publication No. 13744/86; Japanese Patent Application (OPI) Nos. 12129/80 and 167138/81; U.S. Pat. No. 4,050,938; Japanese Patent Application (OPI) No. 11704/86; and acetylacetonato chelate complexes, dithiocarbamate chelate complexes, thiobisphenoxylate chelate complexes, etc., such as described in T. Saegusa, H. Ueda, and H. Hirai, *Kagaku Zokan,* Vol. 77, 247 "Kobunshi Kinzoku Sakutai", Kagaku Dojin (1978).

More preferred among the above-noted transition metal complexes, are those represented by formula (IV) or V):

(IV)

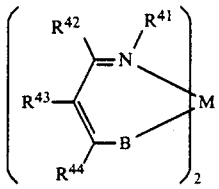

(V)

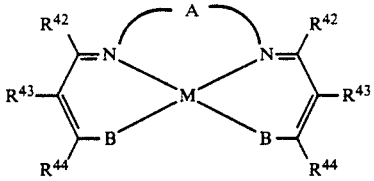

wherein $R^{41}$ represents a hydrogen atom, a hydroxyl group, an aliphatic group (e.g., methyl, ethyl, propyl, dimethylaminoethyl, benzyl, hydroxyethyl, p-hydroxybenzyl, 2-sulfoethyl, butyl, octyl, hexadecyl, and 2-carboxyethyl groups), or an aromatic group (e.g., phenyl, p-hydroxyphenyl, m-methoxyphenyl, p-dimethylaminophenyl, p-acetylaminophenyl, o-chlorophenyl, m-sulfophenyl, p-carboxyphenyl, p-sulfophenyl, and p-(4-sulfobutoxy)phenyl groups); $R^{42}$ and $R^{44}$ each represents a hydrogen atom, an aliphatic group (e.g., methyl, ethyl, dodecyl, pentadecyl, methoxymethyl, 2 chloroethyl, benzyl, and hydroxyethyl groups), or an aromatic group (e.g., phenyl, m-(3-sulfopropyloxy)phenyl, m-hydroxyphenyl, p-[N-methyl-N-(4-sulfobutyl-)amino]phenyl, o-hydroxyphenyl, and m-chlorophenyl groups); R43 represents a hydrogen atom or an alphatic group (e.g., methyl, ethyl, and hexyl groups); or $R^{43}$ and $R^{44}$ are connected to form a ring (such as cycloalkene rings (e.g., a cyclohexene ring and a cyclopentene ring), heterocyclic rings (e.g., a pyrazole ring), and aromatic rings (e.g., a benzene ring and a naphthalene ring)); A represents a divalent linking group (e.g., an ethylene group, a propylene group, a methylethylene group, a group of formula $-(CH_2)_g NR^{45}-(CH_2)_g$ (wherein $R^{45}$ represents a hydrogen atom or an alkyl group (e.g., methyl and ethyl groups), and g represents an integer of from 1 to 5); B represents an oxygen atom or a sulfur atom; and M represents Cu, Co, Ni, Pd or Pt; with the proviso that at least one of $R^{41}$, $R^{42}$, $R^{43}$, $R^{44}$ and A represents a group connected to $(Time)_t$ and at least one of $R^{41}$, $R^{42}$, $R^{43}$, $R^{44}$, and A represents a carboxyl group, a sulfo group, or a group having a carboxyl or sulfo group.

The most preferred of the MCAP moieties of formulae (IV) and (V) are those represented by formula (IVa) or (Va)

(IVa)

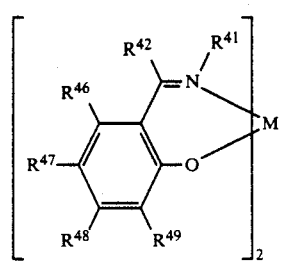

(Va)

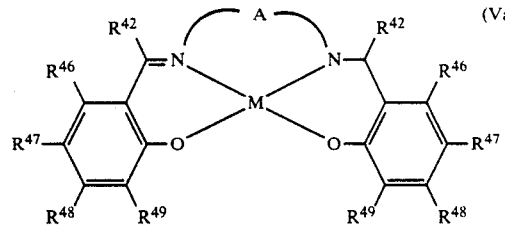

wherein $R^{41}$, $R^{42}$, A, and M are as defined above; $R^{46}$, $R^{47}$, $R^{48}$, and $R^{49}$, which may be the same or different, each represents a hydrogen atom, a hydroxyl group, a cyano group, a halogen atom (e.g., chlorine, bromine, and fluorine atoms), a carboxyl group, a sulfo group, or a substituted or unsubstituted alkyl group (e.g., methyl, ethyl, isobutyl, 2-ethylhexyl, octyl, dodecyl, pentadecyl, isooctadecyl, 2-carboxyethyl, 2-sulfoethyl, 2-hydroxyethyl, diethylaminoethyl, 3-sulfopropyl, 4-sulfobutyl, 4-methoxybutyl, and benzyl group), or a substituted or unsubstituted aryl group (e.g., phenyl, p-methoxyphenyl, p-sulfobutoxyphenyl, and p-cyanophenyl groups), which is bonded to the benzene ring either directly or via a divalent linking group (e.g., —O—, —S—, —CO—, —COO—, $-SO_2-$, —NHCO—, $-NHSO_2-$, —NHCONH—, $-NR^{50}-$, wherein R50 represents a hydrogen atom or a substituted or unsubstituted alkyl group (e.g., methyl, ethyl, butyl, isopropyl, 2-sulfoethyl, hydroxyethyl, 4-sulfobutyl, and 3-carboxyethyl groups)). Also, a pair of $R^{42}$ and $R^{46}$, a pair of $R^{46}$ and $R^{47}$, a pair of $R^{47}$ and $R^{8}$, or a pair of $R^{48}$ and $R^{49}$, are connected to each other to form a 5- or 6-membered ring; with the proviso that at least one of $R^{41}$, $R^{42}$, $R^{46}$, $R^{47}$, $R^{48}$, $R^{49}$ and A represents a group connected to $(Time)_t$ and at least one Of $R^{41}$, $R^{42}$, $R^{46}$, $R^{47}$, $R^{48}$, $R^{49}$, and A represents a carboxyl group, a sulfo group, or a group having a carboxyl or sulfo group.

Specific but non-limiting examples of the compounds according to the present invention are shown below.

1
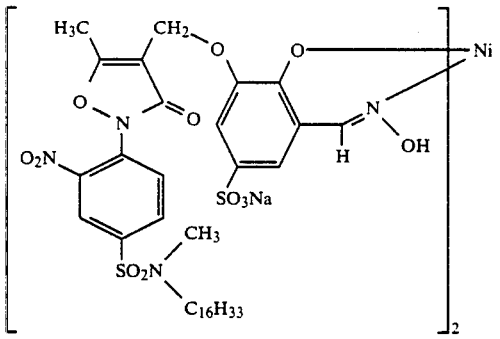
2
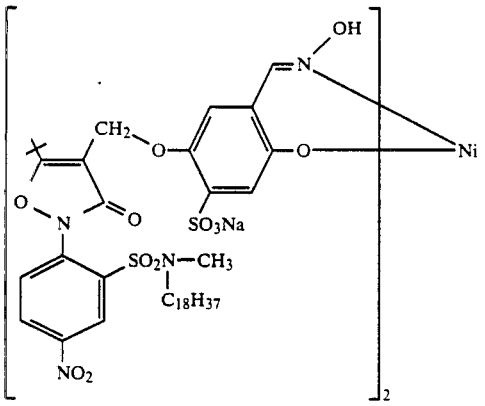
3
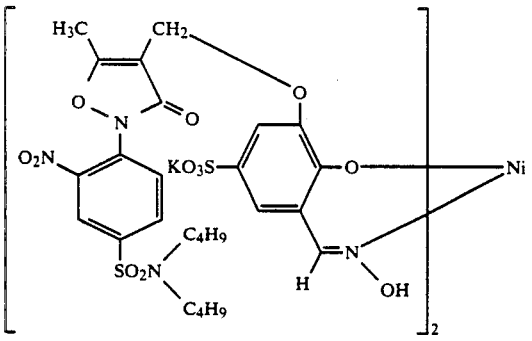
4
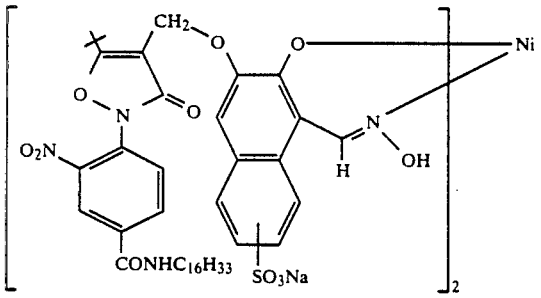

-continued
5
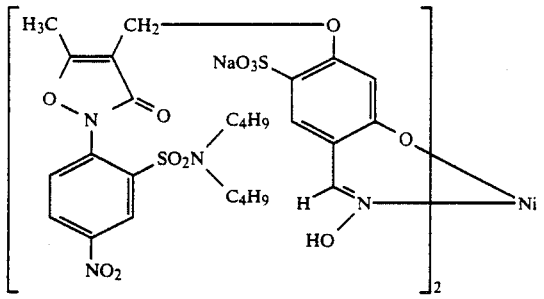
6
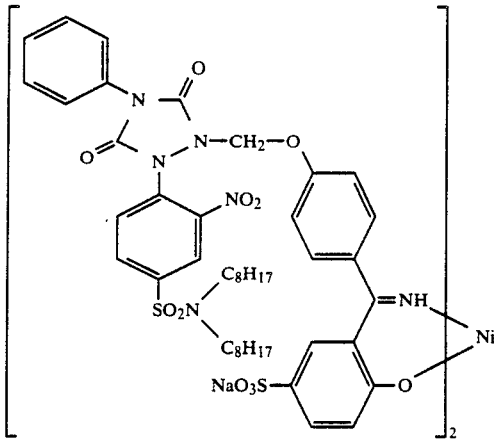
7
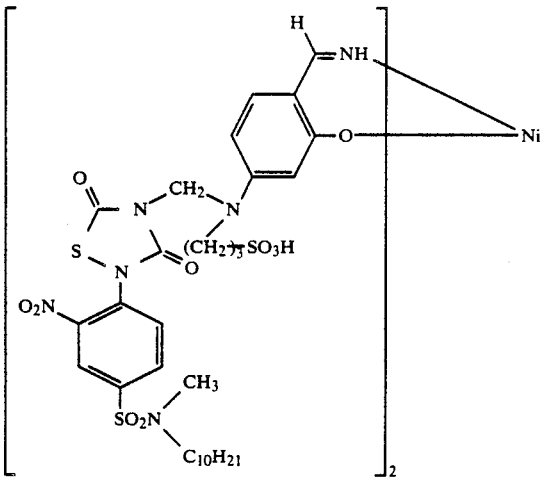
8
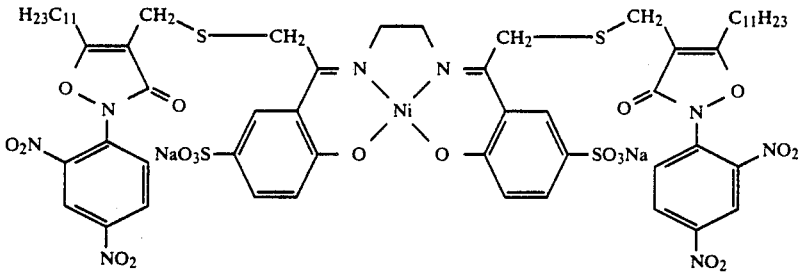

-continued
9
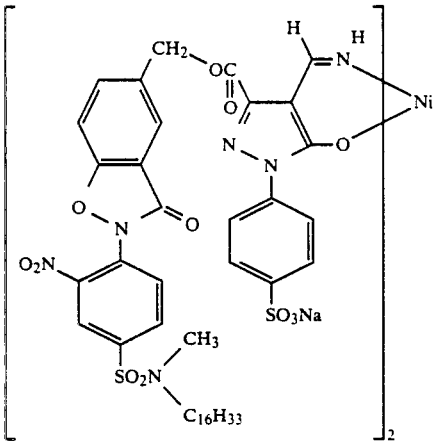
10
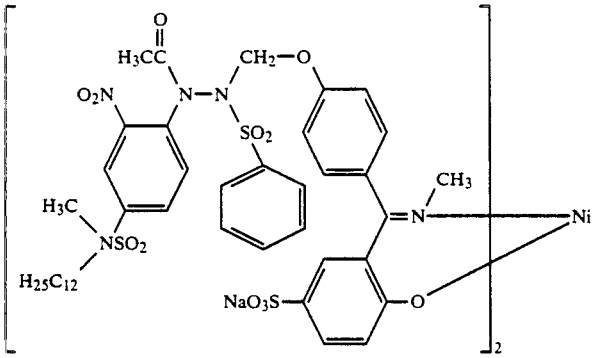
11
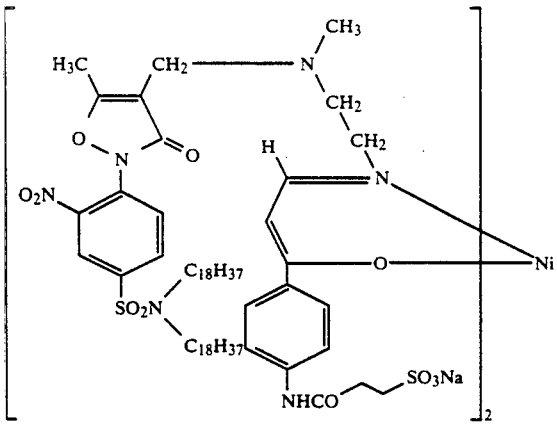
12
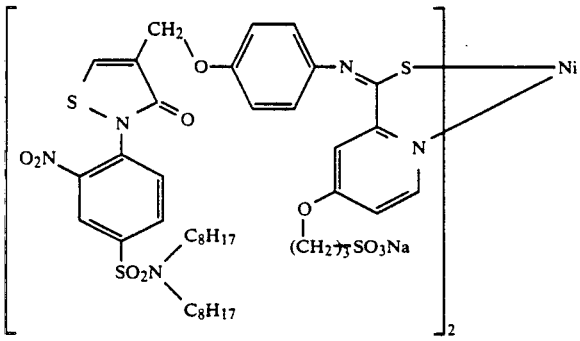

-continued
13
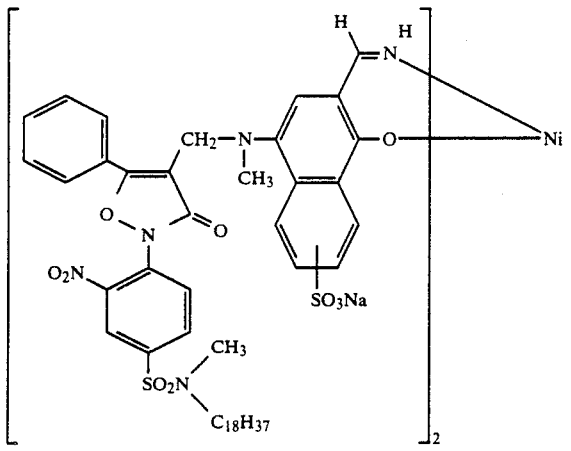
14
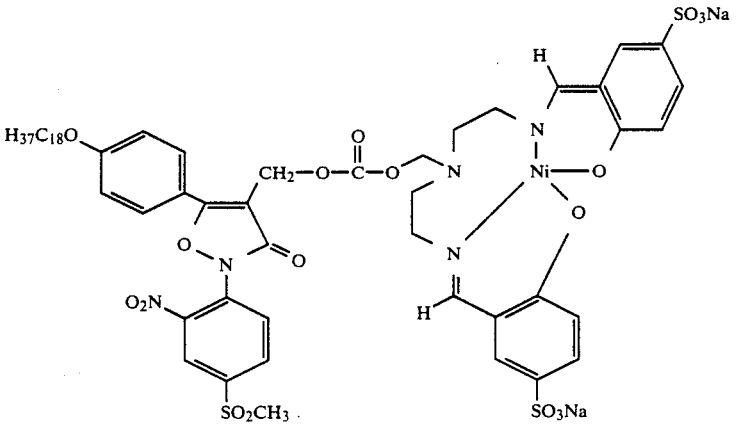
15
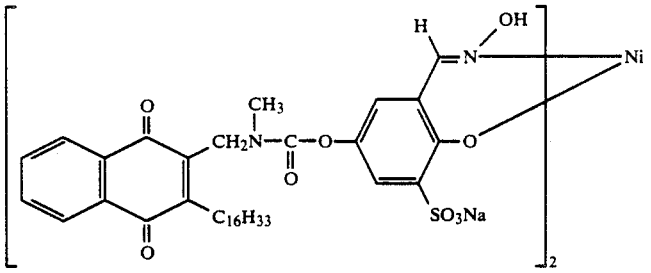
16
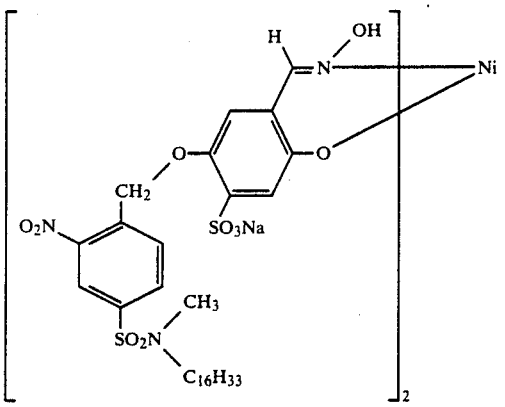

-continued
17
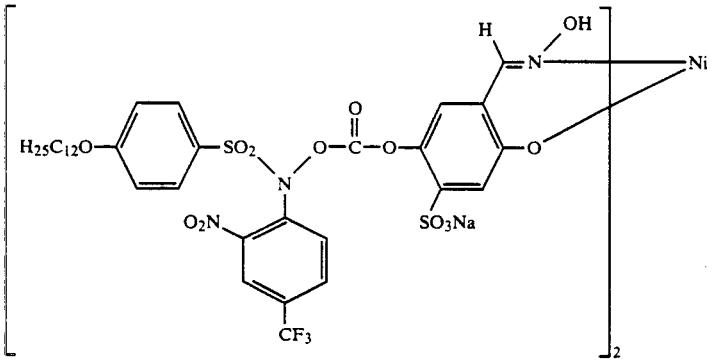
18
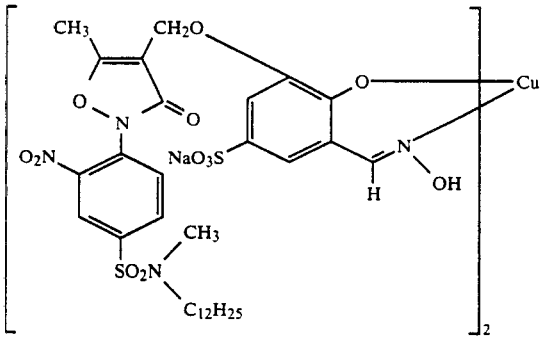
19
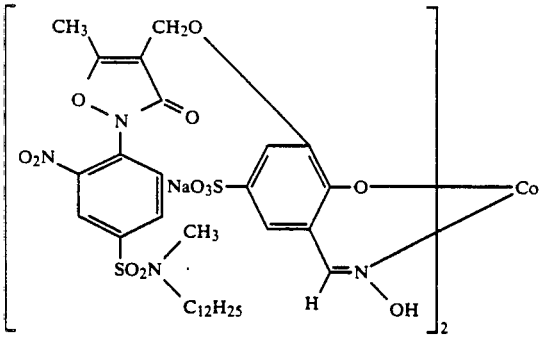
20
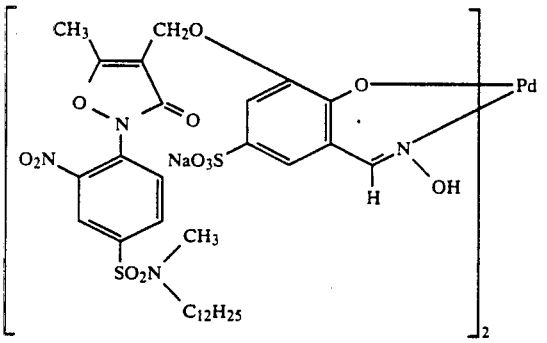

-continued
21
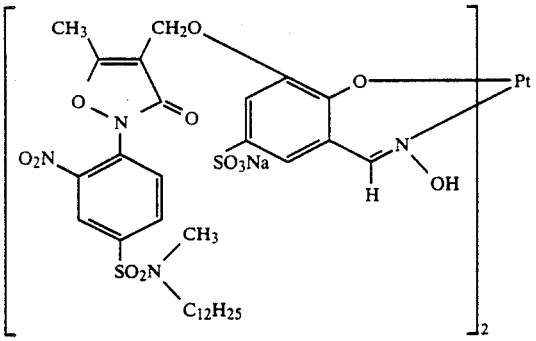
22
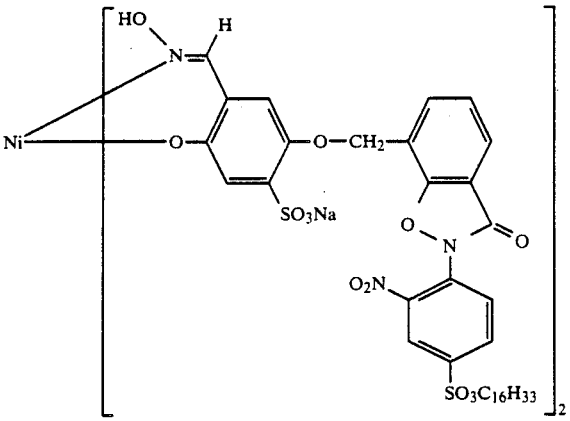
23
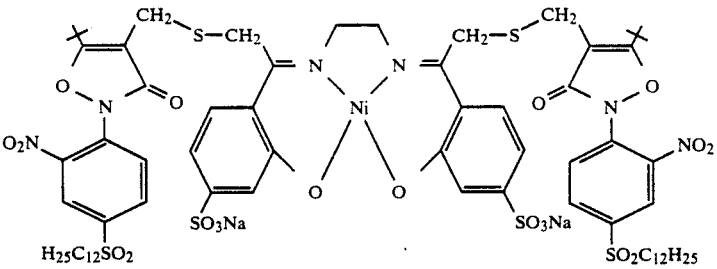
24
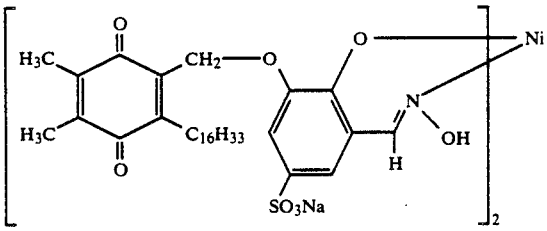
25
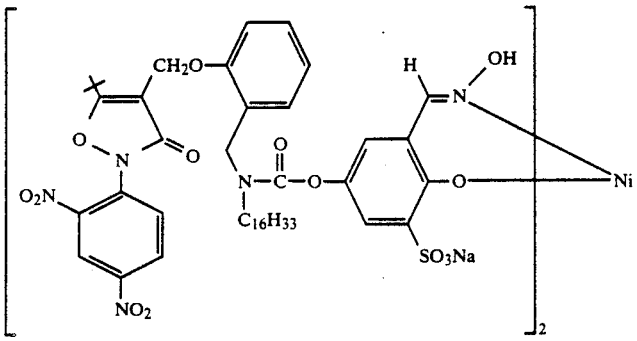

The synthesis of the compounds represented by formula (I) will be described below.

The moiety represented by PWR in formula (I) can be synthesized with reference to the synthesis examples disclosed in the literature cited above with respect to PWR (i.e., U.S. Pat. Nos. 4,139,389, 4,139,379, and 4,564,577; Japanese Patent Application (OPI) Nos. 185333/84 and 84453/82; U.S. Pat. No. 4,232,107; Japanese Patent Application (OPI) No. 101649/84; *Research Disclosure,* (RD No. 24025), IV (1984); Japanese Patent Application (OPI) No. 88257/86; West German Patent Application (OLS) No. 3,008,588; Japanese Patent Application (OPI) No. 142530/81; and U.S. Pat. Nos. 4,343,893, 4,619,884, 4,450,223, and 4,609,610).

Linking of PWR to $\leftarrow$Time$\rightarrow_n$MCAP Can be achieved with reference to the processes disclosed in the above-cited literature or the process hereinafter described.

The moiety represented by MCAP can be synthesized with reference to the literature cited above with respect to MCAP. The moiety represented by Time can be synthesized with reference to Japanese Patent Application (OPI) Nos. 147244/86 and 244873/85, and the patents cited therein.

Details of the synthesis of the compounds represented by formula (II) are described below according to the type of X component bonded to the nitrogen atom (i.e., an oxygen atom, a sulfur atom, or a nitrogen atom).

Synthesis I)

Synthesis of compound (II), wherein X is oxygen

The most important point of the synthesis lies in the manner of bonding the N—O group and the electron accepting group (EAG). The bonding process is divided into two board types: one process comprises introducing a nitro group into the electron accepting moiety, reducing the introduced nitro group with a zinc-ammonium chloride system to convert it to hydroxylamine, and bonding —Time$\rightarrow_n$MCAP thereto; and another process comprises introducing a displaceable group, such as a halogen atom, into the electron accepting moiety and displacing it with hydroxylamine or an equivalent thereof by nuclephilic substitution.

Reference can be made to the first process, in S.R. Sandler & W. Karo, *Organic Functional Group Preparations,* Vol. 3, p.p. 321-364. The synthesis according to the second process can be achieved by reaction in ethanol, dimethylformamide or dimethyl sulfoxide under neutral or basic conditions.

Synthesis IIa)

Synthesis of compound (II), wherein X is sulfur and the N—S bond is not included in a heterocyclic ring This synthesis includes the two reaction routes, A and B. Route A comprises synthesizing a sulfenamide from a sulfenyl chloride and an amine, which is then bonded to an N-acyl or N-sulfonylsulfenamide by making use of the nucleophilic property of the remaining amine. Route B comprises first synthesizing an N-acylated or N-sulfonated compound from an amine, generating an anion on the nitrogen atom of the compound, and subjecting it to a nucleophilic substitution reaction with a sulfenyl chloride.

The sulfenyl chloride to be used can be prepared by reacting the corresponding disulfide or thiol with chlorine or sulfuryl chloride. The disulfide can be synthesized mainly by substitution reaction between an alkali disulfide and $R_1$—Cl (or $R_1$—$N_2^{\oplus}X^{\ominus}$), and the thiol can be synthesized by the general process described in Saul Patai, *The Chemistry of the Thiol Group Part* 1, Chapter 4, John Wiley & Sons (1974).

Synthesis IIb)

Synthesis of Compound (II), wherein X is sulfur and the N—S bond is included in a heterocyclic ring The processes are divided into two broad groups. The first group of processes comprises synthesizing a heterocyclic ring containing a nitrogen-sulfur bond and then bonding an electron accepting moiety to the nitrogen atom. A number of processes for synthesizing such a heterocyclic ring have been proposed, for example in *Comprehensive Heterocyclic Chemistry.* The reaction between the heterocyclic ring and the electron accepting moiety can be carried out in a solvent, e.g., ethanol, dimethylformamide, dimethyl sulfoxide, etc., under a neutral or basic condition.

The second group of processes comprises cyclizing a nitrogen atom bonded to an electron accepting moiety.

Synthesis III)

Synthesis of compound (II), wherein X is nitrogen

The processes are divided into two broad group, Process A and Process B.

In Process A, an electron accepting group, which undergoes an aromatic nucleophilic substitution reaction, such as 4-halo-3-nitrobenzenesulfonamides, is reacted with a hydrazide or sulfonylhydrazine in an aprotic polar solvent (e.g., dimethyl sulfoxide and dimethylformamide), in the presence of a base, and the product is halomethylated. Then, MCAP or a group which can be led to MCAP is bonded to the halomethylated compound through substitution reaction. Alternatively, if MCAP, or a precursor thereof, is reactive with the hydrazide or sulfonylhydrazine, these compounds are directly reacted.

In Process B, an electron accepting group which undergoes an aromatic nucleophilic substitution reaction, such as the 4-halo-3-nitrobenzenesulfonamides, is reacted with a heterocyclic compound having an N—N single bond, with either one of the nitrogen atoms thereof being dissociative in the aprotic polar solvent, as used in Process A, to thereby bond the electron accepting group to the nitrogen atom of the heterocyclic ring. According to this reaction route, appropriate selection of the abovedescribed heterocyclic compound would lead to the release of MCAP as shown in some of the specific examples of the compounds of the present invention.

For better understanding, the aforesaid general synthesis processes are illustrated by the following synthesis examples.

SYNTHESIS EXAMPLE 1

Synthesis of Compound 2

1) Synthesis of 5-t-Butyl-3-hydroxyisozazole

The noted compound can be synthesized easily according to the processes disclosed in *Sankyo Kenkyusho Nenpo,* Vol. 22, 215 (1970); Japanese Patent Publication No. 9675/77; *Bulletin de la Societe Chemicue de France,* 1978; Japanese Patent Application (OPI) Nos. 206668/82 and 206667/82; *Tetrahedron,* Vol. 20, 2835 (1964); Japanese Patent Application (OPI) Nos. 194867/83 and 70878/82; Japanese Patent Publication No. 48953/84, Japanese Patent Application (OPI) No. 190977/84; *Journal of Organic Chemistry,* Vol. 48, 4307 (1983); *Chemical and Pharmaceutical Bulletin,* Vol. 14, 277; *Heterocycles,* Vol. 12, No. 10, 1297; *Canadian Journal of Chemistry,* Vol. 62, 1940; and Japanese Patent Application (OPI) No. 501907/84.

In 2l of a 4N aqueous sodium hydroxide solution was dissolved 583.7 g of hydroxylamine hydrochloride, and a 1:1 (by volume) mixture of a 4N aqueous sodium hydroxide solution and ethanol was added thereto, to adjust to a pH of 10.0. To the solution were dropwise added 1,380 g of ethyl pivaloylacetate and a 1:1 (by volume) mixture of a 4N aqueous sodium hydroxide solution and ethanol while maintaining the solution at a pH of 10.0±0.2 and a temperature between 0° C. and 5° C. After this addition, the mixture was stirred at room temperature for 2 hours, and then poured into 6 kg of an aqueous solution of concentrated hydrochloric acid cooled at 0° C, followed by allowing the mixture to stand for 12 hours. The precipitate thus formed was collected by filtration, thoroughly washed with water, and dried to obtain the noted compound in a yield of 770 g (68.2%), having a melting point of 99°–101° C.

2) Synthesis of N-Methyl-N-octadecyl-5-nitro-2-chlorobenzensulfonamide

To a mixture of 44 g of 5-nitro-2-chlorobenzenesulfonyl chloride and 100 ml of dichloromethane, was added dropwise a dichloromethane solution containing 48.4 g of methyloctadecylamine and 36.1 ml of triethylamine. After completion of the reaction, the reaction solvent was removed by distillation under reduced pressure, and 300 ml of methanol was added to the residue. The mixture was once heated to dissolve, and then gradually cooled to precipitate crystals, which were collected by filtration and dried to yield 64 g (74%) of the noted compound.

3) Synthesis of 5-t-Butyl-2-(2-N-methyl-N-octadecylsulfamoyl-4-nitrophenyl)-4-isoxazolin-3-one A mixture consisting of 62.0 g of N-methyl-N-octadecyl-5-nitro-2-chlorobenzenesulfonamide, 20.9 g of 5-t-butyl-3-hydroxyisoxazole, 20.7 g of potassium carbonate, and 300 ml of dimethylformamide was allowed to react at 80° C. for 6 hours. The reaction mixture was poured into ice-water and was extracted with ethyl acetate. The organic layer was concentrated to dryness under reduced pressure, and the residue was purified by silica gel column chromatography using a 2:1 (by volume) mixed solvent of n-hexane and ethyl acetate as an eluent, to obtain 29.0 g (37%) of the noted compound.

4) Synthesis of 5-t-Butyl-4-chloromethyl-2-(2-N-methyl-N-octadecylsulfamoyl-4-nitrophenyl)-4-isoxazolin-3-one A mixture of 20 g of 5-t-butyl-2-(2-N-methyl-N-octadecylsulfamoyl-4-nitrophenyl)-4-isoxazolin-3-one, 5.4 g of zinc chloride, 3 g of p-formaldehyde, and 100 ml of acetic acid was heated at reflux while blowing hydrogen chloride gas into the mixture. After cooling, the reaction mixture was poured into ice-water and extracted with ethyl acetate. The organic layer was concentrated to dryness under reduced pressure, and the residue was purified by silica gel column chromatography using a 2:1 (by volume) mixed solvent of n-hexane and ethyl acetate as an eluent, to obtain 12.0 g (58%) of the noted compound Synthesis of 5-t-Butyl-4-(2-sulfo-4-hydroxy-5-formylphenoxy)-2-(2-N-methyl-N-octadecylsulfamoyl-4-nitrophenyl)-4-isoxazolin-3-one A mixture consisting of 11.8 g of 5-t-butyl-4-chloromethyl-2-(2-N-methyl-N-octadecylsulfamoyl-4-nitrophenyl)-4 isoxazolin-3-one, 3.3 g of 2,5-dihydroxy-4-sulfobenzaldehyde, 6.3 g of sodium bicarbonate, 0.3 g of sodium iodide, and 120 ml of dimethyl sulfoxide was stirred at room temperature for 20 hours. One milliliter of acetic acid was added to the reaction mixture, and the stirring was continued for one additional hour. Any insoluble matter was removed by filtration, and the filtrate was purified by silica gel column chromatography using a 1:4 (by volume) mixed solvent of methanol and chloroform as an eluent, to obtain 5.2 g (40%) of the noted compound.

6) Synthesis of Compound 2

To a mixture of 5 g of 5-t-butyl-4-(2-sulfo-4-hydroxy-5-formylphenoxy)-2-(2-N-methyl-N-octadecylsulfamoyl-4-nitrophenyl)-4-isoxazolin-3-one and 100 ml of ethanol was added a solution of 0.9 g of nickel acetate tetrahydrate in 10 ml of methanol. A solution of 0.4 g of hydroxylamine hydrochloride in 10 ml of methanol was further added thereto, followed by stirring at room temperature for 2 hours. To the reaction mixture was added dropwise 2.3 ml of a 28 wt. % methanol solution of sodium methoxide, followed by stirring for 1 hour. The precipitate thus formed was collected by filtration and recrystallized from a 3:1 (by volume) mixed solvent of ethyl acetate and methanol to give 3.3 g (63%) of compound 2, having a melting point of 148°–154° C (with decomposition).

SYNTHESIS EXAMPLE 2

Synthesis of Compound 1

1) Synthesis of 5 Methyl-3-hydroxyisoxazole

The noted compound was synthesized according to the process described in *Canadian Journal of Chemistry*, Vol. 62, 1940 (1984). More specifically, the procedure of Synthesis Example 1-1) can be referred to. The synthesized compound having a melting point of 85°–86° C.

2) Synthesis of 4-Chloro-3-nitrobenzenesulfonyl chloride

To a mixed solution consisting of 1,280 g of potassium 4-chloro-3 nitrobenzenesulfonate, 1,150 ml of acetonitrile, 250 ml of sulforan, and 30 ml of dimethylacetamide, was added dropwise 1,250 ml of phosphorous oxychloride, while maintaining the inner temperature between 60° C. and 70° C. The mixture was allowed to react at 73° C. for 3 hours. After allowing to cool, 400 ml of water was slowly added thereto, and the reaction mixture was poured into 5l of ice-water. The crystals thus precipitated were filtered, washed with water, and dried to obtain 1,060 g (84%) of the noted compound.

3) Synthesthesis is of N-Hexadecyl-3-nitro-4-chlorobenzenesulfonamide

To a mixture of 800 g of 3-nitro-4-chlorobenzenesulfonyl chloride and 1,000 ml of dichloromethane, was added dropwise a dichloromethane solution containing 600 g of hexadecylamine and 251 ml of triethylamine. After completion of the reaction, the reaction solvent was removed by distillation under reduced pressure. The residue was dissolved in 3,000 ml of methanol under heating, followed by gradually cooling to precipitate crystals, which were collected by filtration and dried to give 1,020 g (88%) of the noted compound.

4) Synthesis of
N-Methyl-N-hexadecyl-3-nitro-4-chlorobenzenesulfonamide

In 640 ml of acetone, was dissolved 170 g of N-hexadecyl-3-nitro-4-chlorobenzenesulfonamide. Next, 79 g of potassium carbonate, 6 ml of polyethylene glycol 400, and 71 g of dimethyl sulfate were added to the solution, followed by heating at reflux for 5 hours. To the reaction mixture was added 240 ml of acetone, and 870 ml of water was added thereto dropwise at 40° C, followed by cooling to room temperature. The precipitated crystals were collected by filtration, washed successively with water and methanol, and dried to yield 169 g (97%) of the noted compound.

5) Synthesis of
5-Methyl-2-(4-N-methyl-N-hexadecylsulfamoyl-2-nitrophenyl)-4-isoxazolin-3-one Sixteen grams of N-methyl-N-hexadecyl-3-nitro-4-chlorobenzenesulfonamide, 4.8 g of 5-methyl-3-hydroxyisoxazole, 6.4 g of sodium hydrogencarbonate, and 50 ml of dimethyl sulfoxide were mixed and allowed to react at 75° C. for 6 hours. The reaction mixture was poured into ice-water having been rendered acidic with hydrochloric acid. The precipitated crystals were collected by filtration, washed with water, recrystalized from methanol, and dried to obtain 17.9 g (99%) of the noted compound.

6) Synthesis of
5-Methyl-4-chloromethyl-2-(4-N-methyl-N-hexadecylsulfamoyl-2-nitrophenyl)-4-isoxazolin-3-one Sixteen grams of 5-methyl-2-(4-N-methyl-N-hexadecylsulfamoyl-2-nitrophenyl)-4-isoxazoline-3-one, 5 g of zinc chloride, 7 g of p-formaldehyde, 50 ml of acetic acid, and 0.5 ml of concentrated sulfuric acid were mixed an stirred at 75° C. for 9 hours while blowing hydrogen chloride gas into the mixture. After cooling, the reaction mixture was poured into water, and the precipitated crystals were collected by filtration and recrystallized from methanol to obtain 16.3 g (94%) of the noted compound.

7) Synthesis of
5-Methyl-4-(2-hydroxy-3-formyl-5-sulfo)-2-(4-N-methyl-N-hexadecylsulfamoyl -2-nitrophenyl)-4-isoxazolin-3-one A mixture consisting of 5-metyl-4-chloromethyl-2-(4-N-methyl-N-hexadecylsulfonyl-2-nitrophenyl)-4-isozazolin-3-one, 4.3 g of 2,3-dihydroxy-5-sulfobenzaldehyde, 8.4 g of sodium bicarbonate, 0.4 g of sodium iodide, and 140 ml of dimethyl sulfoxide was stirred at room temperature for 20 hours. After 1.3 ml of acetic acid was added to the reaction mixture, the stirring was continued for one additional hour. Any insoluble matter was removed by filtration, and the residue was purified by silica gel column chromatography using a 1:4 (by volume) mixed solvent of methanol and chloroform as an eluent, to obtain 7.1 g (45%) of the noted compound.

8) Synthesis of Compound 1

To a mixed solution consisting of 6.3 g of 5-methyl-4-(2-hydroxy-3-formyl-5-sulfo)-2-(4-N-methyl-N-hexadecylsulfamoyl-2-nitrophenyl)-4-isoxazolin-3-one and 120 ml of ethanol, was added a solution of 1 g of nickel acetate tetrahydrate in 10 ml of methanol, and a solution of 0.6 g of hydroxylamine hydrochloride in 15 ml of methanol was added thereto, followed by stirring at room temperature for 2 hours. To the reaction mixture was added dropwise 3.1 ml of a 28 wt% methanol solution of sodium methoxide, followed by stirring for 1 hour. The precipitated crystals were filtered and recrystallized from a 3:1 (by volume) mixed solvent of ethyl acetate and methanol to give 4.2 g (63%) of Compound 1, having a melting point of 163°-170° C. (with decomposition).

The compounds represented by formula (I) can be used either individually or in combinations of two or more thereof. A suitable amount of the compound to be added usually ranges from about 0.01 mol to about 10 mols, and preferably from about 0.03 mol to about 2 mols, per mol of a coupler or a dye.

Because the compound of formula (I) releases MCAP on receipt of an electron from a reducing substance, the reducing substance is, in turn, oxidized. If the oxidation-reduction reaction takes place imagewise, the reducing substance which is not oxidized remains in the reverse image.

The reducing substance which can be used in the present invention may be either organic or inorganic and preferably has an oxidation potential lower than the standard redox potential of a silver ion/silver system (e.g., 0.80 V).

The inorganic reducing substances include metals having an oxidation potential of 0.8 V or less (e.g., Mn, Ti, Si, Zn, Cr, Fe, Co, Mo, Sn, Pb, W, Sb, Cu, and Hg) Hz; ions having an oxidation potential of 0.8 V or less, or complex compounds thereof (e.g., $Cr^{2+}$, $V^{2+}$, $Cu^{+}$, $Fe^{2+}$, $MnO_4^{2-}$, $I^-$, $Co(CN)_6^{4-}$, $Fe(CN)_6^{4-}$, $(Fe\text{-}EDTA)^{2-}$, etc.); metal hydrides having an oxidation potential of 0.8V or less (e.g., NaH, LiH, KH, $NaBH_4$, $LiBH_4$, $LiAl(O\text{—}C_4H_9\text{—}t)_3H$, $LiAl(OCH_3)_3H$, etc.); and sulfur or phosphorous compounds having an oxidation potential of 0.8V or less (e.g., $Na_2SO_3$, NaHS, $NaHSO_3$, $H_3P$, $H_2S$, $Na_2S$, $Na_2S_2$, etc.).

The organic reducing substances include organic nitrogen compounds, such as alkyl or aryl amines; organic sulfur compounds such as alkyl or aryl mercaptans; organic phosphorous compounds, such as alkyl or aryl phosphines, and preferably compounds following the Kendal-Pelz formula (see, T. H. James, *The Theory of the Photographic Process*, 4th Ed., p. 299 (1977)).

Examples of the compounds usable as reducing substances in the present invention include inorganic reducing agents (such as sodium sulfite, sodium hydrogensulfite, etc.), benzenesulfinic acids, hydroxylamines, hydrazines, hydrazides, borane-amine complexes, hydroquinones, aminophenols, catechlols, p-phenylenediamines, 3-pyrazolidinones, hydroxytetronic acid, ascorbic acid, 4-amino-5-pyrazolones, and the like. In addition, the reducing agents described at pages 291 to 34 of the above-noted literature by T. H. James, as well as the reducing agent precursors described in Japanese Patent Application (OPI) Nos. 138736/81 and 40245/82 and U.S. Pat. No. 4,330,617, can also be employed.

Specific examples of the reducing agents which can be preferably used include 3-pyrazolidones and precursors thereof, e.g., 1-phenyl-3-pyrazolidone, 1-phenyl-4,4-dimethyl-3-pyrazoflidone, 4-hydroxymethyl-4-methyl-1-phenyl-3-pyrazolidone, 1-m-tolyl 3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxyphenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3 pyrazolidone, 1-(3-tolyl)-3-pyrazolidone, 1-(3-4,4-dimethyl-3-pyrazolidone, 5-methyl-3-pyrazolidone, 1,5-diphenyl-3-pyrazolidone, 1 phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxy-pyrazolidone, etc.; hydroquinones and precursors thereof, e.g., hydroquinone, toluhydroquinone, 2,6-dimethylhydroquinone, t-butylhydroquinone, 2,5-di-t-butylhydroquinone, t-octylhydroquinone, 2,5-di-t octylhydroquinone, pentadecylhydroquinone, sodium-5-pentadecylhydroquinone-2-sulfonate, p-benzolyloxyphenol, 2-methyl-4-benzoyloxyphenol, 2-t-butyl-4-(4-chlorobenzoyloxy)phenol, sodium hydroquinone-2-sulfonate, 2-[3,5-bis(2-hexyldecanamido)benzamido]hydroquinone, 2-(3-hexadecanamido)benzamidohydroquinone, 2-(2-hexyldecanamido)hydroquinone, etc.; p-phenylenediamine color developing agents, e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-butoxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.; and aminophenol reducing agents, e.g., 4-amino-2,6-dichlorophenol, 4-amino-2,6-dibromophenol, 4-amino-2 methylphenol sulfate, 4-amino 3-methylphenol sulfate, 4-amino-2,6-dichlorophenol hydrochloride, etc. The 2,6-Dichloro-4-substituted sulfonamidophenols and 2,6-dibromo-4 substituted sulfonamidophenols described in *Research Disclosure,* (RD No. 15108) and U.S. Pat. No. 4,021,240, and p-(N,N-dialkylaminophenyl)sulfamines described in Japanese Patent Application (OPI) No. 16740/84, are also useful. In addition to the phenolic reducing agents set forth above, naphthol reducing agents, such as 4-aminonaphthol derivatives and 4 substituted sulfonamidonaphthol derivatives, are also useful. General color developing agents applicable as reducing agents further include the aminohydroxypyrazole derivatives described in U.S. Pat. No. 2,895,825, aminopyrazoline derivatives described in U.S. Pat. No. 2,892,714, and hydrazone derivatives described in *Research Disclosure,* (RD Nos. 19412 and 19415), pp. 227–230 and 236–240 (June, 1980). These color developing agents may be used either individually or in combinations of two or more thereof.

Illustrated below are the functions of the compounds of formula (I) according to the present invention in silver halide photographic materials.

The compound of the present invention, incorporated into the silver halide photographic materials, is reduced to release MCAP through the electron transfer indicated by the arrows in Scheme A Scheme A:

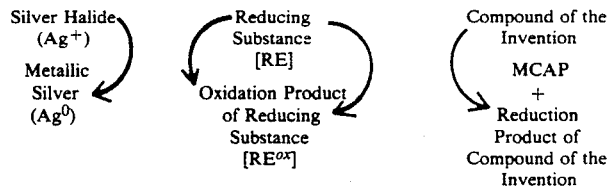

In Scheme A, reducing substance [RE], which is the above-described organic or inorganic reducing substance, may be externally supplied from a processing solution or may be previously incorporated into the photographic material. Further, the reducing substance may be contained in the photographic material and also the same or different kind of a reducing agent [RE]may be supplied from a processing solution.

When using a common negatively-working silver halide emulsion, the reducing substance [RE] is consumed for reduction of silver halide in accordance with the extent of exposure to light. Therefore, only the part of the supplied reducing substance [RE] that remains unused for reduction of silver halide (i.e., in an amount reversely corresponding to the exposure) is subjected to the reaction with the compound of the invention. In other words, the lesser the exposure, the more MCAP is released and discharged from the system. On the other hand, the discoloration inhibitor of formula (I) remains in image areas (i.e., exposed areas) to contribute to image stability. When using, on the contrary, an autopositive emulsion, since reduction of silver halide occurs in unexposed areas, the reducing substance is consumed in the unexposed areas. Therefore, the greater the exposure, the more the reaction between the compound of the invention and the reducing substance occurs to release and discharge a large amount of MCAP. On the other hand, the discoloration inhibitor of formula (I) remains in image areas to contribute to image stability.

As mentioned above, since the discoloration inhibitor of formula (I) remains in image areas while being cleaved and discharged from the system in non-image areas, efficient inhibition of discoloration can be accomplished without being accompanied by background stains due to coloring with the discoloration inhibitor.

Thus, the compound according to the present invention releases MCAP in a small amount in a developed area (i.e., an area where silver halide is reacted with a reducing substance) and in a large amount in a non-developed area. In order to adjust, and usually to increase, the ratio of MCAP release in a developed area to that in a non-developed area, a reducing substance called an electron transport agent [ETA]may be used in combination with the compound of the present invention as shown in Scheme B:

Scheme B:

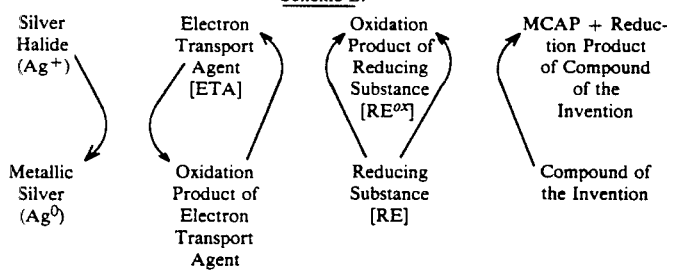

The electron transport agent [ETA] can be selected from among the above-illustrated reducing substances, and preferably the organic reducing agents. Inorder to attain more favorable activities of the electron transport agent [ETA], [ETA] is desirably positioned in the middle between the reducing substance [RE] and silver halide in terms of redox potential.

The mode of supply of the electron transport agent [ETA] and reducing substance [RE] is the same as described above with respect to Scheme A.

In Scheme B, the MCAP release mechanism is the same as in Scheme A, except that an electron is transferred from the reducing substance to silver halide via the electron transport agent. When the reducing substance is immobile, electron transfer from the reducing substance to silver halide is sometimes slow. As can be understood from Scheme A, if electron transfer from the reducing substance to silver halide is slow, the reaction between the reducing substance and the compound of the invention preferentially takes place so that the difference in the quantity of released MCAP between a developed area and a non-developed area becomes small. Accordingly, the electron transport agent can be utilized to the effect that the electron transfer from the immobile reducing substance to silver halide may proceed smoothly, to make the difference of MCAP release between a developed area and a non-developed area greater. In this regard, the electron transport agent, when combined with an immobile reducing substance [RE], should have greater mobility than [RE]. As shown in Scheme B, an immobile reducing substance can be effectively used with the aid of an electron transport agent.

The reducing substance to be combined with [ETA] may be any of those enumerated above, so long as it is substantially immobile in layers of light-sensitive materials. Particularly preferred are hydroquinones, aminophenols, aminonaphthols, 3-pyrazolidinones, saccharin (and their precursors), picoliniums, and the compounds disclosed in Japanese Patent Application (OPI) No. 110827/78 as electron donors.

Specific examples of the reducing agents which can be used in the present invention are shown below.

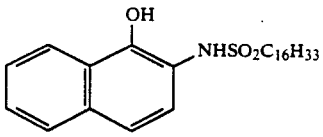

S-1

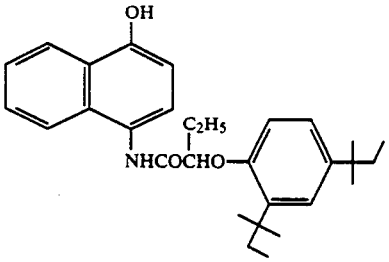

S-2

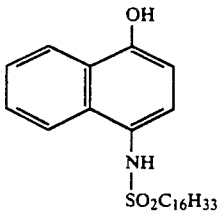

S-3

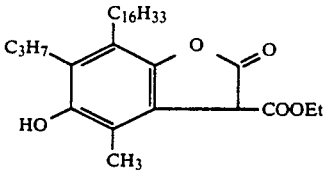

S-4

-continued
S-5
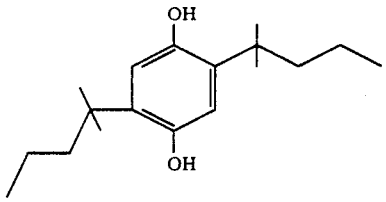
S-6
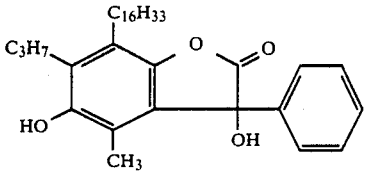
S-7
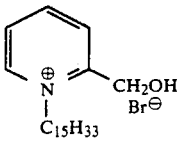
S-8
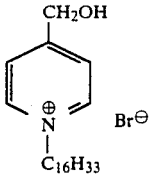
S-9
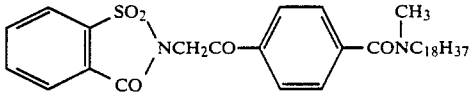
S-10
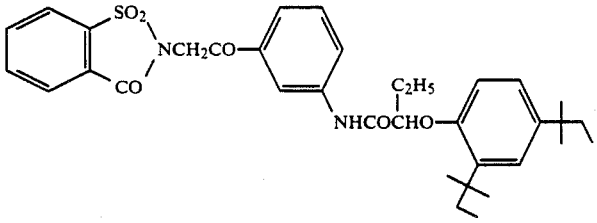
S-11
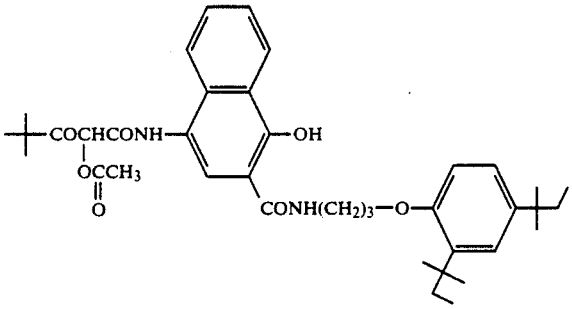
S-12
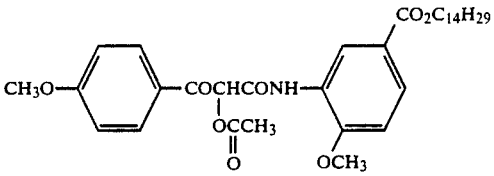

-continued
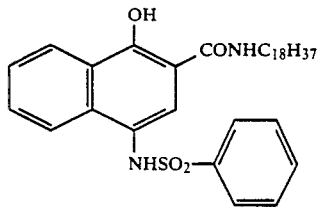
S-13
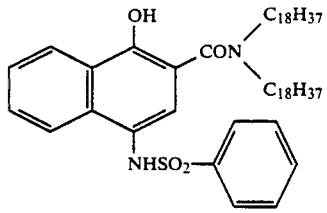
S-14
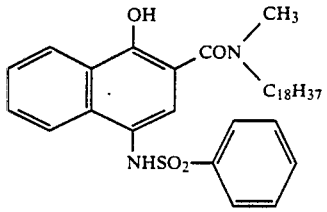
S-15
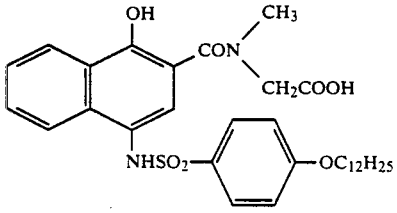
S-16
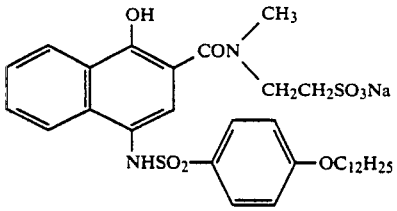
S-17
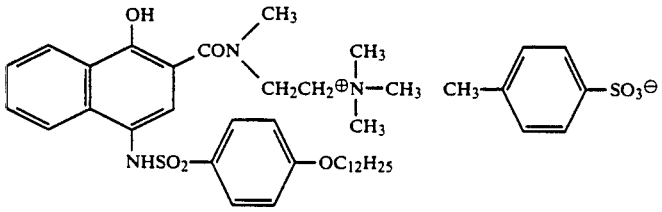
S-18
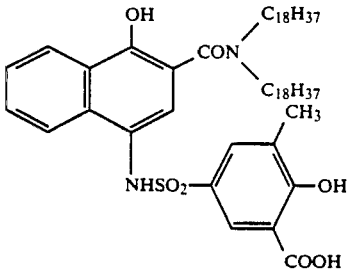
S-19

-continued
S-20
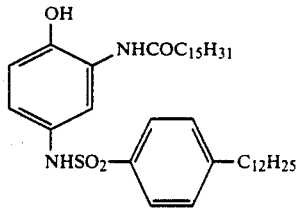
S-21
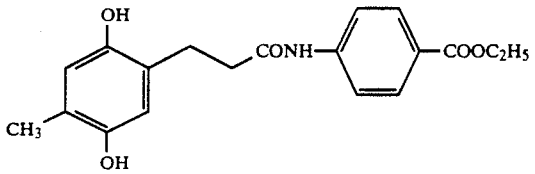
S-22
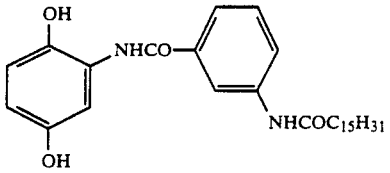
S-23
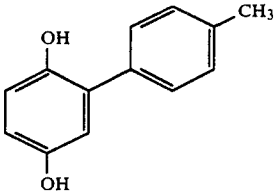
S-24
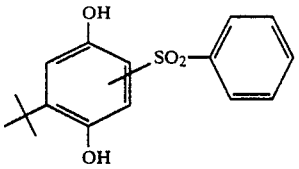
S-25
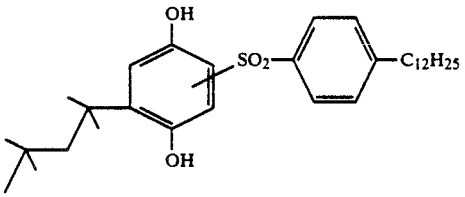
S-26
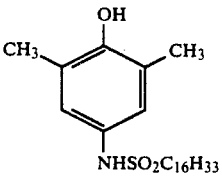
S-27
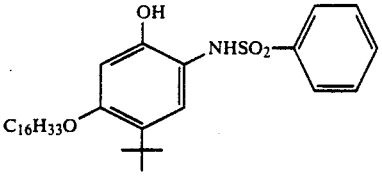

-continued
S-28
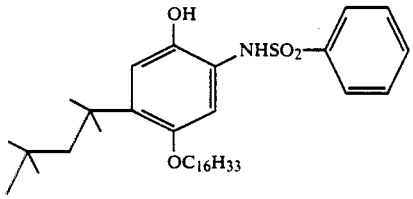
S-29
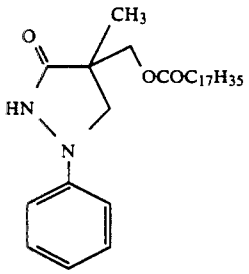
S-30
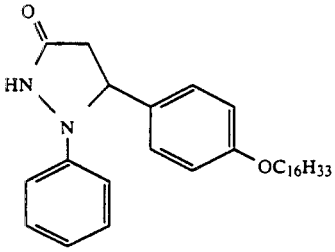
S-31
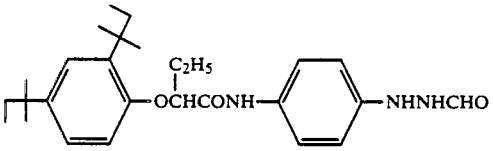
S-32
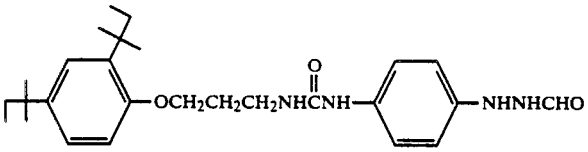
S-33
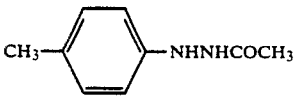
S-34
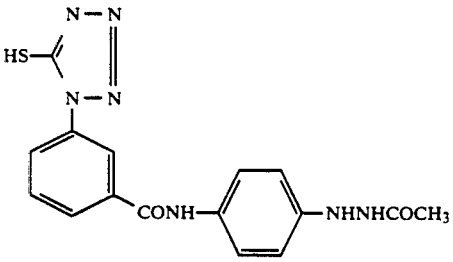

-continued
S-35
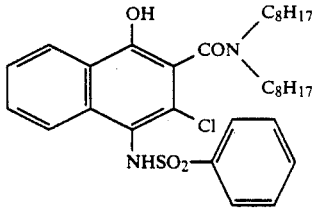
S-36
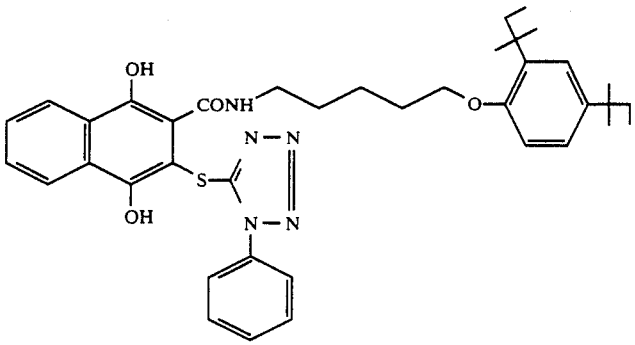
S-37
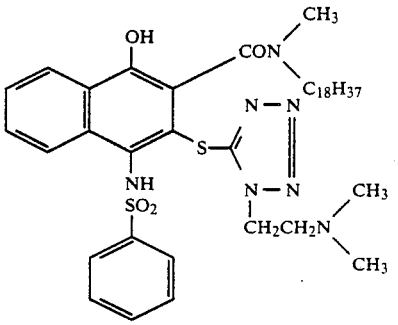
S-38
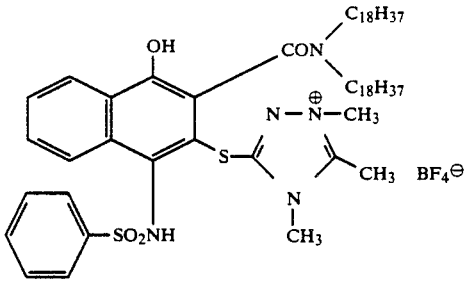
S-39
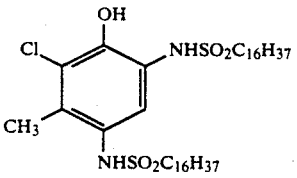
S-40
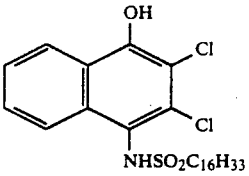

-continued
S-41
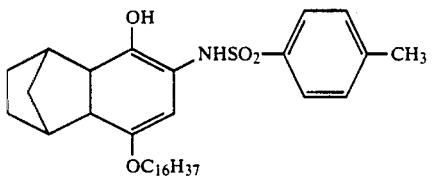
S-42
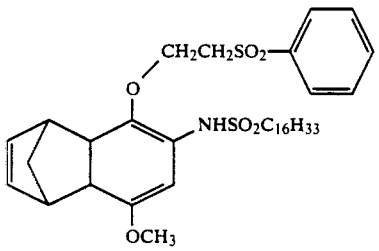
S-43
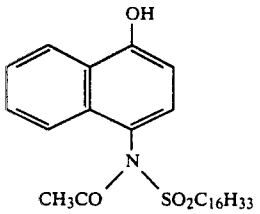
S-44
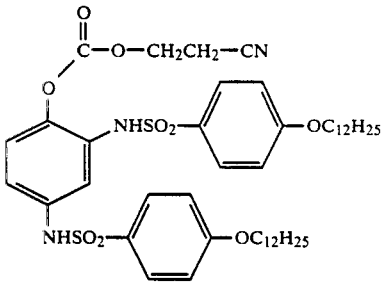
S-45
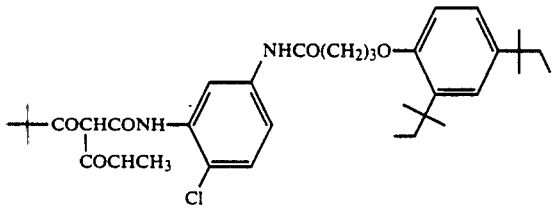
S-46
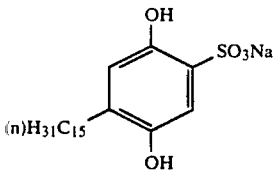
S-47
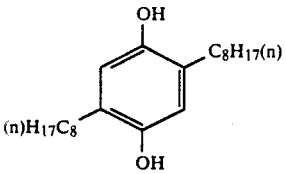

-continued

S-48

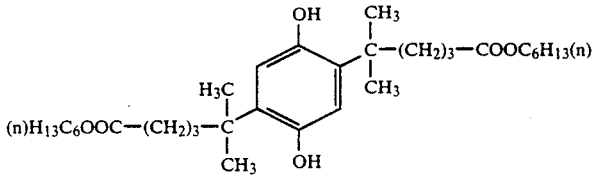

S-49

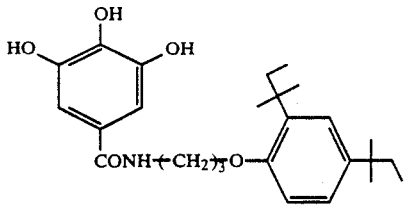

S-50

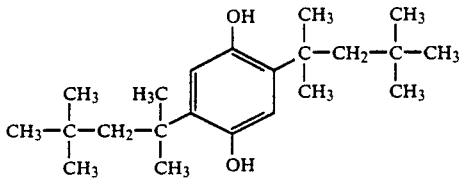

S-51

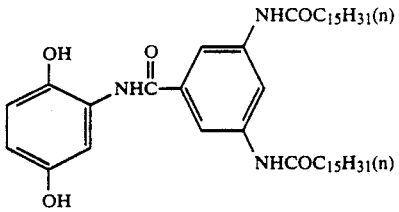

S-52

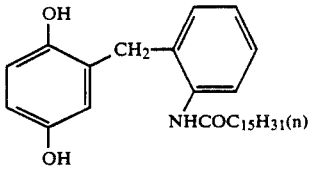

S-53

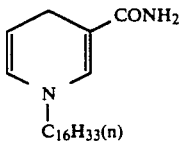

The electron transport agent (ETA) to be combined with these reducing substances is not particularly restricted as long as it is capable of undergoing cross-oxidation with the reducing substance, and preferably includes diffusible 3-pyrazolidinone, aminophenol, phenylenediamine or reductone compounds.

It is preferable that the above-described reducing substance, or the combination of the reducing substance and ETA, is supplied to a light-sensitive material in the form of a developing solution at the time of development processing, or that the reducing substance is incorporated into a light-sensitive material while ETA being supplied in the form of a developing solution. In the former mode of supply, the reducing substance, or its combination with ETA, is added to a developing solution in total concentration of from 0.001 to 1 mol per liter. In the latter case, the reducing substance is added in an amount of from 0.01 to 50 mols per mol of the compound of the invention, and ETA is added to a developing solution in concentration of from 0.001 to 1 mol per liter.

The compounds of formula (I) according to the present invention can be used in combination with yellow couplers, magenta couplers or cyan couplers. The couplers to be combined may be either 4-equivalent or 2-equivalent to a silver ion, and may be in the form of a polymer or an oligomer. Further, the couplers may be used individually or in combination of two or more thereof.

Couplers which can be preferably used in this invention are shown by formulae (VI) to (X), however, the invention should not be construed as being limited thereto:

(VI)

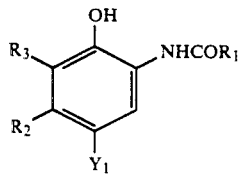

(VII)

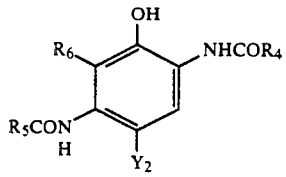

(VIII)

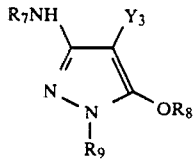

(IX)

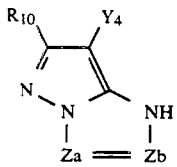

(X)

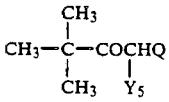

wherein $R_1$, $R_4$, and $R_5$ each represents an aliphatic group, an aromatic group, a heterocyclic group, an aromatic amino group or a heterocyclic amino group; $R_2$ represents an aliphatic group; $R_3$ and $R_6$ each represents a hydrogen atom, a halogen atom, an aliphatic group, an aliphatic oxy group or an acylamino group; a pair of $R_2$ and $R_3$ or a pair of $R_5$ and $R_6$ in formulae (VI) and (VII) may be connected to form a 5-, 6- or 7-membered ring; $R_7$ and $R_9$ each represents a substituted or unsubstituted phenyl group; $R_8$ represents a hydrogen atom, an aliphatic or aromatic acyl group or an aliphatic or aromatic sulfonyl group; $R_{10}$ represents a hydrogen atom or a substituent; Q represents a substituted or unsubstituted N-phenylcarbamoyl group; $Z_a$ and $Z_b$ each represents a methine group, a substituted methine group or =N—; and $Y_1$, $Y_2$, $Y_3$, $Y_4$ and $Y_5$ each represents a hydrogen atom or a group releasable upon coupling with an oxidation product of a developing agent (hereinafter referred to as a releasable group).

The couplers represented by formulae (VI) to (X) also include dimers or polymers thereof formed at $R_1$, $R_2$, $R_3$ or $Y_1$ in formula (VI), $R_4$, $R_5$, $R_6$ or $Y_2$ in formula (VII), $R_7$, $R_8$, $R_9$ or $Y_3$ in formula (VIII), $R_{10}$, $Z_a$, $Z_b$ or $Y_4$ in formula (IX), or Q or $Y_5$ in formula (X).

The term "aliphatic group" as used herein includes straight chain, branched chain or cyclic alkyl, alkenyl or alkynyl groups.

Specific and preferred examples of the cyan couplers represented by formulae (VI) and (VII) are shown below, however, the present invention should not be construed as being limited thereto.

(C-1)

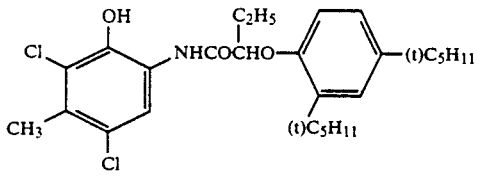

(C-2)

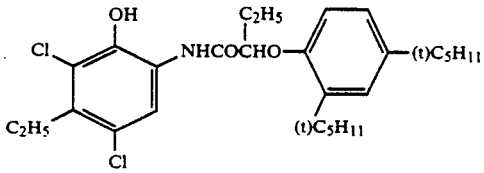

(C-3)

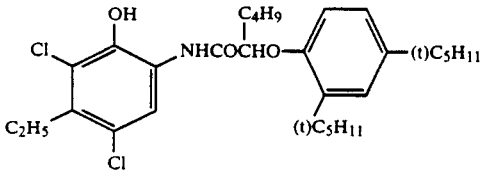

(C-4)

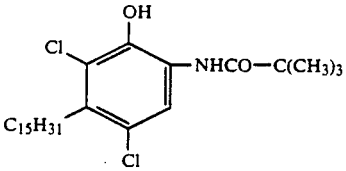

-continued
(C-5)
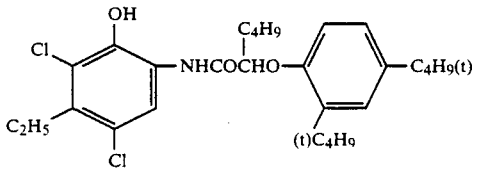
(C-6)
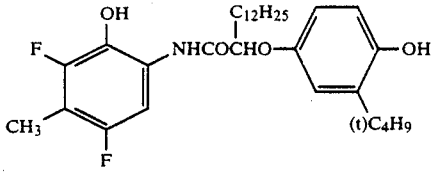
(C-7)
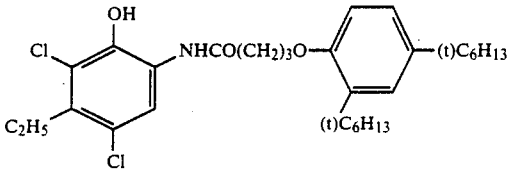
(C-8)
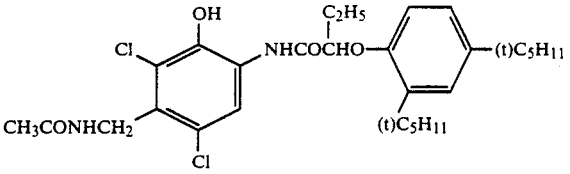
(C-9)
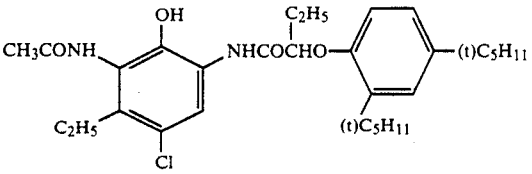
(C-10)
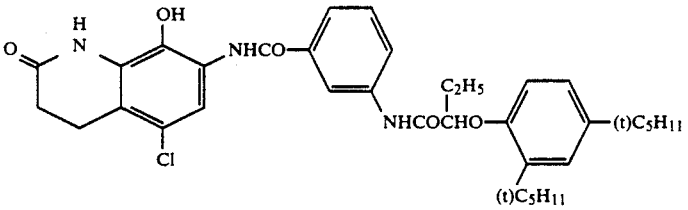
(C-11)
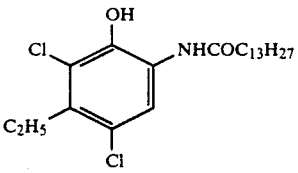
(C-12)
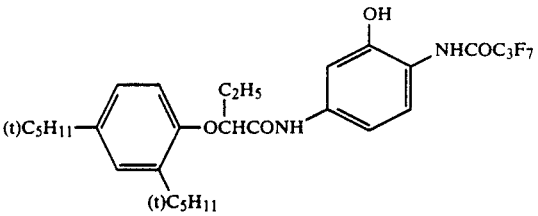

-continued
(C-13)
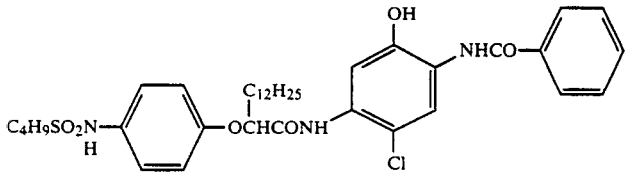
(C-14)
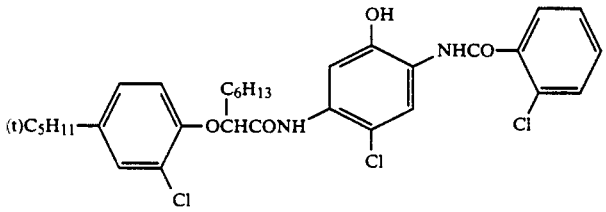
(C-15)
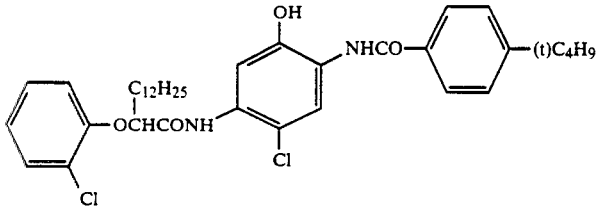
(C-16)
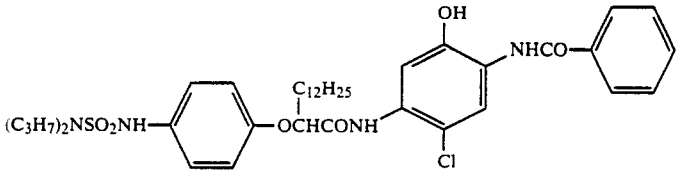
(C-17)
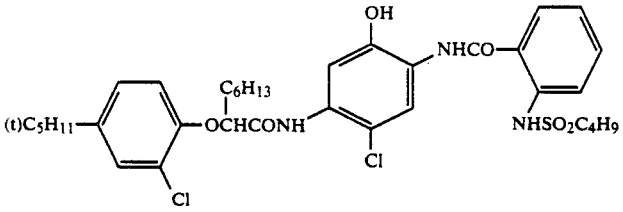
(C-18)
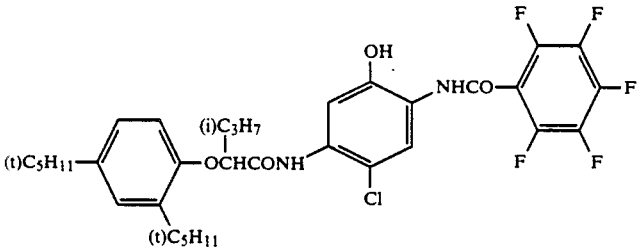
(C-19)
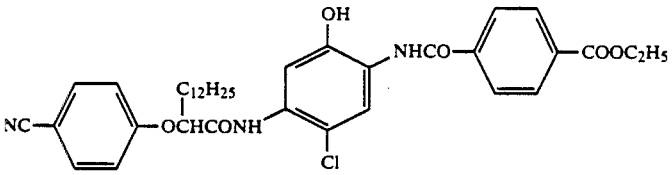

-continued
(C-20)
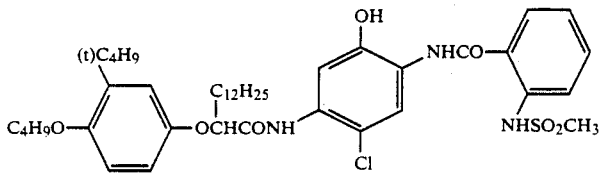
(C-21)
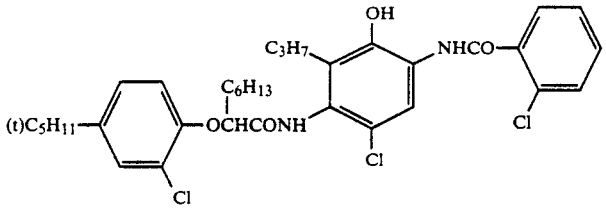
(C-22)
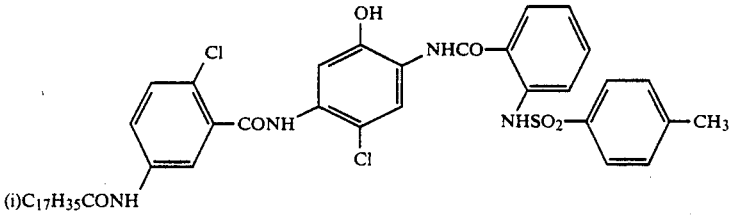
(C-23)
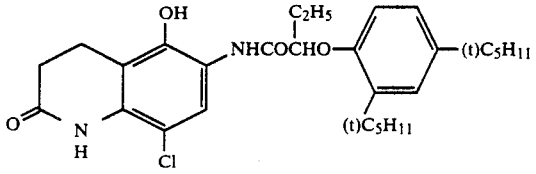
(C-24)
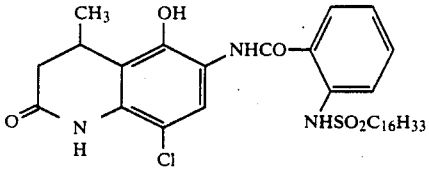
(C-25)
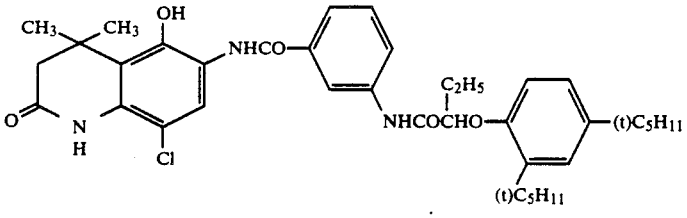
(C-26)
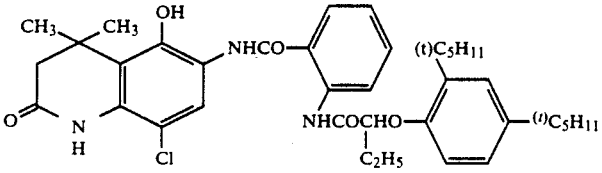
(C-27)
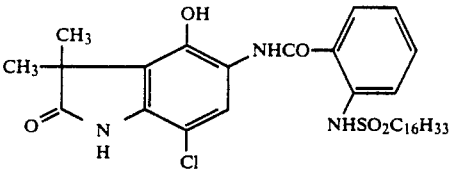

-continued
(C-28)
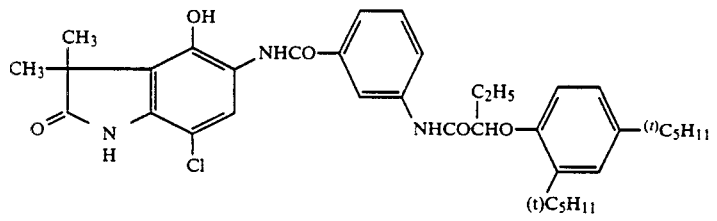
(C-29)
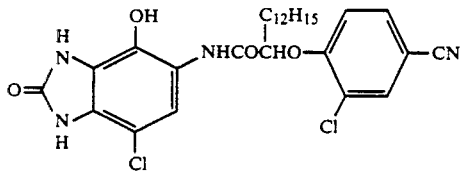
(C-30)
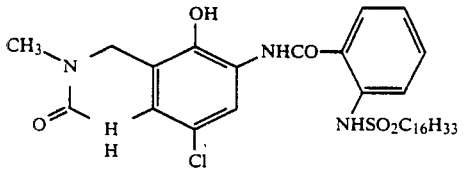
(C-31)
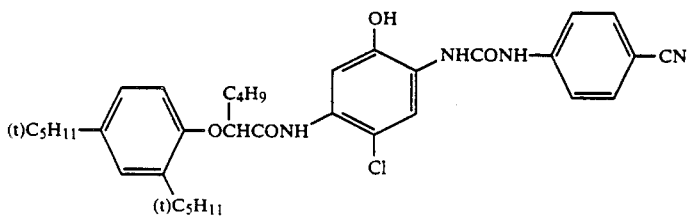
(C-32)
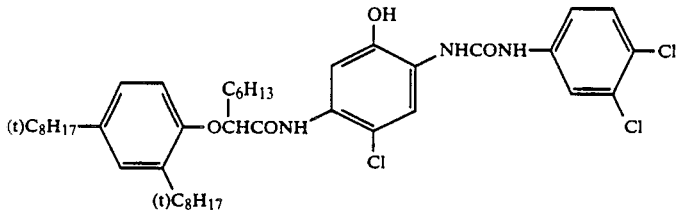
(C-33)
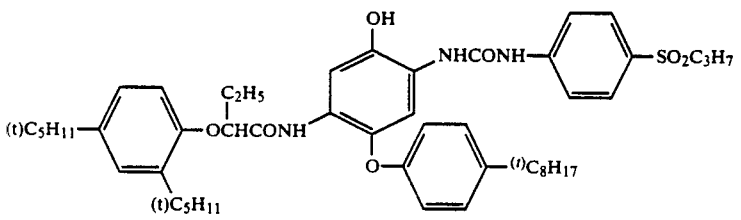
(C-34)
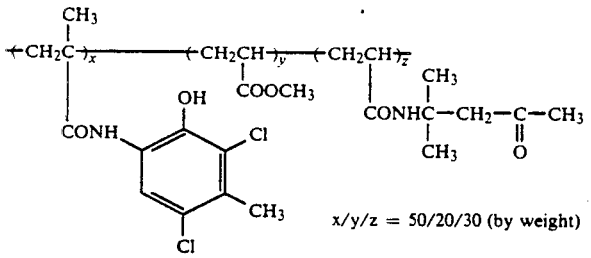
x/y/z = 50/20/30 (by weight)

-continued
(C-35)
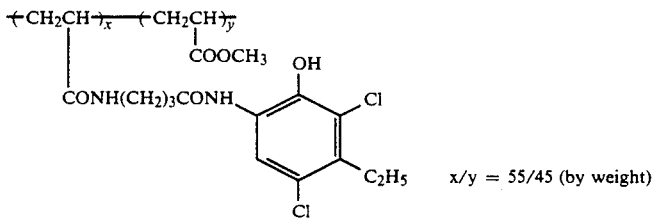
x/y = 55/45 (by weight)
(C-36)
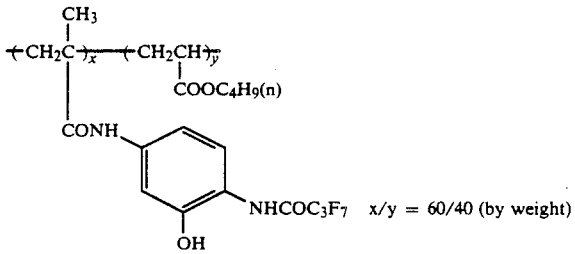
x/y = 60/40 (by weight)
(C-37)
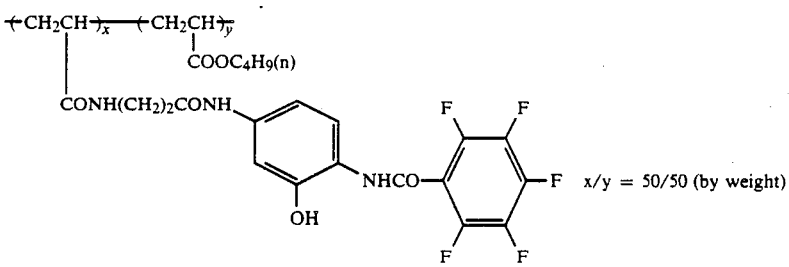
x/y = 50/50 (by weight)
(C-38)
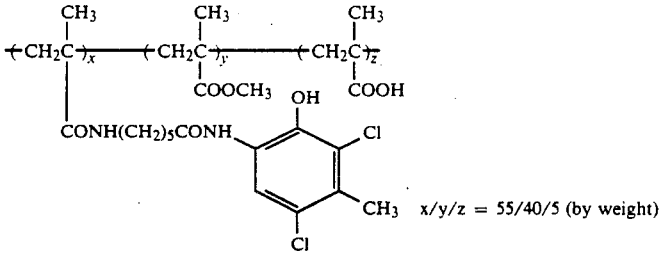
x/y/z = 55/40/5 (by weight)
(C-39)
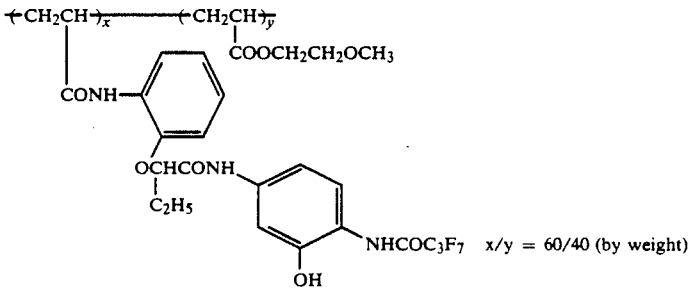
x/y = 60/40 (by weight)
(C-40)
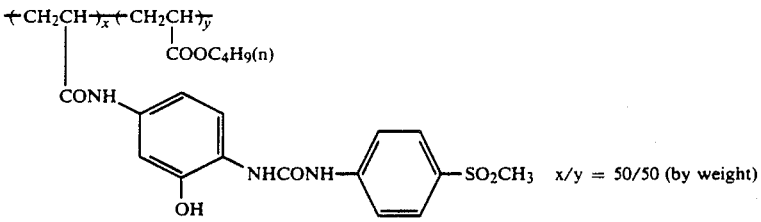
x/y = 50/50 (by weight)

-continued
(C-41)
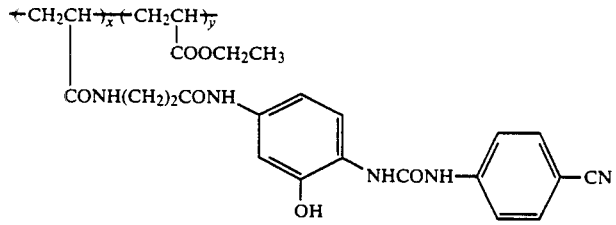
x/y = 45/55 (by weight)
(C-42)
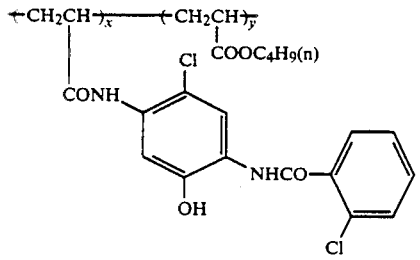
x/y = 50/50 (by weight)
(C-43)
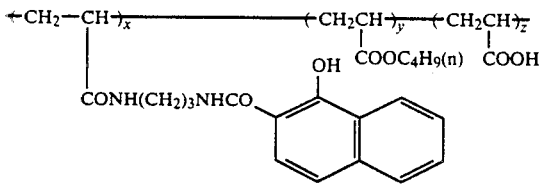
x/y/z = 45/45/10 (by weight)
(C-44)
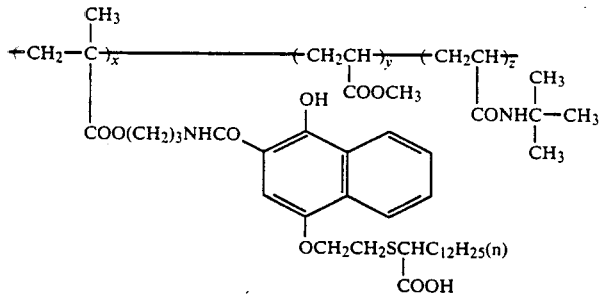
x/y/z = 50/20/30 (by weight)
(C-45)
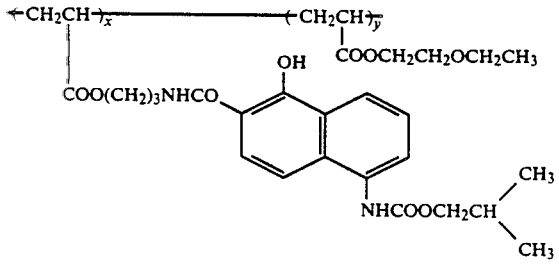
x/y = 50/50 (by weight)
Specific and preferred examples of the magenta couplers represented by formulae (VIII) and (IX) are shown below, however, the present invention should not be construed as being limited thereto.

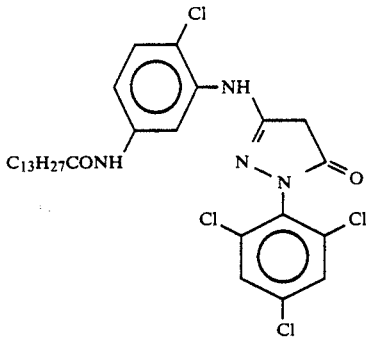
(M-1)
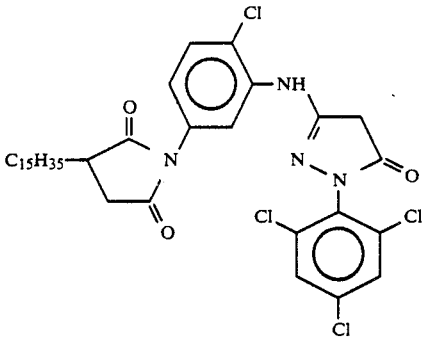
(M-2)
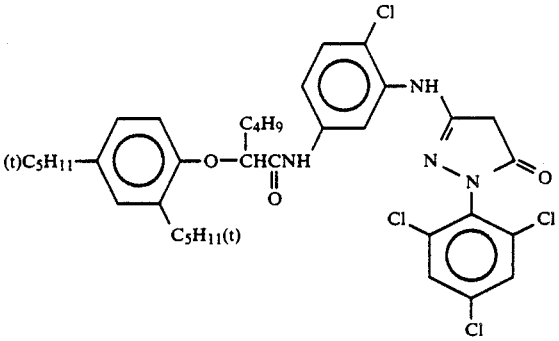
(M-3)
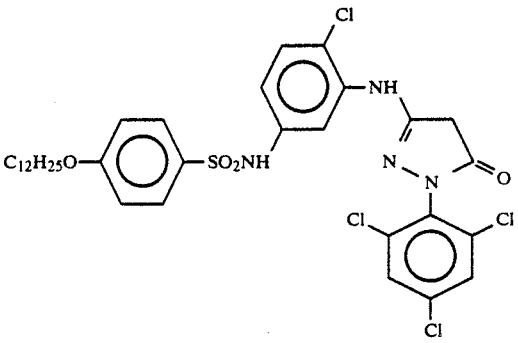
(M-4)

-continued
(M-5)
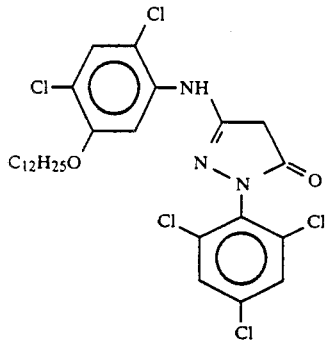
(M-6)
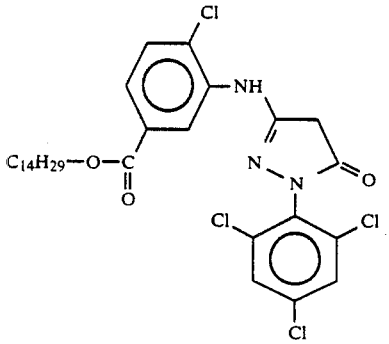
(M-7)
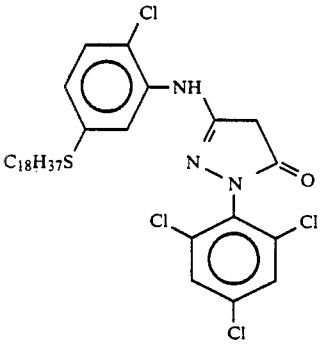
(M-8)
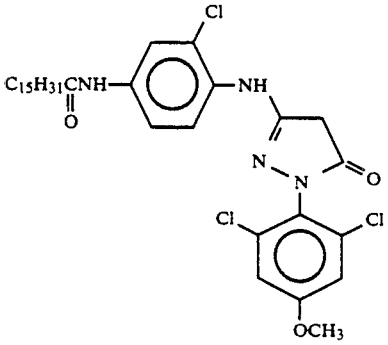
(M-9)
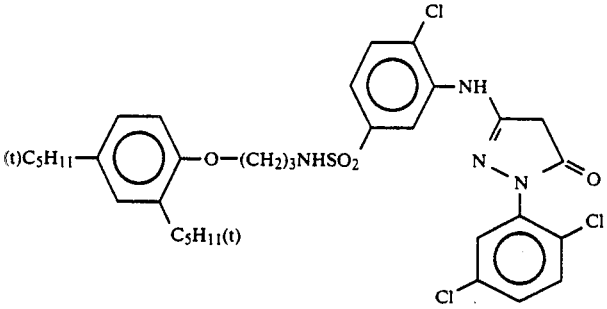

-continued
(M-10)
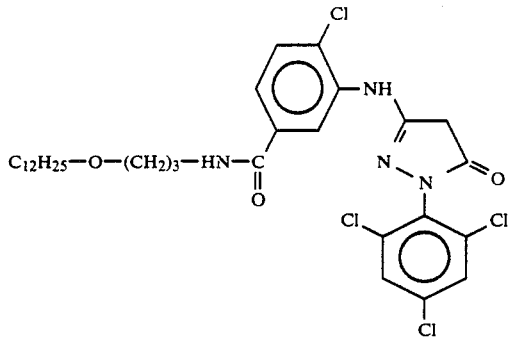
(M-11)
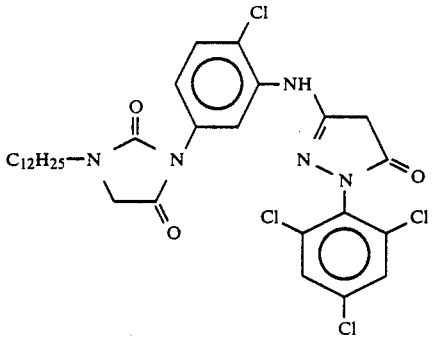
(M-12)
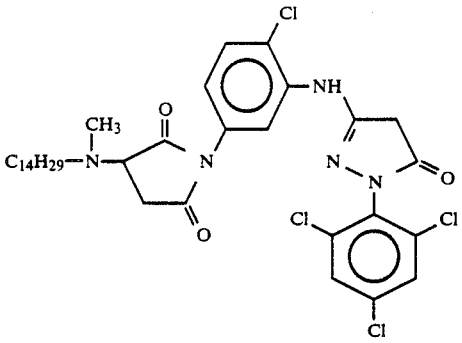
(M-13)
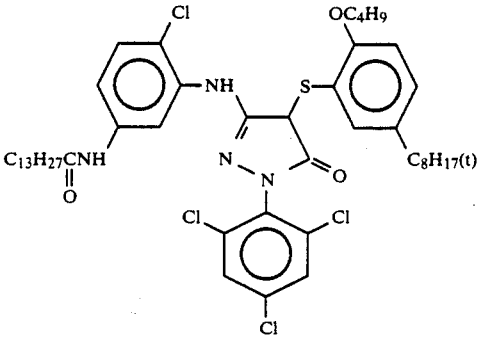

-continued
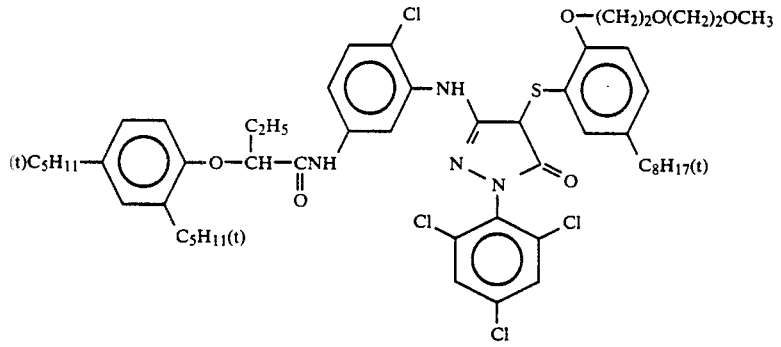
(M-14)
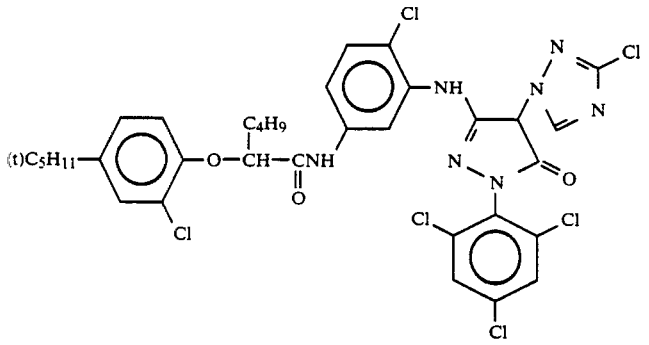
(M-15)
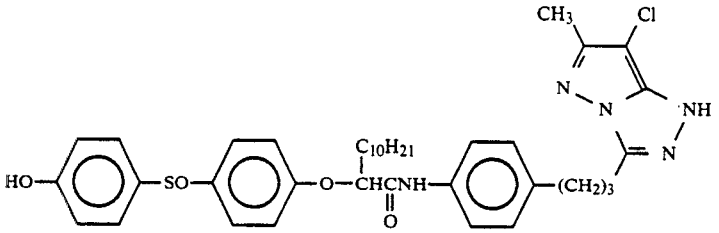
(M-16)
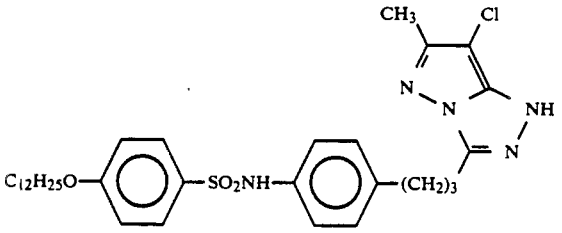
(M-17)
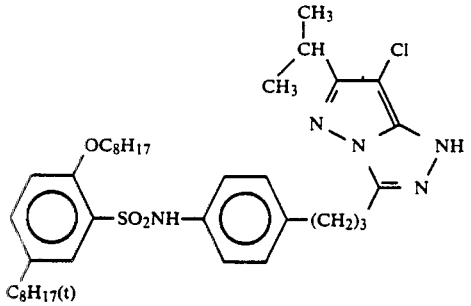
(M-18)

-continued
(M-19)
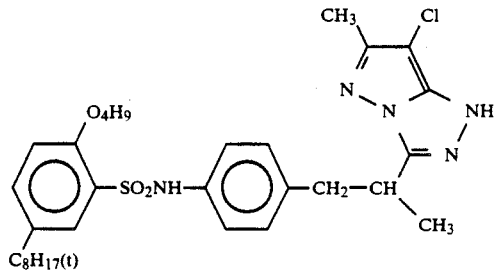
(M-20)
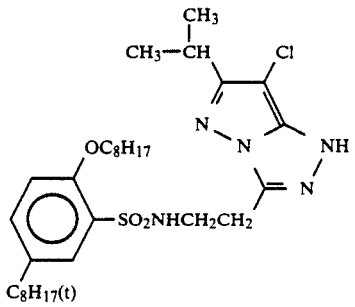
(M-21)
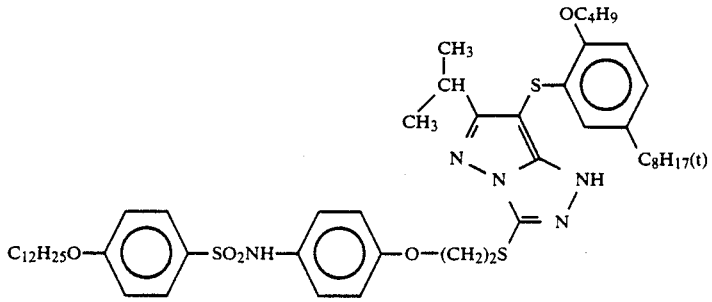
(M-22)
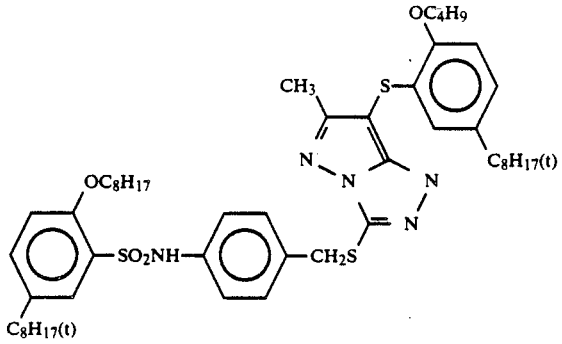
(M-23)
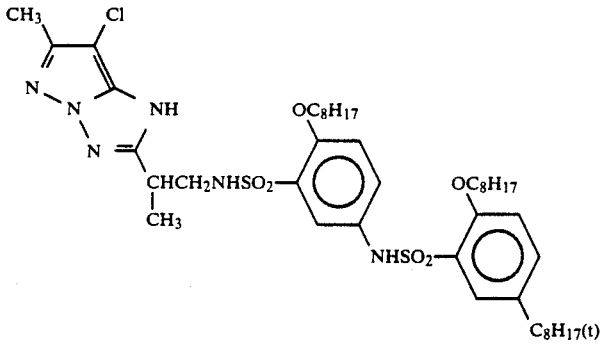

-continued
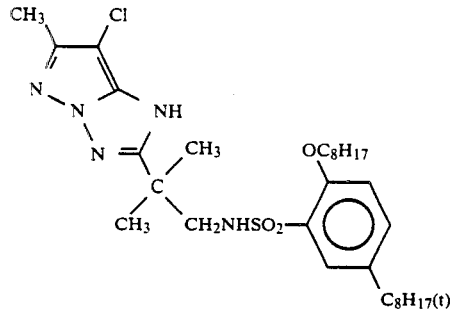
(M-24)
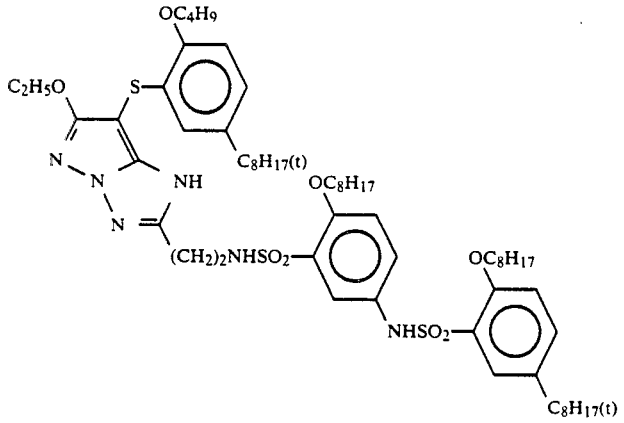
(M-25)
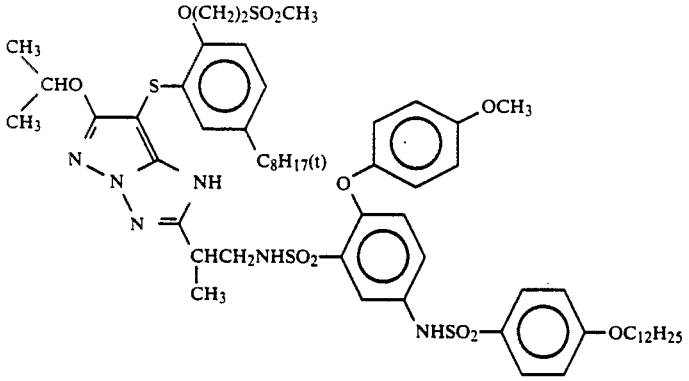
(M-26)
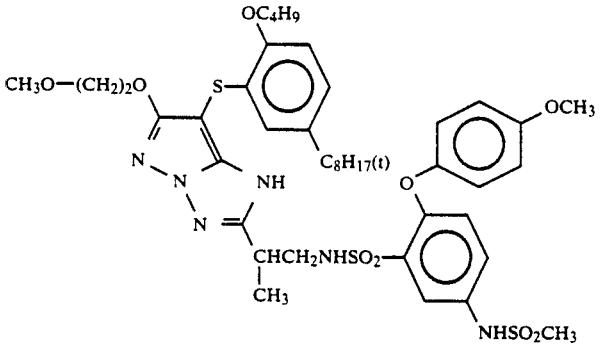
(M-27)

-continued
(M-28)
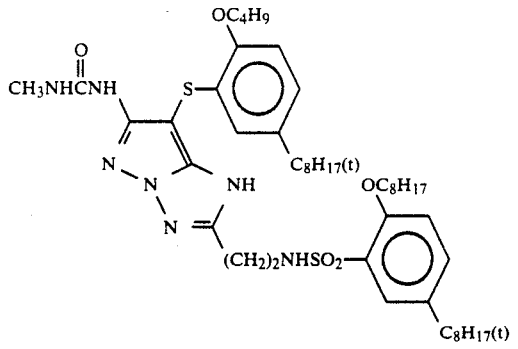
(M-29)
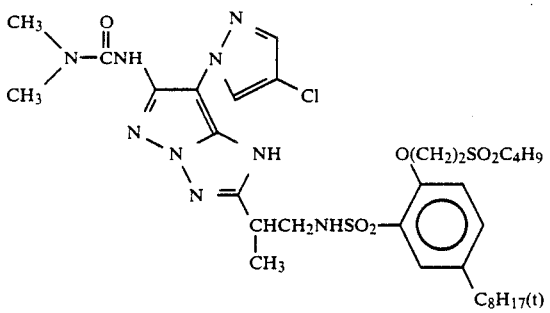
(M-30)
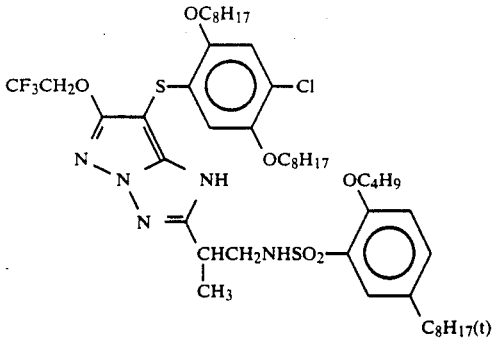
(M-31)
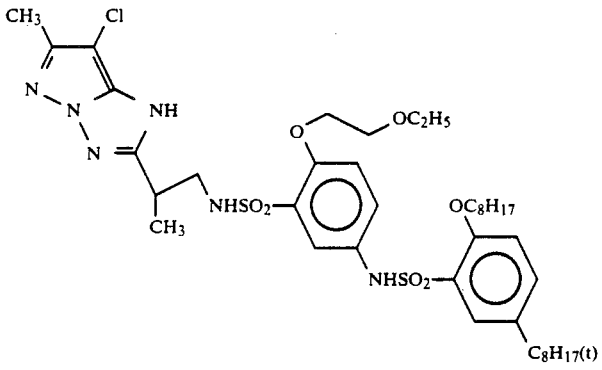

-continued
(M-32)
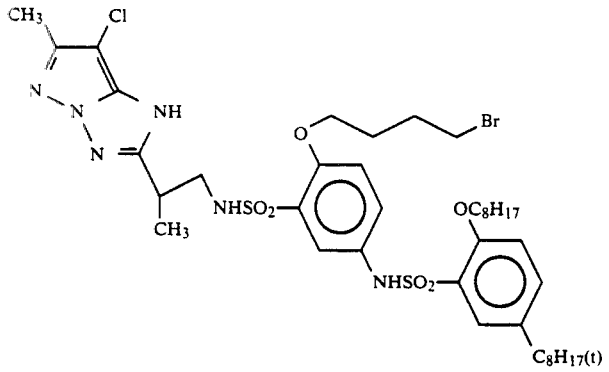
(M-33)
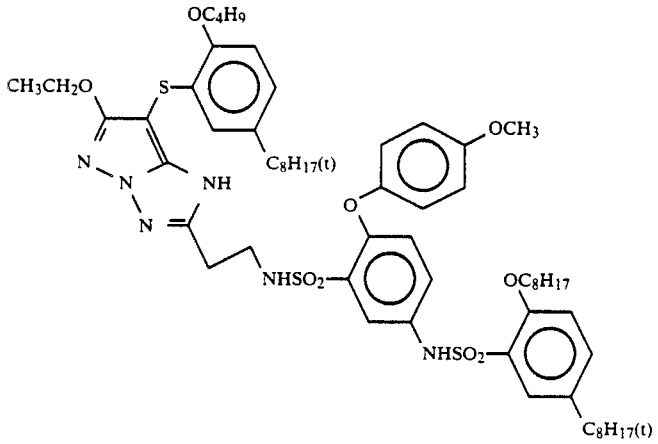
(M-34)
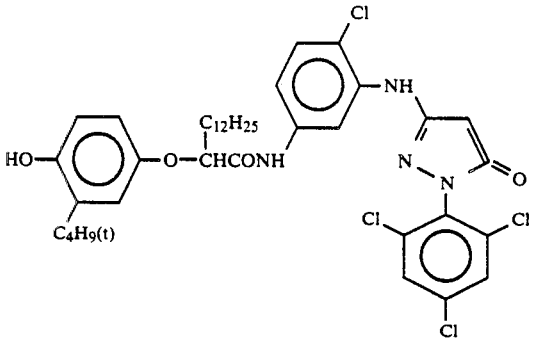
(M-35)
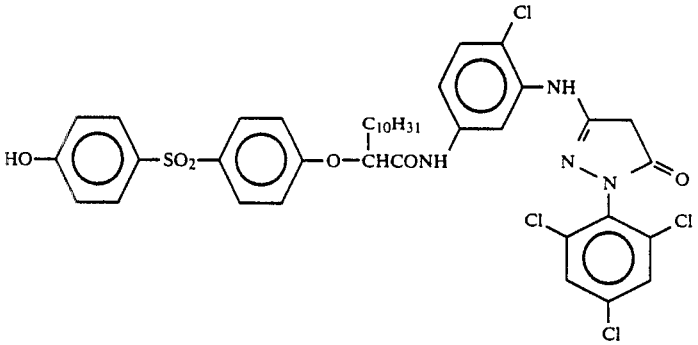

-continued
(M-36)
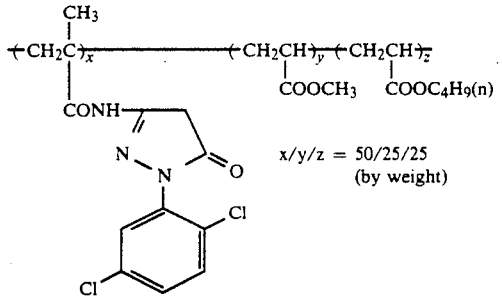
x/y/z = 50/25/25 (by weight)
(M-37)
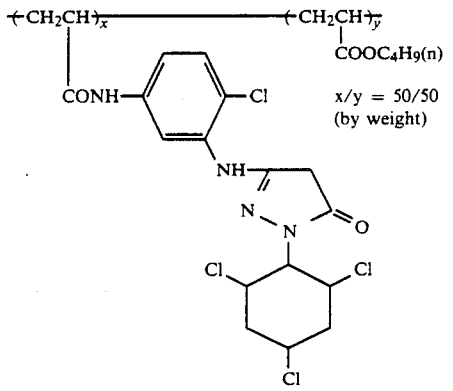
x/y = 50/50 (by weight)
(M-38)
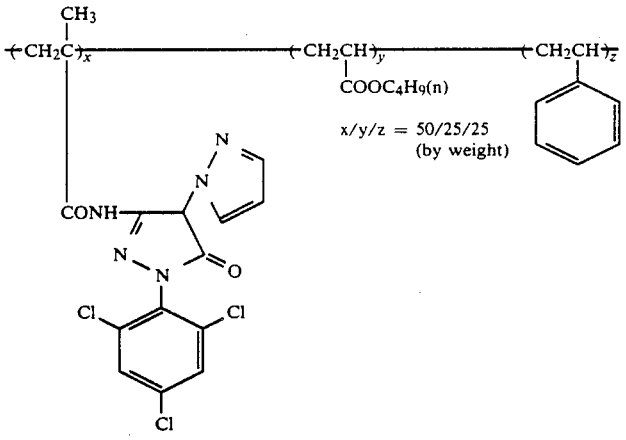
x/y/z = 50/25/25 (by weight)
(M-39)
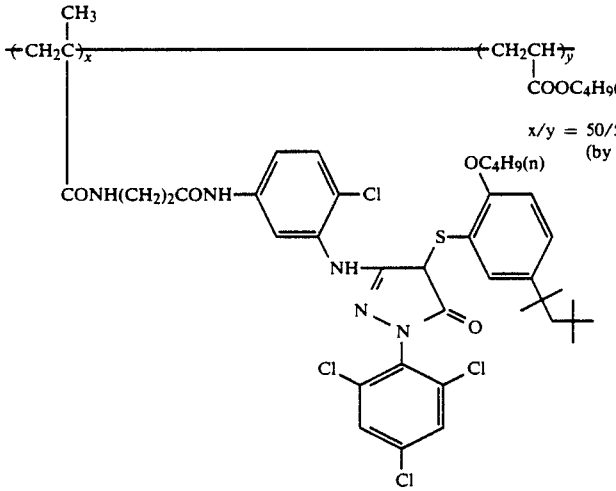
x/y = 50/50 (by weight)

-continued
(M-40)
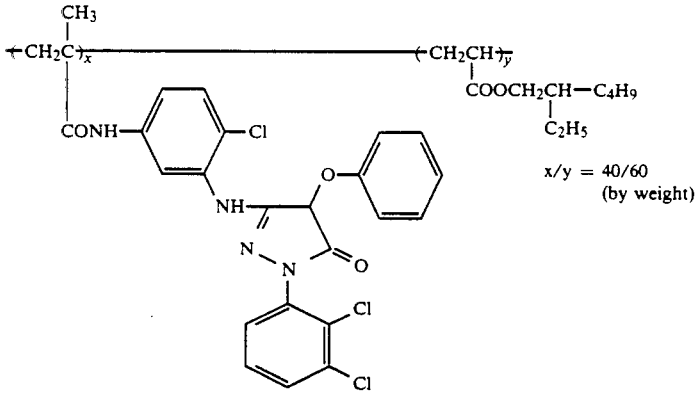
x/y = 40/60 (by weight)
(M-41)
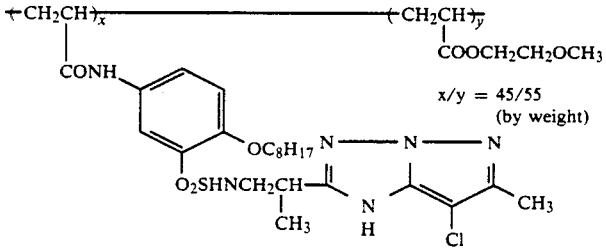
x/y = 45/55 (by weight)
(M-42)
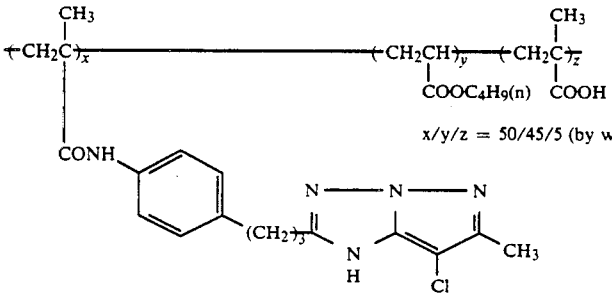
x/y/z = 50/45/5 (by weight)
(M-43)
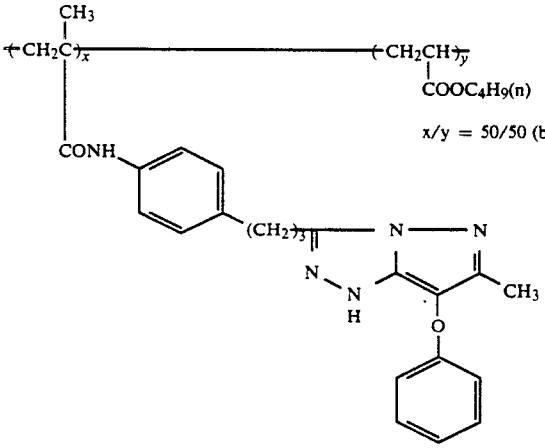
x/y = 50/50 (by weight)
(M-44)
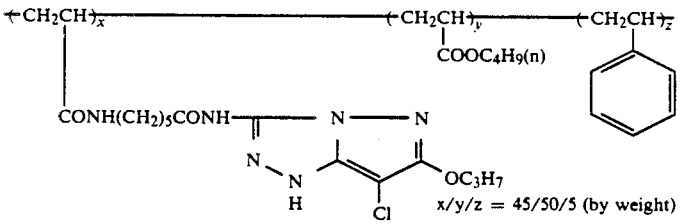
x/y/z = 45/50/5 (by weight)

-continued
(M-45)
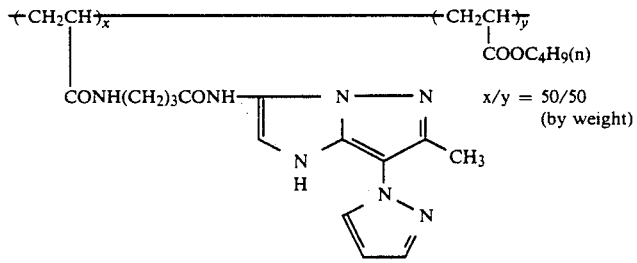
x/y = 50/50 (by weight)
(M-46)
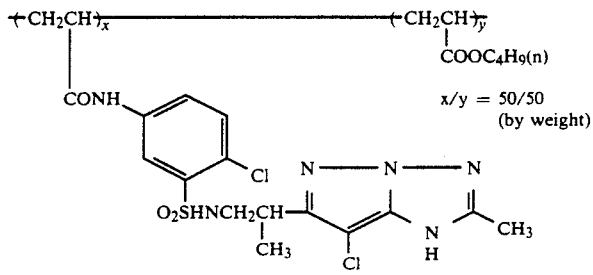
x/y = 50/50 (by weight)
(M-47)
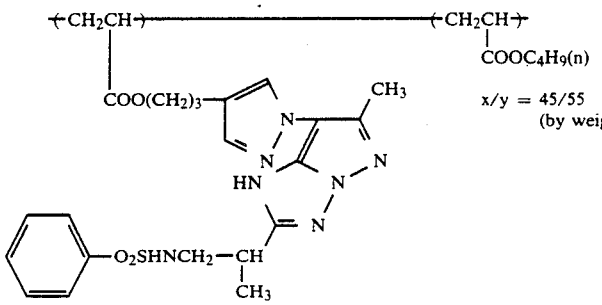
x/y = 45/55 (by weight)
Specific and preferred examples of the yellow couplers represented by formula (X) are shown below, however, the present invention should not be construed as being limited thereto.
(Y-1)
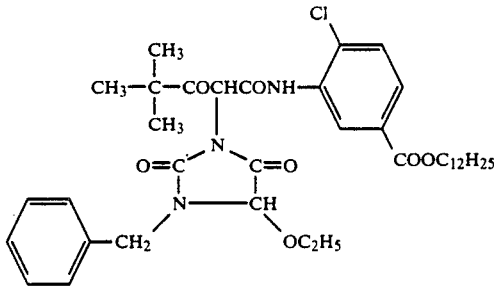
(Y-2)
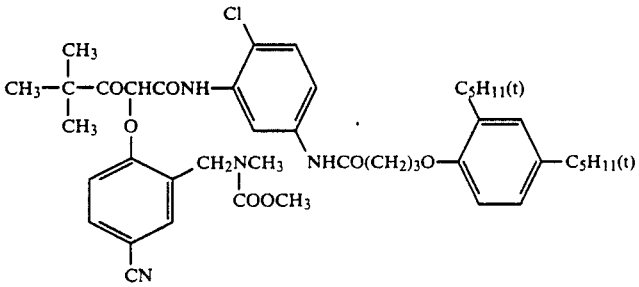

-continued
(Y-3)
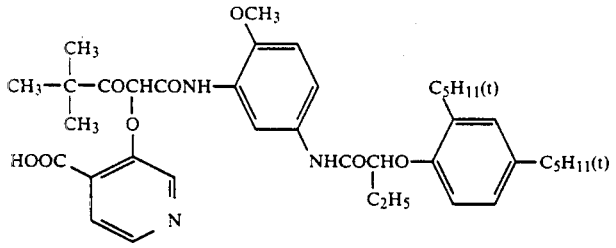
(Y-4)
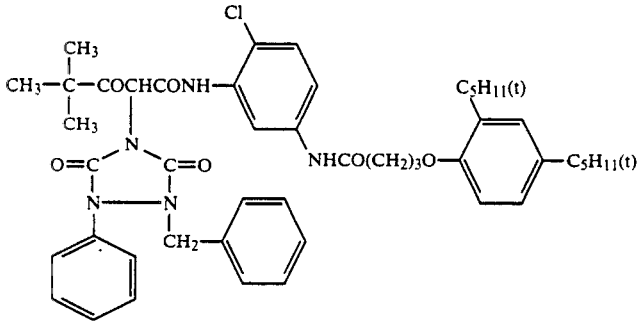
(Y-5)
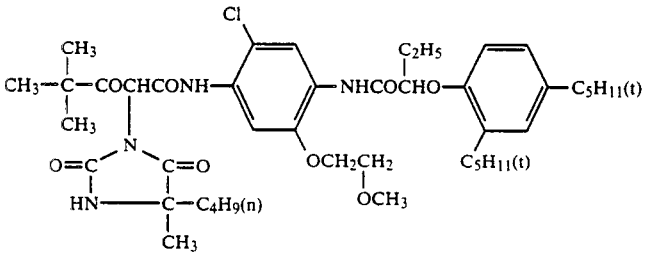
(Y-6)
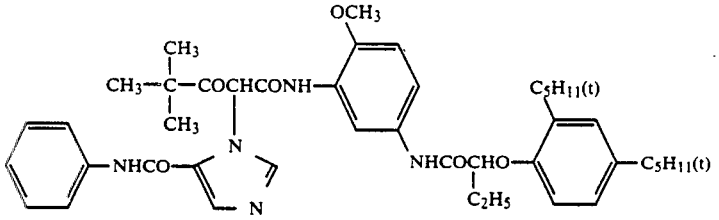
(Y-7)
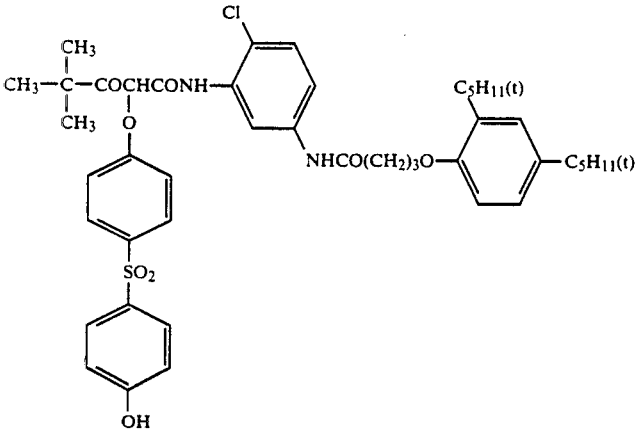

-continued
(Y-8)
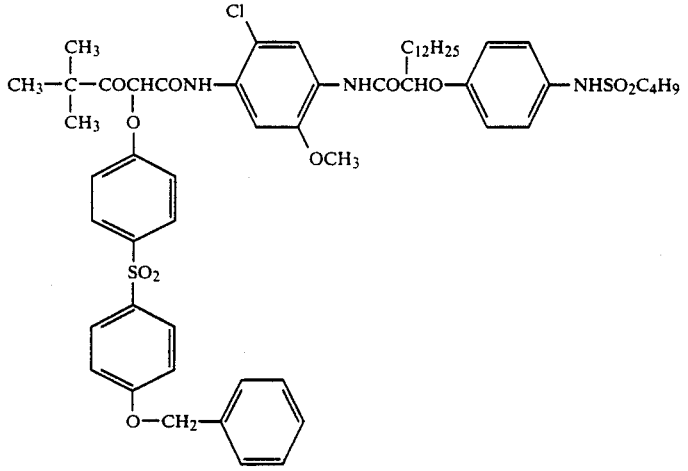
(Y-9)
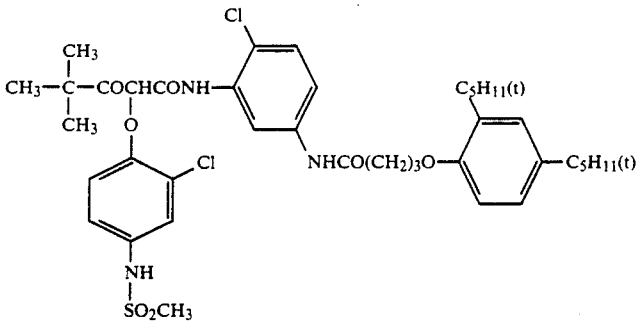
(Y-10)
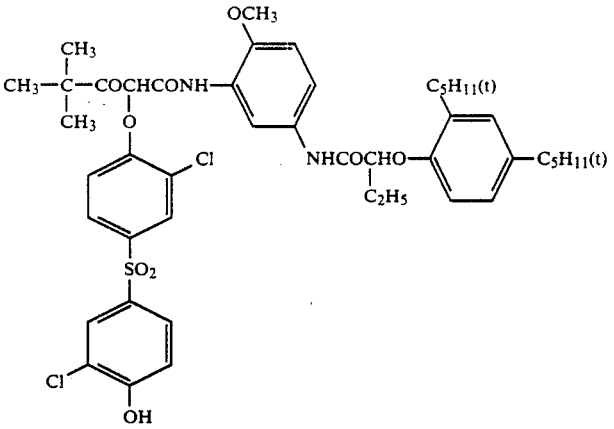
(Y-11)
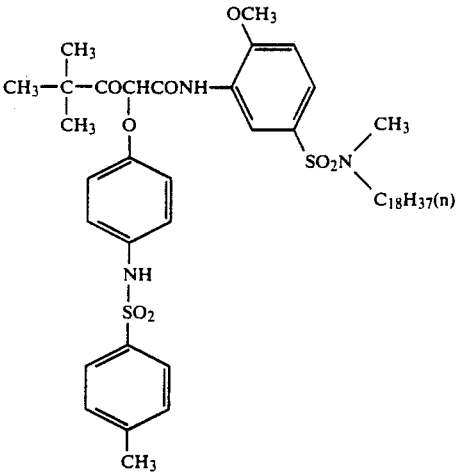

-continued
(Y-12)
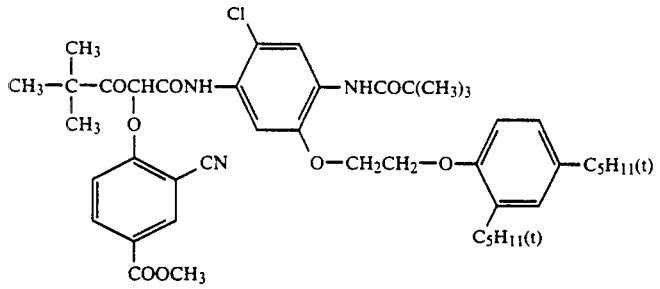
(Y-13)
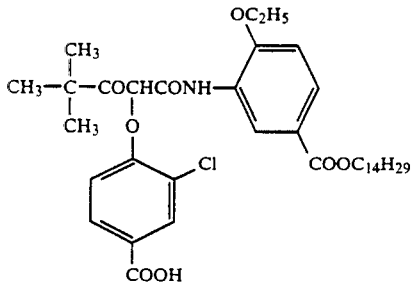
(Y-14)
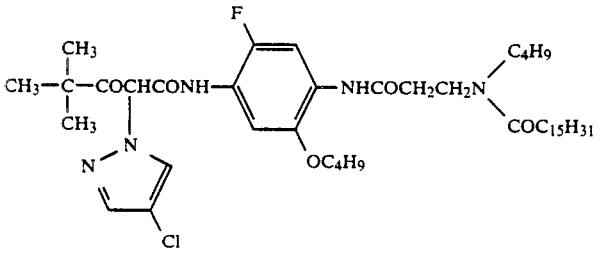
(Y-15)
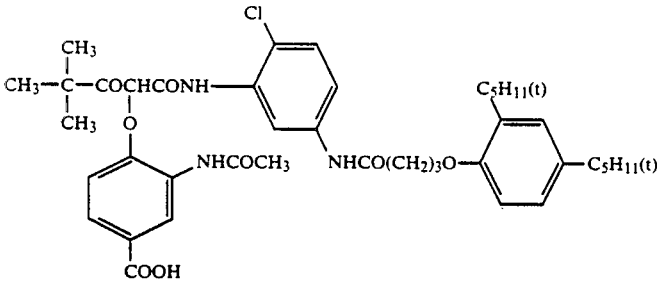
(Y-16)
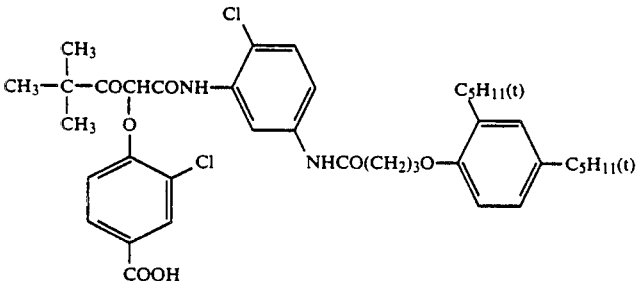
(Y-17)
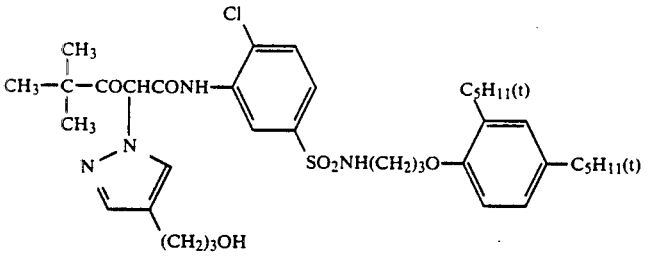

-continued
(Y-18)
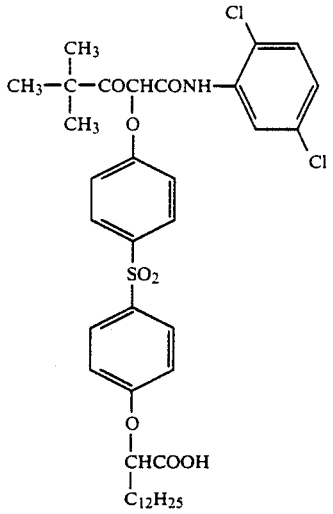
(Y-19)
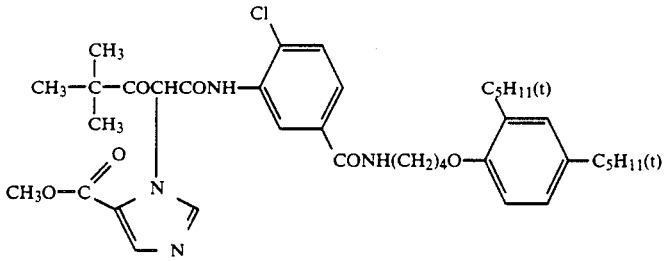
(Y-20)
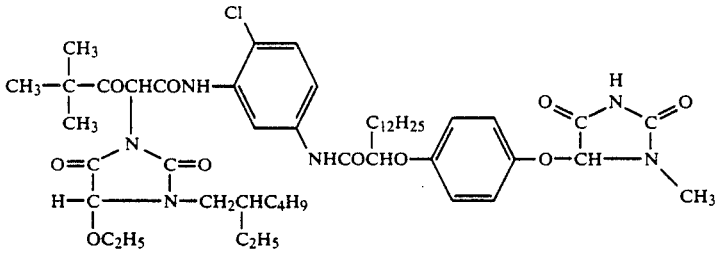
(Y-21)
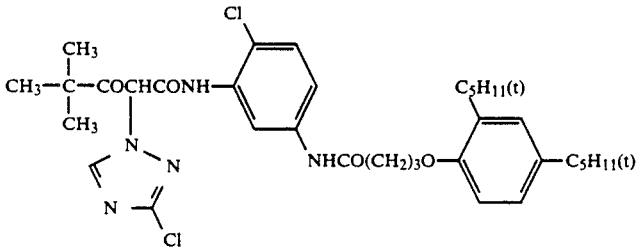
(Y-22)
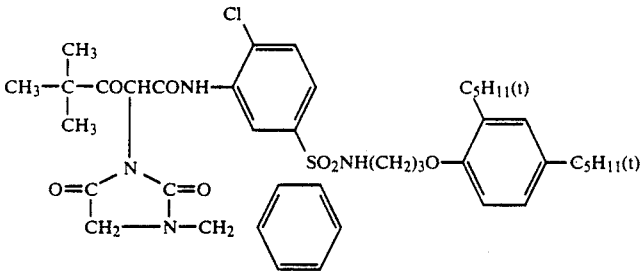

-continued
(Y-23)
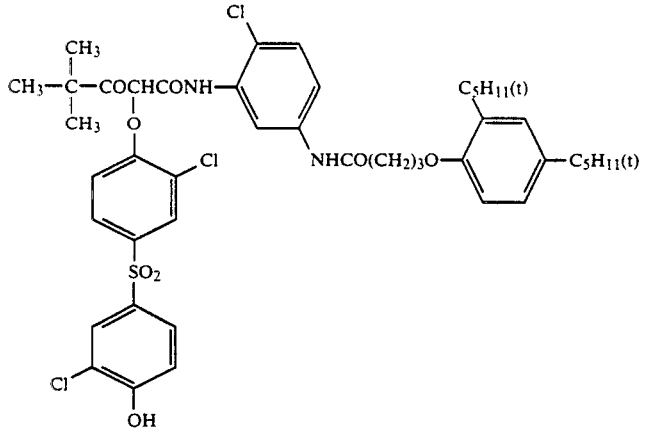
(Y-24)
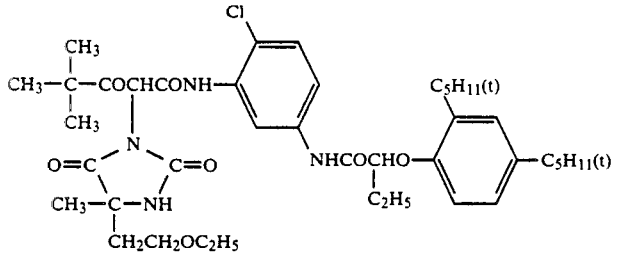
(Y-25)
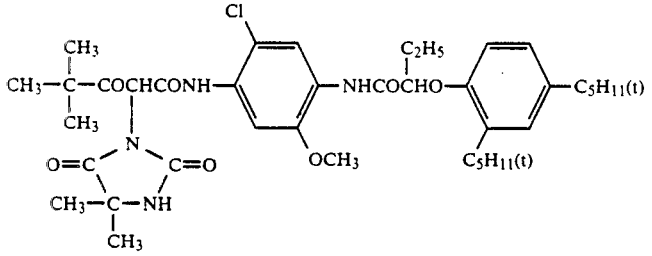
(Y-26)
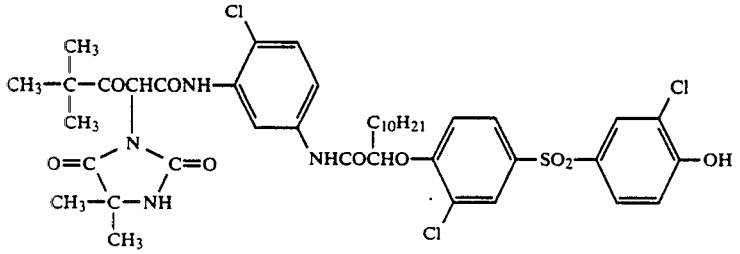
(Y-27)
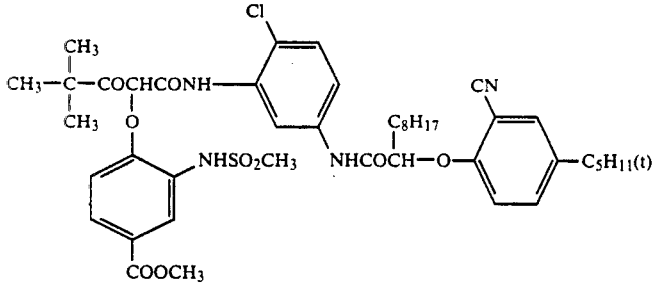

-continued
(Y-28)
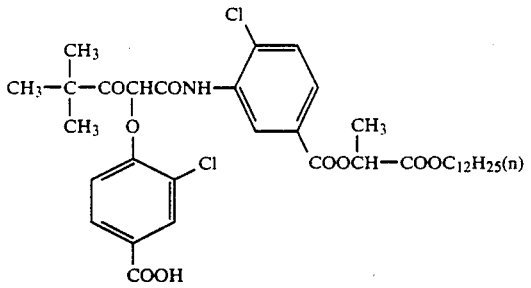
(Y-29)
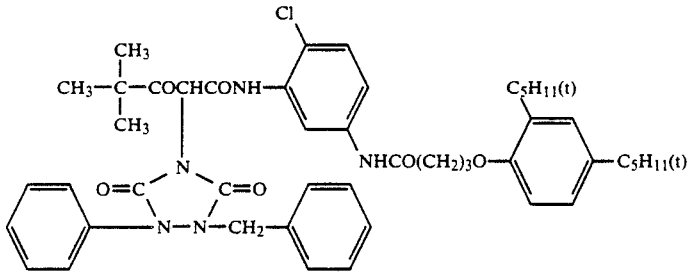
(Y-30)
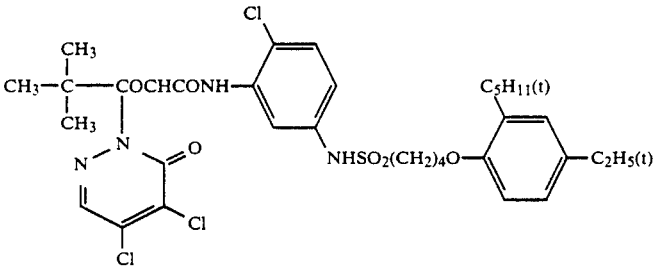
(Y-31)
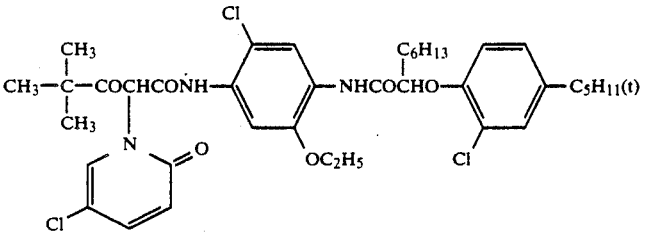
(Y-32)
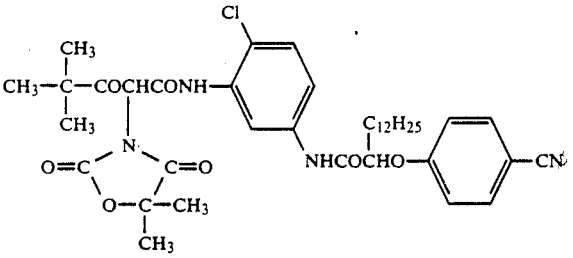

-continued
(Y-33)
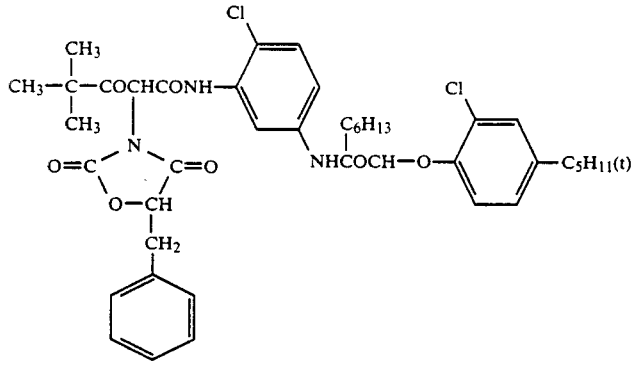
(Y-34)
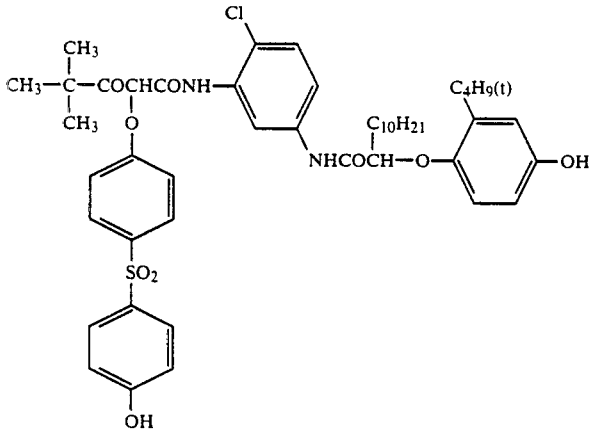
(Y-35)
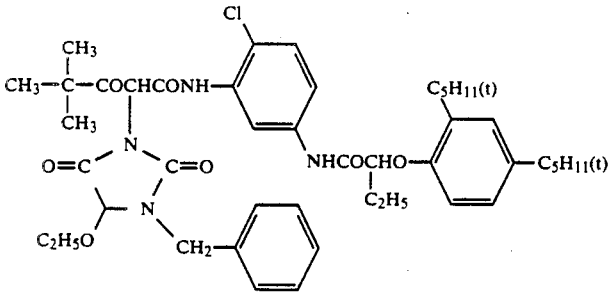
(Y-36)
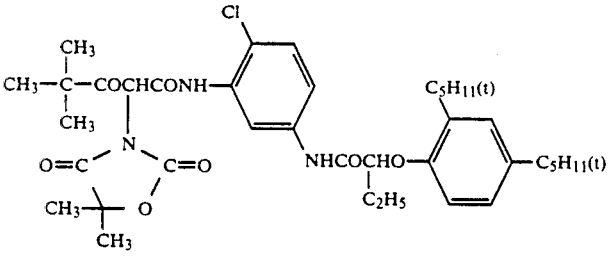

-continued
(Y-37)
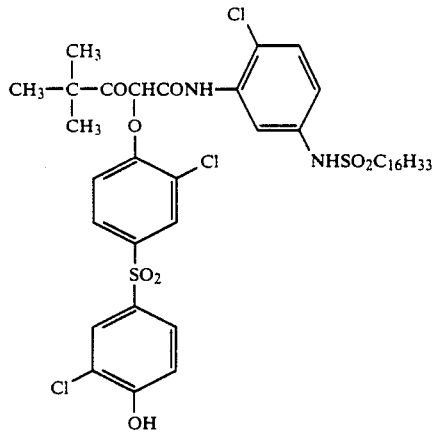
(Y-38)
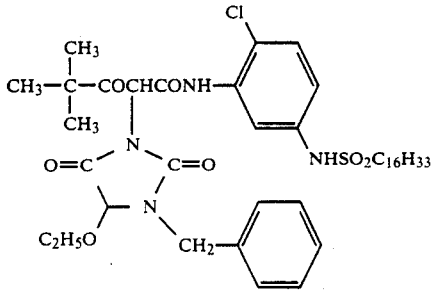
(Y-39)
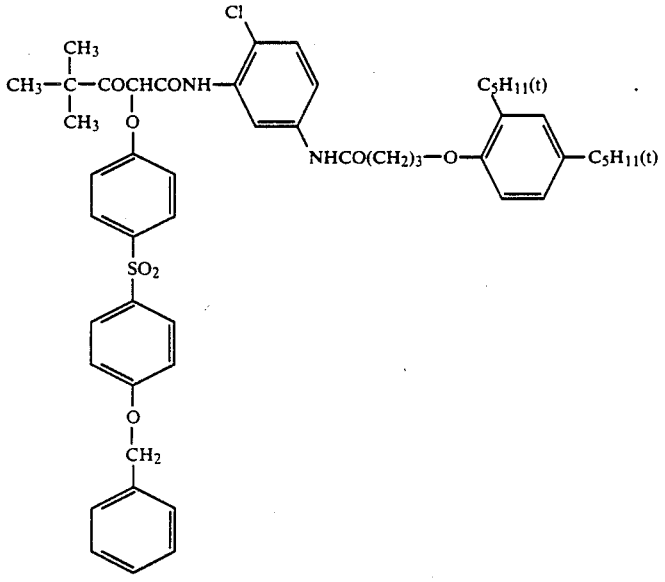

-continued
(Y-40)
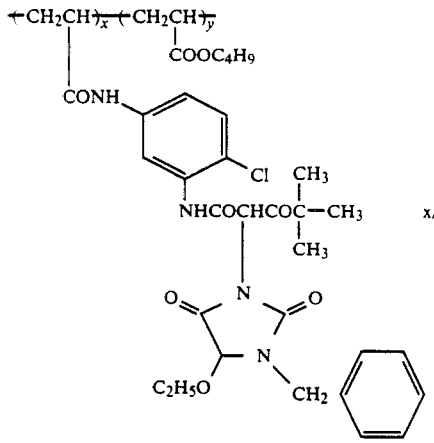
x/y = 50/50 (by weight)
(Y-41)
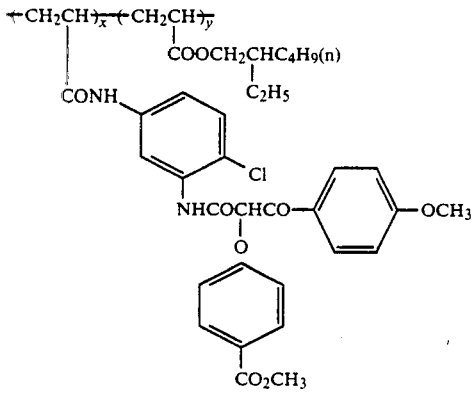
x/y = 45/55 (by weight)
(Y-42)
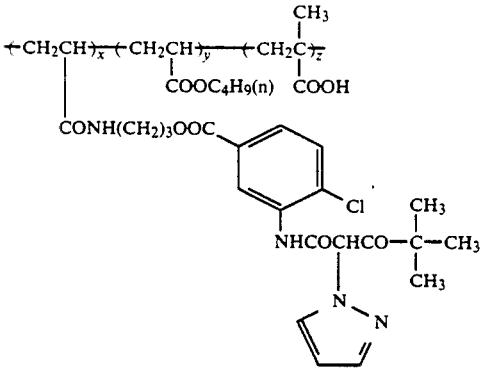
x/y/z = 50/45/5 (by weight)
(Y-43)
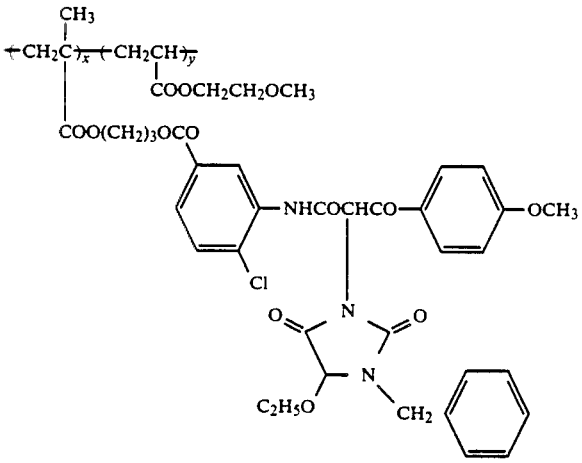
x/y = 50/50 (by weight)

-continued
(Y-44)
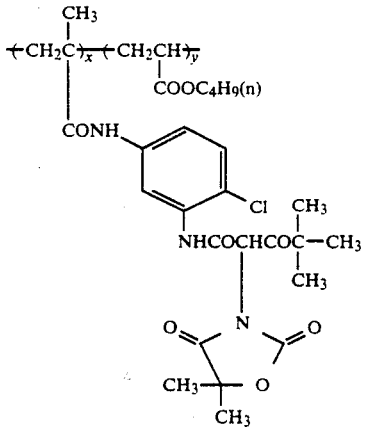
x/y = 50/50 (by weight)
(Y-45)
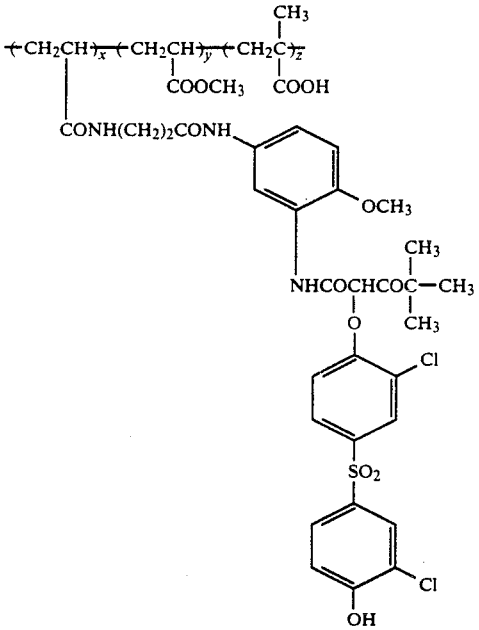
x/y/z = 55/40/5 (by weight)
(Y-46)
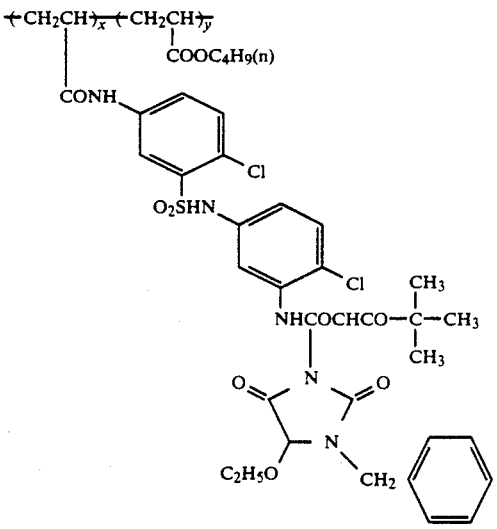
x/y = 60/40 (by weight)

-continued

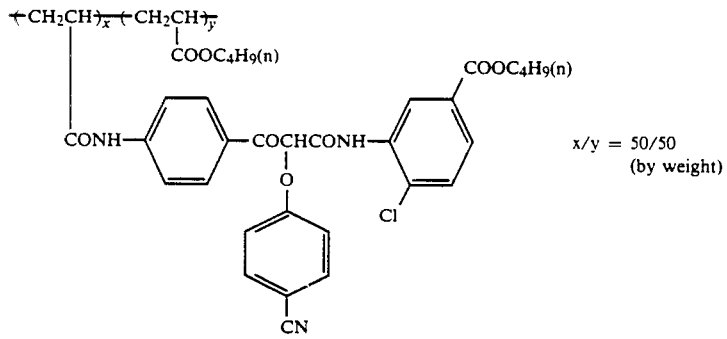

(Y-47)

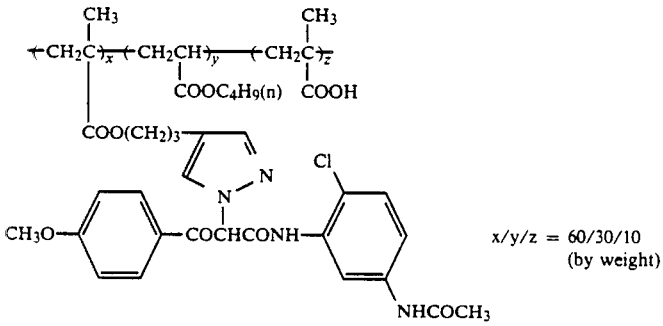

(Y-48)

The cyan couplers of formula (VI) can be synthesized by known processes as described, e.g., in U.S. Pat. Nos. 2,423,730 and 3,772,002, and the cyan couplers of formula (VII) can be synthesized by known processes as described, e.g., in U.S. Pat. Nos. 2,895,826, 4,333,999, and 4,327,173.

The magenta couplers represented by formula (VIII) can be synthesized by the processes described, e.g., in Japanese Patent Application (OPI) Nos. 74027/74 and 74028/74, Japanese Patent Publication Nos. 27930/73 and 33846/78, and U.S. Pat. No. 3,519,429. The magenta couplers represented by formula (IX) can be synthesized by the processes disclosed, e.g., in Japanese Patent Application (OPI) No. 162548/84, U.S. Pat. No. 3,725,067, and Japanese Patent Application (OPI) Nos. 171956/84 and 33552/85.

The yellow couplers represented by formula (X) can be synthesized by the processes described, e.g., in Japanese Patent Application (OPI) No. 48541/79, Japanese Patent Publication No. 10739/83, U.S. Pat. No. 4,326,024, and *Research Disclosure*, (RD No. 18053).

The couplers which can be used in the present invention may further include colored couplers having color correction effects or DIR couplers capable of releasing a developing inhibitor with the progress of development. Further, the couplers may be those producing a colorless coupling product.

The colored couplers include those described, e.g., in U.S. Pat. Nos. 3,476,560, 2,521,908, and 3,034,892, Japanese Patent Publication Nos. 2016/69, 22335/63, 11304/67, and 32461/69, Japanese Patent Application (OPI) Nos. 26034/76 and 42121/77, and West German Patent Application (OLS) No. 2,418,959.

The DIR couplers include those described, e.g., in U.S. Pat. Nos. 3,227,554, 3,617,291, 3,701,783, 3,790,384, and 3,632,345, West German Patent Application (OLS) Nos. 2,414,006, 2,454,301, and 2,454,329, British Patent 953,454, Japanese Patent Application (OPI) Nos. 69624/77 and 122335/74, and Japanese Patent Publication No. 16141/76.

In addition to DIR couplers, the light-sensitive material may contain a compound capable of releasing a development inhibitor during development processing, such as those described, e.g., in U.S. Pat. Nos. 3,297,445 and 3,379,529, West German Patent Application (OLS) No. 2,417,914, and Japanese Patent Application (OPI) Nos. 15271/77 and 9116/78. It is particularly preferable for ensuring the effects of the present invention that the magenta couplers represented by formulae (VIII) and (IX), are combined with such a development inhibitor-releasing compound.

The above-described couplers are generally added to a silver halide emulsion in an amount of from $2\times10^{-3}$ mol to $5\times10^{-1}$ mol, and preferably from $1\times10^{-2}$ mol to $5\times10^{-1}$ mol, per mol of Silver.

In carrying out the present invention, the compounds of formula (I) can be used in combination with one or more of known discoloration inhibitors. Known discoloration inhibitors include hydroquinone derivatives, such as described in U.S. Pat. Nos. 2,360,290, 2,418,613, 2,675,314, 2,701,197, 2,704,713, 2,728,659, 2,732,300, 2,735,765, 2,710,801, and 2,816,028, and British Patent 1,363,921; gallic acid derivatives, such as described in U.S. Pat. Nos. 3,457,079 and 3,069,262; p-alkoxyphenols, such as described in U.S. Pat. No. 2,735,765 and 3,698,909 and Japanese Patent Publication No. 20977/74 and 6623/77; p-oxyphenol derivatives, such as described in U.S. Pat. Nos. 3,432,300, 3,573,050, 3,574,627, and 3,764,337 and Japanese Patent Application (OPI) Nos. 35633/77, 14743/77, and 152225/77; and bisphenols, such as described in U.S. Pat. No. 3,700,455.

The compound of the present invention (discoloration inhibitor) may be incorporated into the photographic layers of color light-sensitive materials, for example, by dissolving it in a low-boiling organic solvent (e.g., ethyl acetate, ethanol, etc.), and directly adding the solution to a silver halide emulsion or a mixed solution of a coupler dispersion without emulsification. However, it is desirable that the compound of the invention should be dissolved in a high-boiling organic solvent (e.g., dibutyl phthalate, tricresyl phosphate, etc.), and, if desired, a low boiling auxiliary solvent together with the couplers. Then, the solution is dispersed in a water-soluble protective colloid (e.g., gelatin), in the form of oil droplets, and the dispersion is then added to a silver halide emulsion. The dispersion of the compound alone and the coupler dispersion may be separately prepared and added to a silver halide emulsion.

Photographic layers to which the compound of the present invention can be added as a dye image stabilizer include coupler-containing light-sensitive silver halide emulsion layers (e.g., a red-sensitive silver halide emulsion, a green-sensitive silver halide emulsion, a blue-sensitive silver halide emulsion, etc.) and light-insensitive photographic auxiliary layers (e.g., a protective layer, a filter layer, an intermediate layer, a subbing layer, etc.). In particular, the compound of the invention, when incorporated into a magenta coupler-containing photographic layer, effectively prevents discoloration or color change of a magenta dye image.

Typical examples of the high-boiling organic solvents to be used for dispersing the compound of the present invention, either alone or in combination with couplers, include those described in U.S. Pat. No. 3,676,137 (such as, butyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate, trioctadecylphosphate, etc.); diethyl succinate; dioctyl adipate; and the liquid dye stabilizers described in *Product License Index*, Vol. 83, 26–29 (Mar., 1971), under the name of "improved photographic dye image stabilizers".

Examples of the low-boiling organic solvents which can be used as an auxiliary solvent together with the high-boiling organic solvent are ethyl acetate, butyl acetate, ethyl propionate, ethyl formate, butyl formate, nitroethane, carbon tetrachloride, chloroform, hexane, cyclohexane, ethylene glycol, acetone, ethanol, dimethylformamide, dioxane, etc. These low-boiling organic solvents may contain benzene, toluene, xylene, etc.

The discoloration inhibitor of the present invention, when dissolved in a solvent either alone or in combination with a coupler, can be dispersed in an aqueous protective colloid solution in the presence of a surface active agent. Examples of the surface active agent to be used include saponin, sodium alkylsulfosuccinates, sodium alkylbenzenesulfonates, etc. The hydrophilic protective colloids include gelatin (including lime-processed gelatin and acid-processed gelatin), casein, carboxymethyl cellulose, polyvinyl alcohol, polyvinylpyrrolidone, a strene-maleic anhydride copolymer, a condensate of a styrene-maleic anhydride copolymer and polyvinyl alcohol, polyacrylate, ethyl cellulose, and the like.

Supports which can be used in the present invention are those conventionally used, and specifically include a cellulose nitrate film, a cellulose acetate film, a cellulose acetate butylate film, a cellulose acetate propionate film, a polystyrene film, a polyethylene terephthalate film, a polycarbonate film (as well as laminates of these polymer films), a thin glass sheet, paper, and the like. Also usable to advantage are paper supports coated or laminated with baryta or an $\alpha$-olefin polymner, and preferably a polymer of an $\alpha$-olefin having from 2 to 10 carbon atoms (e.g., polyethylene, polypropylene, an ethylene-butene copolymer, etc.), and plastic films whose surface is roughened to improve adhesion to other high polymeric materials, such as described in Japanese Patent Publication No. 19068/72.

In selecting whether the support to be used should be transparent or opaque, the determination should be made according to the end use of the light-sensitive material. It is possible to add a dye or a pigment to a transparent material to form a colored transparent support.

Opaque supports embrace those which are essentially opaque, such as paper; transparent films to which a dye or a pigment (e.g., titanium dioxide), has been added; plastic films having been subjected to surface treatment according to, for example, the process disclosed in Japanese Patent Publication No. 19068/72; and paper or plastic films having been made completely light shielding by addition of carbon black, dyes, etc. A subbing layer is usually provided on the support. In order to improve adhesiveness of the support, the surface of the support may be subjected to preliminary treatment, such as corona discharge, ultraviolet irradiation, flame treatment, and the like.

In carrying out the present invention, it is effective and preferable, for prevention of light discoloration, to provide an ultraviolet absorbing layer on the upper side of a photographic light-sensitive emulsion layer.

The present invention is free from any limitation regarding the kind of employable color processing agents, e.g., a color developing agent, a bleaching agent, a fixing agent, and the like. The present invention can be applied with advantage to the so-called silver saving type color light-sensitive materials, such as described in U.S. Pat. No. 3,902,905. Further, the present invention is not limited by the kind of intensifiers for color intensification. Any of those described in West German Patent Application (OLS) No. 181,390, Japanese Patent Application (OPI) No. 9728/73, and Japanese Patent Publication No. 14625/77, may be used.

Color light-sensitive materials to which the present invention is applicable include ordinary color light-sensitive materials, and particularly color light-sensitive materials for prints. In addition, the present invention can also be applied to color photographic systems, and particularly a color diffusion transfer system, such as described in U.S. Pat. Nos. 3,227,550, 3,227,551, and 3,227,552 and U.S. Published Pat. application No. B351,673.

Formation of a dye image on the color photographic material according to the present invention requires color development processing subsequent to exposure to light. Color photographic development processing basically includes color development, bleaching, and fixation. Two of these processing steps may sometimes be carried out simultaneously. A combination of color development, first fixation, and bleach-fix is also possible. If necessary, the development processing step may be combined with prehardening, neutralization, first development (black-and-white development), image stabilization, washing, and the like. The processing is usually conducted at 18° C. or higher. A processing temperature range often used is from 20° C. to 60° C., or from 30° C. to 60° C.

The color developing solution is usually an alkaline aqueous solution having a pH of 8 or more, and preferably a pH between 9 and 12, containing an aromatic primary amine color developing agent. Typical examples of the color developing agent includes 4-amino-N,N-diethylaniline, 3-methyl 4-amino-N,N-diethylaniline, 4-ethyl-N-8-hydroxyethylaniline, 4-amino-3-methyl-N-ethyl-N-8-methanesulfonamidoethylaniline, 4-amino-N,N-dimethylaniline, 4-amino-3-methoxy-N,N-diethylaniline, 4-amino-3-methyl-N-ethyl-8-methoxyethylaniline, 4-amino-3-methoxy-N-ethyl-N-8-methoxyethylaniline, 4-amino-3-8-methanesulfonamidoethyl-N,N-diethylaniline, and salts thereof (e.g., sulfates, hydrochlorides, sulfites, p-toluenesulfonates, etc.). Additional examples of usable developing agents are described in U.S. Pat. Nos. 2,193,015 and 2,592,364, Japanese Patent Application (OPI) No. 64933/73, and L.F.A. Mason, *Photographic Processing Chemistry*, 226-229, Focal Press, London (1966).

The color developing solution can further contain a pH buffer, such as a sulfite, carbonate, borate or phosphate of an alkali metal, etc.; a development inhibitor, such as a bromide, an iodide, an organic antifoggant, etc.; an antifoggant; and the like.

Specific examples of employable antifoggants include potassium bromide, potassium iodide; nitrobenzimidazoles (as described in U.S. Pat. Nos. 2,496,940 and 2,656,271); mercaptobenzimidazole, 5-methylbenzotriazole, 1-phenyl-5-mercaptotetrazole; the compounds disclosed in U.S. Pat. Nos. 3,113,864, 3,342,596, 3,295,976, 3,615,522, and 3,597,199; thiosulfonyl compounds (as described in British Patent 972,211); phenazine-N-oxides (as described in Japanese Patent Publication No. 41675/71); and the antifoggants described in *Kagaku Shashin Binran*, Mid. Vol., 29-47.

If desired, the color developing solution can further contain a water softener, a preservative (e.g., hydroxylamine), an organic solvent (e.g., benzyl alcohol and diethylene glycol), a development accelerator (e.g., polyethylene glycol, quaternary ammonium salts, and amines), a dye forming coupler, a competing coupler, a fogging agent (e.g., sodium borohydride), an auxiliary developing agent (e.g., 1-phenyl-3-pyrazolidone), a viscosity-imparting agent, and the like.

It is desirable to use no benzyl alcohol in the color developing solution. If benzylacohol is used, its content is preferably not more than 2.0 ml/l, and more preferably not more than 0.5 ml/l.

The color development processing is preferably completed within 2.5 minutes, more preferably between 30 seconds and 2.5 minutes, and most preferably between 45 seconds and 2 minutes.

While the color light-sensitive material according to the present invention is subjected to ordinary color development processing, color intensification can also be applied thereto. Color intensification can be carried out by using, for example, a peroxide (as described in U.S. Pat. Nos. 3,674,490 and 3,761,265, West German Patent Application (OLS) No. 2,056,360, and Japanese Patent Application (OPI) Nos. 6338/72, 10538/72, 13335/77, 13334/72, and 13336/77); a cobalt complex salt (as described in West German Patent Application (OLS) No. 2,226,770 and Japanese Patent Application (OPI) Nos. 9728/73, 9729/73, 6026/76, 94822/76, 133023/76, 7728/77, and 11034/77); or chlorous acid (as described in Japanese Patent Publication No. 14625/77 and Japanese Patent Application(OPI) Nos. 99022/76 and 103430/76).

After color development, the photographic emulsion layers are usually subjected to bleaching. Bleaching may be carried out simultaneously with fixation, or these two steps may be effected separately. Bleaching agents to be used include compounds of polyvalent metals (e.g., iron (III), cobalt (III), chromium (IV), copper (II), etc.), peracids, quinones, and nitroso compounds. Examples of these bleaching agents include ferricyanides; bichromatates; organic complex salts of iron (III) or cobalt (III}, such as complex salts with organic acids (e.g., aminopolycarboxylic acids (e.g., ethylenediaminetetraacetic acid, nitrilotriacetic acid, 1,3-diamino-2-propanoltetraacetic acid, etc.), citric acid, tartaric acid, malic acid, etc.); persulfates; permanganates; nitrosophenol; and so on. Of these, potassium ferricyanide, sodium ethylenediaminetetraacetato ferrate, and ammonium ethylenediaminetetraacetato ferrate are particularly useful. Ethylenediaminetetraacetato farrate complex salts are useful in both an independent bleaching bath and a combined blix bath.

The bleaching or blix bath may contain various additives, such as a bleaching accelerator, as described in U.S. Pat. Nos. 3,042,520 and 3,241,966 and Japanese Patent Publication No. 8506/70 and 8836/70.

The silver halide color photographic material according to the present invention provides a color image having long-term preservability, which is free from discoloration and background stains.

In the color photographic materials of the present invention, the compounds of formula (I) produce sufficient effects as discoloration inhibitors to prevent discoloration or color change of a dye image without causing a change in hue or fog.

The compounds of the present invention are also effective for dye image stabilization of light-sensitive materials other than silver halide color photographic materials. In addition, they are effective for stabilization of color formers, dyes, and pigments used in materials other than light-sensitive materials.

The present invention is now illustrated in greater detail with reference to the following examples, but it should be understood that the present invention is not construed to be limited thereto. In these examples, all the percents are by weight unless otherwise indicated.

EXAMPLE 1

Ten grams of a magenta coupler (M-31) were dissolved in 20 ml of tricresyl phosphate and 20 ml of ethyl acetate, and the solution was emulsified and dispersed in 80 g of an aqueous gelatin solution containing 8 ml of a 1% aqueous solution of sodium dodecylbenzenesulfonate.

The resulting dispersion was mixed with 145 g of a green-sensitive silver chlorobromide emulsion (bromine content: 50 mol%; Ag content: 7 g), and sodium dodecylbenzenesulfonate was added thereto as coating aid. The resulting coating composition was coated on a paper support laminated on both sides thereof with polyethylene to such a coverage that 400 mg/m$^2$ of the coupler was coated.

Onto the coating film was further coated 1 g/m$^2$ of gelatin to form a protective layer.

The resulting light-sensitive material was designated as Sample 101.

Samples 102 to 106 were prepared in the same manner as Sample 101, except that the coupler dispersion further contained each of the discoloration inhibitors or combinations of discoloration inhibitor and reducing agent (1:1 by mol) as shown in Table 1 below. Each of the discoloration inhibitor and the reducing agents was added in an amount of 10 mol% based on the amount of the coupler.

Each of Samples 101 to 106 was exposed to light (1,000 lux) and processed according to the following processing steps using processing solutions having the following formulations.

| Processing Step: | Temperature | Time |
|---|---|---|
| Development | 33° C. | 3'30" |
| Blix | 33° C. | 1'30" |
| Washing | 28–35° C. | 3'00" |
| Developing Solution Formulation: | | |
| Benzyl alcohol | | 15 ml |
| Diethylenetriaminepentaacetic acid | | 5 g |
| KBr | | 0.4 g |
| $Na_2SO_3$ | | 5 g |
| $Na_2CO_3$ | | 30 g |
| Hydroxylamine sulfate | | 2 g |
| 4-Amino-3-methyl-N-ethyl-N-β-(methanesulfonamido)ethylaniline.$3/2H_2SO_4.H_2O$ | | 4.5 g |
| Water to make | | 1 l (pH = 10.1) |
| Blix Bath Formulation: | | |
| Ammonium thiosulfate (70%) | | 150 ml |
| $Na_2SO_3$ | | 5 g |
| Sodium ethylenediaminetetraacetato farrate | | 40 g |
| Ethylenediaminetetraacetic acid | | 4 g |
| Water to make | | 1 l (pH = 6.8) |

Each of the samples thus processed was subjected to accelerated discoloration test using a xenon tester, in which the sample was exposed to light of a xenon lamp (200,000 lux) through a ultraviolet absorbing filter cutting wavelengths of 400 nm or less (product of Fuji Photo Film Co., Ltd.) for 6 hours. The change in color density in the area having an initial density (before discoloration test) of 2.0 and the density of the white background, were measured by the use of a Macbeth densitometer RD-514 (Status AA filter). The results obtained are shown in Table 1.

TABLE 1

| Sample No. | Magenta Coupler | Discoloration Inhibitor | Reducing Agent | Change in Magenta Density ($D_{0=2.0}$) | Background Stain ($D_B$) |
|---|---|---|---|---|---|
| 101 | M-31 | — | — | −1.81 | 0.04 |
| 102 | M-31 | Comparative Compound (A) | — | −0.18 | 0.06 |
| 103 | M-31 | Comparative Compound (B) | — | −0.17 | 0.10 |
| 104 | M-31 | Compound 1 | — | −0.17 | 0.06 |
| 105 | M-31 | Compound 1 | S-46 | −0.19 | 0.04 |
| 106 | M-31 | Compound 2 | S-46 | −0.21 | 0.04 |

Comparative Compound (A):

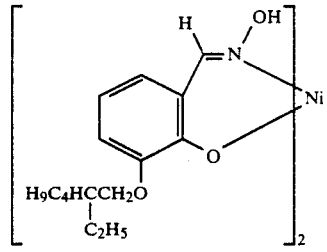

Comparative Compound (B):

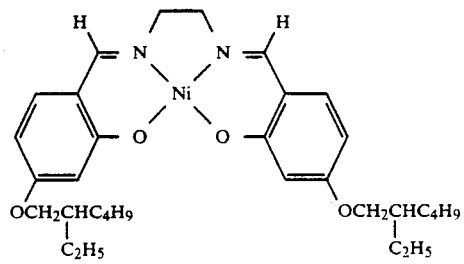

As can be seen from Table 1, the discoloration inhibitors according to the present invention, even when used in a very small amount, produce great effects to inhibit discoloration of a dye image similar to the comparative metal complex discoloration inhibitors. These compounds, after redox reaction with a reducing agent, do not leave their color in the white background, whereas the color of the comparative metal complex discoloration inhibitors remains in the white background.

That is, the compounds according to the present invention not only produce great effects on prevention of discoloration or color change of a dye image but, when combined with an appropriate reducing agent, achieve striking effects to prevent stain formation.

When the same test as described above was carried out on Compounds 3 to 6, 8, 18, 23, and 24, equivalent effects were manifested.

EXAMPLE 2

On a paper support laminated on both sides thereof with polyethylene, was coated the following 1st to 12th layers to prepare a multilayer color photographic material (Sample 201). The polyethylene laminate on the side to be coated contained titanium white as a white pigment, and a trace amount of ultramarine as a bluing dye.

| | |
|---|---|
| 1st Layer (Gelatin Layer): | |
| Gelatin | 1.30 g/m² |
| 2nd Layer (Antihalation Layer): | |
| Black colloidal silver | 0.10 g/m² |
| Gelatin | 0.70 g/m² |
| 3rd Layer (Low-Sensitive Red-Sensitive Layer): | |
| Silver iodobromide emulsion (silver iodide: 5.0 mol %; mean grain size: 0.4 μm) spectrally sensitized with red sensitizing dyes*1,*2 | 0.15 g of Ag/m² |
| Gelatin | 1.00 g/m² |
| Cyan coupler*3 | 0.14 g/m² |
| Cyan coupler*4 | 0.07 g/m² |
| Discoloration inhibitors*5,*6,*7 | 0.10 g/m² |
| Coupler solvents*8,*9 | 0.06 g/m² |
| 4th Layer (High-Sensitive Red-sensitive Layer): | |

-continued

| | |
|---|---|
| Silver iodobromide emulsion (silver iodide: 6.0 mol %; mean grain size: 0.7 μm) spectrally sensitizing with red sensitizing dyes*1,*2 | 0.15 g of Ag/m$^2$ |
| Gelatin | 1.00 g/m$^2$ |
| Cyan coupler*3 | 0.20 g/m$^2$ |
| Cyan coupler*4 | 0.10 g/m$^2$ |
| Discoloration inhibitors*5,*6,*7 | 0.15 g/m$^2$ |
| Coupler solvents*8,*9 | 0.10 g/m$^2$ |
| 5th Layer (Intermediate Layer): | |
| Magenta colloidal silver | 0.02 g/m$^2$ |
| Gelatin | 1.00 g/m$^2$ |
| Color mixing inhibitor*10 | 0.08 g/m$^2$ |
| Color mixing inhibitor solvents*11,*12 | 0.16 g/m$^2$ |
| Polymer latex*13 | 0.10 g/m$^2$ |
| 6th Layer (Low-Sensitive Green-Sensitive Layer): | |
| Silver iodobromide emulsion (silver iodide: 2.5 mol %; mean grain size: 0.4 μm) spectrally sensitized with green sensitizing dye*14 | 0.10 g of Ag/m$^2$ |
| Gelatin | 0.80 g/m$^2$ |
| Magenta coupler*15 | 0.10 g/m$^2$ |
| Discoloration inhibitor*16 | 0.10 g/m$^2$ |
| Stain inhibitor*17 | 0.01 g/m$^2$ |
| Stain inhibitor*18 | 0.001 g/m$^2$ |
| Coupler solvents*11,*19 | 0.15 g/m$^2$ |
| 7th Layer (High-Sensitive Green-Sensitive Layer): | |
| Silver iodobromide emulsion (silver iodide: 3.5 mol %; mean grain size: 0.9 μm) spectrally sensitized with green sensitizing dye*14 | 0.10 g of Ag/m$^2$ |
| Gelatin | 0.80 g/m$^2$ |
| Magenta coupler*15 | 0.10 g/m$^2$ |
| Discoloration inhibitor*16 | 0.10 g/m$^2$ |
| Stain inhibitor*17 | 0.01 g/m$^2$ |
| Stain inhibitor*18 | 0.001 g/m$^2$ |
| Coupler solvents*11,*19 | 0.15 g/m$^2$ |
| 8th Layer (Yellow Filter Layer): | |
| Yellow colloidal silver | 0.20 g/m$^2$ |
| Gelatin | 1.00 g/m$^2$ |
| Color mixing inhibitor*10 | 0.06 g/m$^2$ |
| Color mixing inhibitor solvents*11,*12 | 0.15 g/m$^2$ |
| Polymer latex*13 | 0.10 g/m$^2$ |
| 9th Layer (Low-Senstive Blue-Sensitive Layer): | |
| Silver iodobromide emulsion (silver iodide: 2.5 mol %; mean grain size: 0.5 μm) spectrally sensitzed with blue sensitizing dye*20 | 0.15 g of Ag/m$^2$ |
| Gelatin | 0.50 g/m$^2$ |
| Yellow coupler*21 | 0.20 g/m$^2$ |
| Stain inhibitor*18 | 0.001 g/m$^2$ |
| Coupler solvent*9 | 0.05 g/m$^2$ |
| 10th Layer (High-Senstive Blue-Sensitive Layer): | |
| Silver iodobromide emulsion (silver iodide: 2.5 mol %; mean grain size: 1.2 μm) spectrally sensitized with red sensitizing dye*20 | 0.25 g of Ag/m$^2$ |
| Gelatin | 1.00 g/m$^2$ |
| Yellow coupler*21 | 0.40 g/m$^2$ |
| Stain inhibitor*18 | 0.002 g/m$^2$ |
| Coupler solvent*9 | 0.10 g/m$^2$ |
| 11th Layer (Ultraviolet Absorbing Layer): | |
| Gelatin | 1.50 g/m$^2$ |
| Ultraviolet absorbents*22,*6,*7 | 1.00 g/m$^2$ |
| Color mixing inhibitor*23 | 0.06 g/m$^2$ |
| Color mixing inhibitor solvent*9 | 0.15 g/m$^2$ |
| Anti-irradiation dye*24 | 0.02 g/m$^2$ |
| Anti-irradiation dye*25 | 0.02 g/m$^2$ |
| 12th Layer (Protective Layer): | |
| Silver iodobromide fine grains (silver chloride: 97 mol %; mean grain size: 0.2 μm) | 0.07 g of Ag/m$^2$ |
| Gelatin | 1.50 g/m$^2$ |
| Gelatin hardening agent*26 | 0.17 g/m$^2$ |

*15,5'-Dichloro-3,3'-di(3-sulfobutyl)-9-ethylthiacarbocyanine sodium salt

-continued

*2Triethylammonium 3-[2-{2[3-(3-sulfopropyl)naphtho-(1,2-d)thiazoline-2-indenemethyl]-1-butenyl}-3-naphtho(1,2-d)thiazolino]propanesulfonate
*32-[α-(2,4-Di-t-amylphenoxy)hexanamido]-4,6-dichloro-5-ethylphenol
*42-[2-Chlorobenzoylamido]-4-chloro-5-[α-(2-chloro-4-t-amylphenoxy)octanamido]phenol
*52-(2-Hydroxy-3-sec-5-t-butylphenyl)benzotriazole
*62-(2-Hydroxy-5-t-butylphenyl)benzotriazole
*72-(2-Hydroxy-3,5-di-t-butylphenyl)-6-chlorobenzo-triazole
*8Di(2-ethylhexyl)phthalate
*9Trinonyl phosphate
*102,5-Di-t-octylhydroquinone
*11Tricresyl phosphate
*12Dibutyl phthalate
*13Polyethyl acrylate
*145,5'-Diphenyl-9-ethyl-3,3'-disulfopropyloxacarbo-cyanine sodium salt
*157-Chloro-6-methyl-2-[1-{2-octyloxy-5-(2-octyloxy-5-t-octylbenzenesulfonamido}2-propyl]1-H-pyrazolo-[1,5-b][1,2,4]triazole
*163,3,3',3'-Tetramethyl-5,6,5',6'-tetrapropoxy-1,1'-bis-spiroindane
*173-(2-Ethylhexyloxycarbonyloxy)-1-(3-hexadecyloxy-phenyl)-2-pyrazoline
*182-Methyl-5-t-octylhydroquinone
*19Trictyl phosphate
*20Thiethylammonium 3-[2-(3-benzylrhodanin-5-ylidene)-3-benzoxazolinyl]propanesulfonate
*21α-Pivaloyl-α-[(2,4-dioxo-1-benzyl-5-ethoxy-hydantoin-3-yl)-2-chloro-5-(α-2,4-di-t-amyl-phenoxy)butanamido]acetanilide
*225-Chloro-2-(2-hydroxy-3-t-butyl-5-t-octyl)phenyl-benzotriazole
*232,5-Di-sec-octylhydroquinone

*24

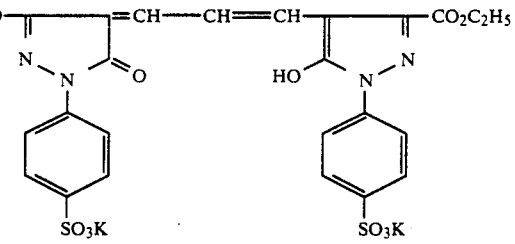

*25

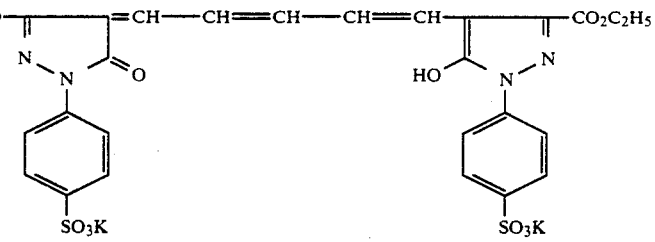

*261,2-Bis(vinylsulfonylacetamido)ethane

Samples 202 and 203 were prepared in the same manner as for Sample 201, except for replacing the discoloration inhibitor*16 used in the 6th and 7th layers of Sample 201, with Comparative Compound (A) or (B), respectively, in an amount ¼ the molar amount of the discoloration inhibitor*16.

Samples 204 to 207 were prepared in the same manner as for Sample 201, except for replacing the discoloration inhibitor*16 used in the 6th and 7th layers of Sample 201, with ¼ the molar amount of Compound 1, 3, 5 or 8 of the present invention, respectively, and ¼ the molar amount of a reducing agent (S-47).

Each of Samples 201 to 207 was imagewise exposed to white light and processed according to the following processing steps.

| Processing Step: | Temperature | Time |
|---|---|---|
| First development (black-and-white development) | 38° C. | 1'15" |
| Washing | 38° C. | 1'30" |
| Reversal exposure | 100 lux or more | 1" or more |
| Color development | 38° C. | 2'15" |

-continued

| | | |
|---|---|---|
| Washing | 38° C. | 45" |
| Blix | 38° C. | 2'00" |
| Washing | 38° C. | 2'15" |

First Developing Solution Formulation:

| | |
|---|---|
| Pentasodium nitrilo-N,N,N-trimethylenephosphonate | 0.6 g |
| Pentasodium diethylenetriamine-pentaacetic acid | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 l |
| | (pH = 9.70) |

Color Developing Solution Formulation:

| | |
|---|---|
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylenephosphonate | 0.5 g |
| Pentasodium diethylenetriamine- | 2.0 g |

-continued

| | |
|---|---|
| pentaacetate | |
| Sodium sulfite | 2.0 g |
| Potassium carbonate | 25.0 g |
| Hydroxylamine sulfate | 3.0 g |
| N-Ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1 l |
| | (pH = 10.40) |
| Blix Bath Formulation: | |
| 2-Mercapto-1,3,4-triazole | 1.0 g |
| Disodium ethylenediaminetetra-acetate dihydrate | 5.0 g |
| Ammonium ethylenediaminetetra-acetato farrate monohydrate | 80.0 g |
| Sodium sulfite | 15.0 g |
| Sodium thiosulfate (700 g/l solution) | 160.0 ml |
| Glacial acetic acid | 5.0 ml |
| Water to make | 1 l |
| | (pH = 6.50) |

The thus processed sample was tested for light fastness using the same absorption filter and xenon tester as used in Example 1, under exposure conditions of 85,000 lux and 200 hours. The light fastness of the color image was expressed in terms of the percentage of the magenta density after testing based on the initial density (2.0). The density of the white background after testing (background stain) was also measured. The results obtained are shown in Table 2.

TABLE 2

| Sample No. | Discoloration Inhibitor | Magenta Density (%) | Background Stain | Remark |
|---|---|---|---|---|
| 201 | *16 | 82 | 0.19 | Comparison |
| 202 | (A) | 91 | 0.27 | " |
| 203 | (B) | 92 | 0.31 | " |
| 204 | 1 | 93 | 0.18 | Invention |
| 205 | 3 | 92 | 0.20 | " |
| 206 | 5 | 95 | 0.18 | " |
| 207 | 8 | 96 | 0.22 | " |

As is apparent from Table 2, the compounds of the present invention stabilize a dye image without causing background stain.

When these samples were allowed to stand at 60° C. at 70% RH for 30 days, and the background density was measured, it was revealed that the compounds of the invention achieved marked improvement as compared with the comparative compounds.

EXAMPLE 3

A multilayer color light-sensitive material having the following layer structure was coated on a paper support laminated on both sides thereof with polyethylene (Sample 301).

| Layer Structure: | |
|---|---|
| E9 Layer: | Protective Layer |
| E8 Layer: | Ultraviolet Absorbing Layer |
| E7 Layer: | Blue-Sensitive Emulsion Layer |
| E6 Layer: | Intermediate Layer |
| E5 Layer: | Yellow Filter Layer |
| E4 Layer: | Intermediate Layer |
| E3 Layer: | Green-Sensitive Emulsion Layer |
| E2 Layer: | Intermediate Layer |
| E1 Layer: | Red-Sensitive Emulsion Layer |
| Support | |
| B1 Layer: | Backing Layer |
| B2 Layer: | Protective Layer |

-continued

Each layer had the following composition:

Support:

A polyethylene laminate paper. The polyethylene layer on the E1 layer side contained a white pigment (titanium dioxide) and a bluing dye (ultramarine).

| | |
|---|---|
| **E1 Layer:** | |
| Silver halide emulsion | 0.26 g of Ag/m$^2$ |
| Spectral sensitizing dye (ExSS-1) | $1.0 \times 10^{-4}$ mol/mol of AgX (X: halogen) |
| Spectral sensitizing dye (ExSS-2) | $6.1 \times 10^{-5}$ mol/mol of AgX |
| Gelatin | 1.11 g/m$^2$ |
| Cyan coupler (ExCC-1) | 0.21 g/m$^2$ |
| Cyan coupler (ExCC-2) | 0.26 g/m$^2$ |
| Ultraviolet absorbent (ExUV-1) | 0.17 g/m$^2$ |
| Solvent (ExS-1) | 0.23 g/m$^2$ |
| Development contolling agent (ExGC-1) | 0.02 g/m$^2$ |
| Stabilizer (ExA-1) | 0.006 g/m$^2$ |
| Nucleation accelerator (ExZS-1) | $3.0 \times 10^{-4}$ g/m$^2$ |
| Nucleating agent (ExZK-1) | $8.0 \times 10^{-6}$ g/m$^2$ |
| **E2 Layer:** | |
| Gelatin | 1.41 g/m$^2$ |
| Color mixing inhibitor (ExKB-1) | 0.09 g/m$^2$ |
| Solvent (ExS-1) | 0.10 g/m$^2$ |
| Solvent (ExS-2) | 0.10 g/m$^2$ |
| **E3 Layer:** | |
| Silver halide emulsion | 0.23 g of Ag/m$^2$ |
| Spectral sensitizing dye (ExSS-3) | $3.0 \times 10^{-4}$ mol/mol of AgX |
| Gelatin | 1.05 g/m$^2$ |
| Magenta Coupler (ExMC-1) | 0.16 g/m$^2$ |
| Discoloration inhibitor (ExSA-1) | 0.20 g/m$^2$ |
| Solvent (ExS-3) | 0.25 g/m$^2$ |
| Development contolling agent (ExGC-1) | 0.02 g/m$^2$ |
| Stabilizer (ExA-1) | 0.006 g/m$^2$ |
| Nucleation accelerator (ExZS-1) | $2.7 \times 10^{-4}$ g/m$^2$ |
| Nucleating agent (ExZK-1) | $1.4 \times 10^{-5}$ g/m$^2$ |
| **E4 Layer:** | |
| Gelatin | 0.47 g/m$^2$ |
| Color mixing inhibitor (ExKB-1) | 0.03 g/m$^2$ |
| Solvent (ExS-1) | 0.03 g/m$^2$ |
| Solvent (ExS-2) | 0.03 g/m$^2$ |
| **E5 Layer:** | |
| Colloidal silver | 0.09 g of Ag/m$^2$ |
| Gelatin | 0.49 g/m$^2$ |
| Color mixing inhibitor (ExKB-1) | 0.03 g/m$^2$ |
| Solvent (ExS-1) | 0.03 g/m$^2$ |
| Solvent (ExS-2) | 0.03 g/m$^2$ |
| **E6 Layer:** | |
| The same as E4 Layer. | |
| **E7 Layer:** | |
| Silver halide emulsion | 0.40 g of Ag/m$^2$ |
| Spectral sensitizing dye (ExSS-3) | $4.2 \times 10^{-4}$ mol/mol of AgX |
| Gelatin | 2.17 g/m$^2$ |
| Yellow coupler (ExYC-1) | 0.51 g/m$^2$ |
| Solvent (ExS-2) | 0.20 g/m$^2$ |
| Solvent (ExS-4) | 0.20 g/m$^2$ |
| Development contolling agent (ExGC-1) | 0.06 g/m$^2$ |
| Stabilizer (ExA-1) | 0.001 g/m$^2$ |
| Nucleation accelerator (ExZS-1) | $5.0 \times 10^{-4}$ g/m$^2$ |
| Nucleating agent (ExZK-1) | $1.2 \times 10^{-6}$ g/m$^2$ |
| **E8 Layer:** | |
| Gelatin | 0.54 g/m$^2$ |
| Ultraviolet absorbent (ExUV-2) | 0.21 g/m$^2$ |
| Solvent (ExS-4) | 0.08 g/m$^2$ |
| **E9 Layer:** | |
| Gelatin | 1.28 g/m$^2$ |
| Acryl-modified polyvinyl alcohol (degree of modification: 17%) | 0.17 g/m$^2$ |
| Liquid paraffin | 0.03 g/m$^2$ |
| Polymethyl methacrylate latex (average particle size: 2.8 μm) | 0.05 g/m$^2$ |
| **B1 Layer:** | |
| Gelatin | 8.70 g/m$^2$ |
| **B2 Layer:** | |

-continued
| |
|---|
| The same as E9 Layer. |
Each of the above layers further contained a gelatin hardening agent (ExGK-1) and a surface active agent.
The compounds used in the sample preparation were as set forth below.
(ExCC-1) Cyan Coupler:
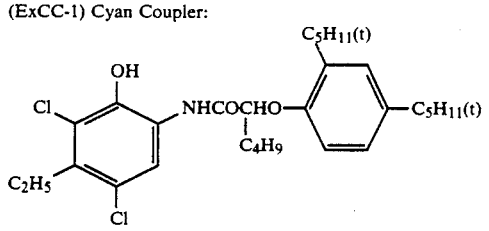
(ExCC-2) Cyan Coupler:
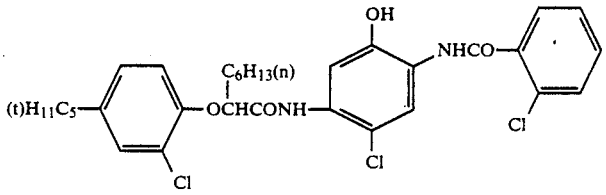
(ExMC-1) Magenta Coupler:
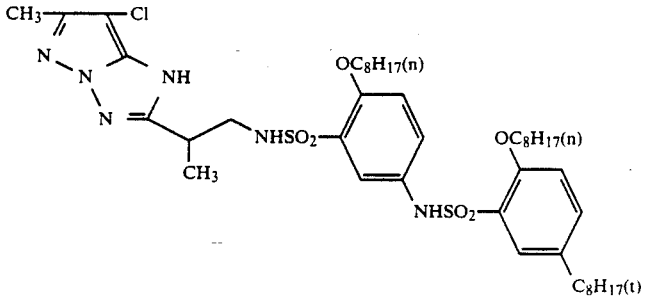
(ExYC-1) Yellow Coupler:
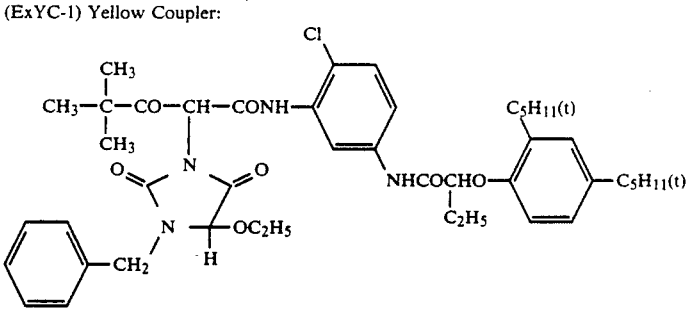
(ExSS-1) Spectral Sensitizing Dye:
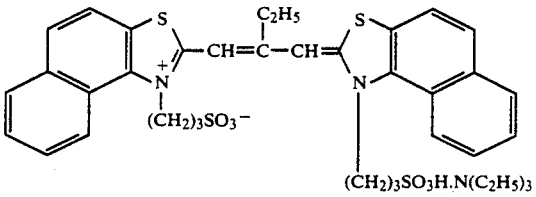
(ExSS-2) Spectral Sensitizing Dye:
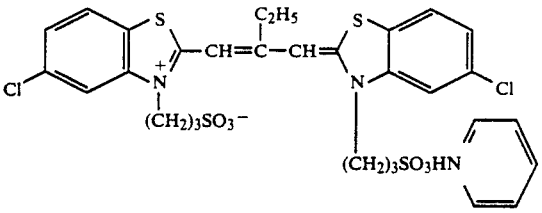

-continued
(ExSS-3) Spectral Sensitizing Dye:
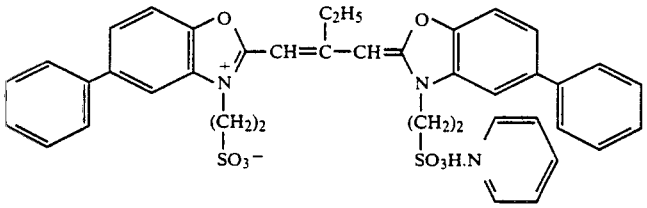
(ExSS-4) Spectral Sensitizing Dye:
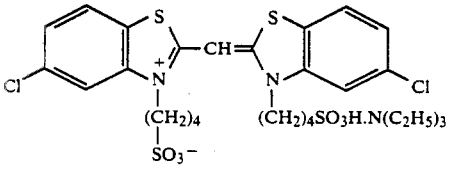
(ExS-1) Solvent:
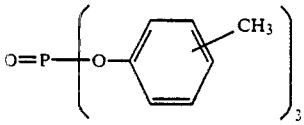
(ExS-2) Solvent:
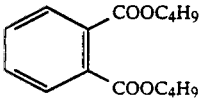
(ExS-3) Solvent:
A 1:1 (by volume) mixture of
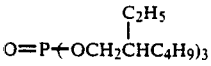
and
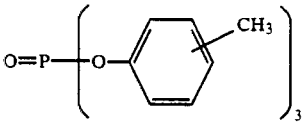
(ExS-4) Solvent:
$O{=}P(O{-}C_9H_{19}(iso))_3$
(ExUV-1) Ultraviolet Absorbent:
A 5:8:9 (by weight) mixture of
(1)
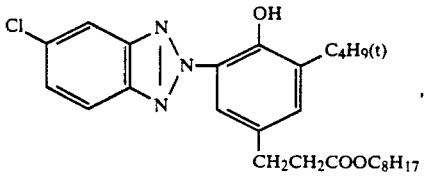
(2)
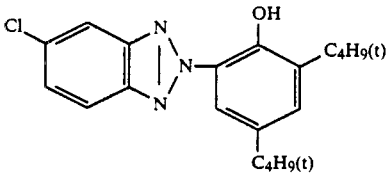
and -continued (3)

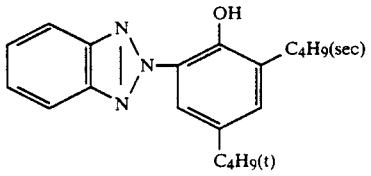

(ExUV-2) Ultraviolet Absorbent;
A 2:9:8 (by weight) mixture of the compounds (1), (2), and (3) shown above.

(ExSA-1) Discoloration Inhibitor:

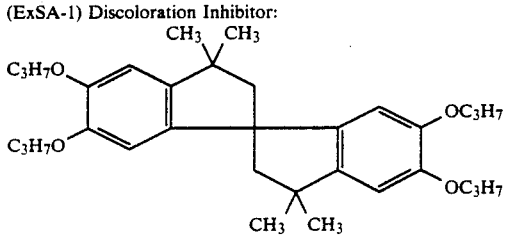

(ExKB-1) Color Mixing Inhibitor:

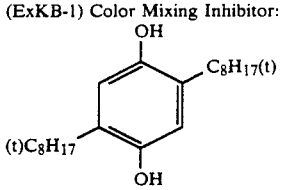

(ExGC-1) Development Controlling Agent:

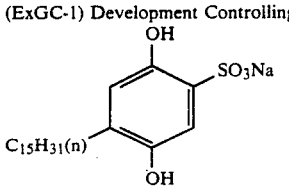

(ExA-1) Stabilizer:
4-Hydroxy-5,6-trimethylene-1,3,3a,7-tetraazaindene
(ExZS-1) Nucleation Accelerator:
2-(3-Dimethylaminopropylthio)-5-mercapto-1,3,4-thiadiazole hydrochloride
(ExZK-1) Nucleating Agent:
6-Ethoxythiocarbonylamino-2-methyl-1-propargyl-quinolinium trifluoromethanesulfonate
(ExGK-1) Gelatin Hardening Agent:
1-Oxy-3,5-dichloro-S-triazine sodium salt The silver halide emulsion used in the sample preparation was prepared as follows.

A mixed aqueous solution of potassium bromide and sodium chloride, and an aqueous solution of silver nitrate, were added simultaneously to an aqueous gelatin solution containing 0.07 g of 3,4-dimethyl 1,3-thiazolin-2-thione per gram of silver, at 65° C. over a period of about 14 minutes, while vigorously stirring to obtain a monodispersed silver chlorobromide emulsion (silver bromide content: 80 mol%) having a mean grain size of about 0.23 μm. To the emulsion were added 61 mg of sodium thiosulfate and 42 mg of chloroauric acid (tetrahydrate) per mole of silver. The mixture was heated at 65° C. for 60 minutes, to effect chemical sensitization. The resulting silver chlorobromide grains were allowed to grow under the same precipitating environment as employed above, to finally obtain a monodispersed core/shell silver chlorobromide emulsion (silver bromide content: 70 mol%) having a mean grain size of about 0.65 μm. The silver halide grains had a coefficient of size variation of about 12%. To the emulsion were added 1.5 mg of sodium thiosulfate and 1.5 mg of chloroauric acid (tetrahydrate), per mole of silver, and the mixture was heated at 60° C. for 60 minutes to effect chemical sensitization in order to obtain an inner latent image type silver halide emulsion.

Samples 302 to 306 were prepared in the same manner as for Sample 301, except for replacing the stabilizer (ExA-1) used in E7 Layer of Sample 301 with ⅓ the molar amount of Compound 2, 4, 6, 7 or 9, respectively, and ⅓ the molar amount of a reducing agent (S-52).

Each of Samples 301 to 306 was imagewise exposed to white light and processed according to the steps described below.

| Processing Step: | Temperature | Time |
|---|---|---|
| Color development | 38° C. | 1'40" |
| Blix | 30–34° C. | 1'00" |
| Rinsing (1) | 30–34° C. | 20" |
| Rinsing (2) | 30–34° C. | 20" |
| Rinsing (3) | 30–34° C. | 20" |
| Drying | 70–80° C. | 50" |

The rinsing was carried out in a counter-current system from (3) toward (1).

| | |
|---|---|
| Color Developing Solution Formulation: | |
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 3.0 g |
| Brightening agent ("WHITEX 4B" produced by Sumitomo Chemical Co., Ltd.) | 1.5 g |
| Water to make | 1,000 ml [pH = 10.25 (25° C.)] |
| Blix Bath Formulation: | |
| Water | 400 ml |
| Ammonium thiosulfate (70%) | 200 ml |
| Sodium sulfate | 20 g |
| Ammonium ethylenediaminetetra-acetato farrate | 60 g |
| Disodium ethylenediaminetetra-acetic acid | 10 g |
| Water to make | 1,000 ml [pH = 7.00 (25° C.)] |
| Rinsing Solution Formulation: | |
| Benzotriazole | 1.0 g |
| Ethylenediamine-N,N,N'N,N,N',N'-tetra-methylenephosphonic acid | 0.3 g |
| Water to make | 1,000 ml [pH = 7.50 (25° C.)] |

Each of the thus processed samples were tested for light-fastness in the same manner as in Example 2, and the results obtained are shown in Table 3 below.

TABLE 3

| Sample No. | Discoloration Inhibitor | Magenta Density (%) | Background Stain | Remark |
|---|---|---|---|---|
| 301 | ExA-1 | 71 | 0.25 | Comparison |
| 302 | 2 | 81 | 0.26 | Invention |
| 303 | 4 | 79 | 0.23 | " |
| 304 | 6 | 86 | 0.25 | " |
| 305 | 7 | 83 | 0.27 | " |
| 306 | 9 | 85 | 0.21 | " |

The results of Table 3 clearly demonstrate the effectiveness of the discoloration inhibitors of the present invention.

EXAMPLE 4

A multilayer color printing paper having the following layers was coated on a paper support laminated on both sides thereof with polyethylene (Sample 401). The coating composition for each emulsion layer was prepared as follows.

Coating Composition for 1st Layer

In 27.2 ml of ethyl acetate and 7.7 ml of a solvent (Solv-1) were dissolved 19.1 g of a yellow coupler (ExY) and 4.4 g of a discoloration inhibitor (Cpd-1), and the solution was emulsified and dispersed in 185 ml of a 10% aqueous gelatin solution containing 8 ml of a 10% aqueous sodium dodecylbenzenesulfonate solution.

Separately, a silver chlorobromide emulsion (silver bromide content: 80.0 mol%; Ag content: 70 g/Kg) was prepared, and a blue sensitizing dye of the formula shown below was added to the emulsion in an amount of $5.0\times10^{-4}$ mol per mol of silver.

The above prepared coupler dispersion and the silver halide emulsion were mixed to prepare a coating composition having the formulation hereinafter set forth.

Coating compositions for the 2nd to 7th layers were prepared in the same manner as described above.

Each of the layers further contained 1-oxy-3,5-dichloro-s-triazine sodium salt as a gelatin hardening agent.

Sensitizing Dye for Blue-Sensitive Emulsion Layer:

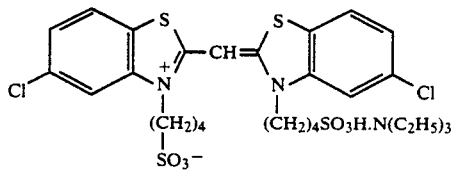

($5.0\times10^{-4}$ mol per mol of silver halide)

Sensitizing Dye for Green-Sensitive Emulsion Layer:

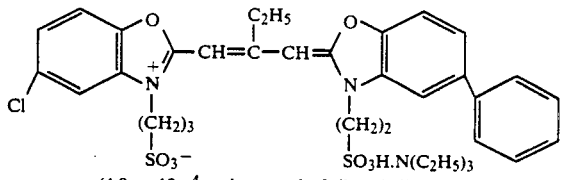

($4.0\times10^{-4}$ mol per mol of silver halide) and

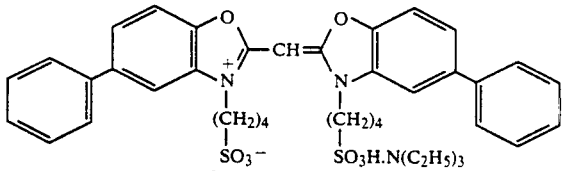

($7.0\times10^{-5}$ mol per mol of silver halide)

Sensitizing Dye for Red-Sensitive Emulsion Layer:

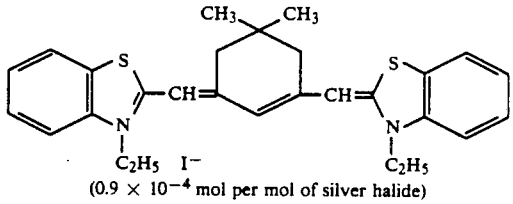

($0.9\times10^{-4}$ mol per mol of silver halide)

To the coating composition for the red-sensitive emulsion layer was further added $2.6\times10^{-3}$ mol of the following compound per mol of silver halide:

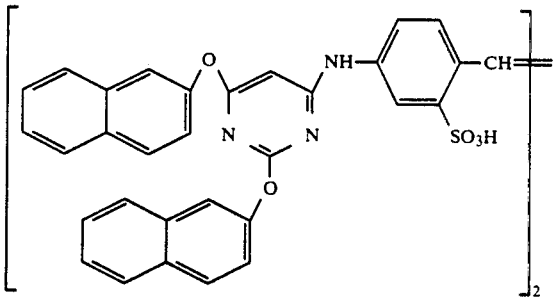

To the blue-sensitive emulsion layer, green-sensitive emulsion layer, and red-sensitive emulsion layer was further added 1-(5-methylureidophenyl)-5-mercaptotetrazole in an amount of $4.0\times10^{-6}$ mol, $3.0\times10^{-5}$ mol, and $1.0\times10^{-5}$ mol, respectively, per mol of silver halide.

To the blue-sensitive emulsion layer and green-sensitive emulsion layer was further added 4-hydroxy-6-methyl-1,3,3*a*,7-tetraazaindene in an amount of $1.2\times10^{-2}$ mol and $1.1\times10^{-2}$ mol, per mol of silver halide, respectively.

For irradiation prevention, each emulsion layer contained dyes of formulae:

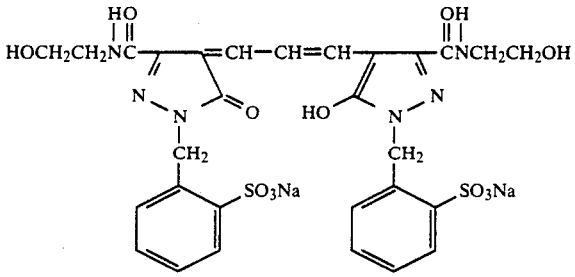

and

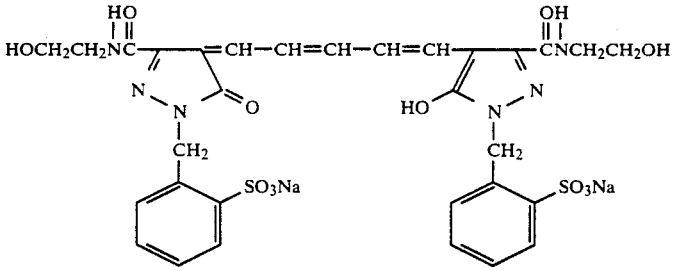

Layer Structure

Support

A polyethylene laminate paper support. The polyethylene layer on the side to be coated contained a white pigment (titanium dioxide) and a bluing dye (ultramarine).

| | |
|---|---|
| 1st Layer (Blue-Sensitive Layer): | |
| Silver halide emulsion (Br: 80 mol %) | 0.26 g of Ag/m$^2$ |
| Gelatin | 1.83 g/m$^2$ |
| Yellow coupler (ExY) | 0.83 g/m$^2$ |
| Discoloration inhibitor (Cpd-1) | 0.19 g/m$^2$ |
| Solvent (Sov-1) | 0.35 g/m$^2$ |
| 2nd Layer (Color Mixing Preventing Layer): | |
| Gelatin | 0.99 g/m$^2$ |
| Color mixing inhibitor (Cpd-2) | 0.08 g/m$^2$ |
| 3rd Layer (Green-Sensitive Layer): | |
| Silver halide emulsion (Br: 80 mol %) | 0.16 g of Ag/m$^2$ |
| Gelatin | 1.79 g/m$^2$ |
| Magenta coupler (ExM) | 0.32 g/m$^2$ |
| Discoloration inhibitor (Cpd-3) | 0.20 g/m$^2$ |
| Discoloration inhibitor (Cpd-4) | 0.14 g/m$^2$ |
| Discoloration inhibitor (Cpd-8) | 0.06 g/m$^2$ |
| Discoloration inhibitor (Cpd-9) | 0.06 g/m$^2$ |
| Solvent (Sov-2) | 0.65 g/m$^2$ |
| 4th Layer (Ultraviolet Absorbing Layer): | |
| Gelatin | 1.58 g/m$^2$ |
| Ultraviolet absorbent (UV-1) | 0.62 g/m$^2$ |
| Color mixing inhibitor (Cpd-5) | 0.05 g/m$^2$ |
| Solvent (Solv-3) | 0.24 g/m$^2$ |
| 5th Layer (Red-Sensitive Layer): | |
| Silver halide emulsion (Br: 70 mol %) | 0.23 g of Ag/m$^2$ |
| Gelatin | 1.34 g/m$^2$ |
| Cyan coupler (ExC) | 0.34 g/m$^2$ |
| Discoloration inhibitor (Cpd-6) | 0.17 g/m$^2$ |
| Polymer (Cpd-7) | 0.40 g/m$^2$ |
| Solvent (Solv-4) | 0.23 g/m$^2$ |
| 6th Layer (Ultraviolet Absorbing Layer): | |
| Gelatin | 0.53 g/m$^2$ |
| Ultraviolet absorbent (UV-1) | 0.21 g/m$^2$ |
| Solvent (Solv-3) | 0.08 g/m$^2$ |
| 7th Layer (Protective Layer): | |
| Gelatin | 1.33 g/m$^2$ |
| Acryl-modified polyvinyl alcohol degree of modification: 17%) | 0.17 g/m$^2$ |
| Liquid paraffin | 0.03 g/m$^2$ |

The compounds used in the sample preparation were as follows:

(ExY) Yellow Coupler:

-continued
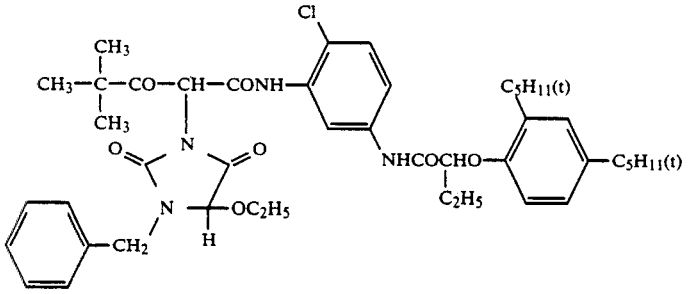
(ExM) Magenta Coupler:
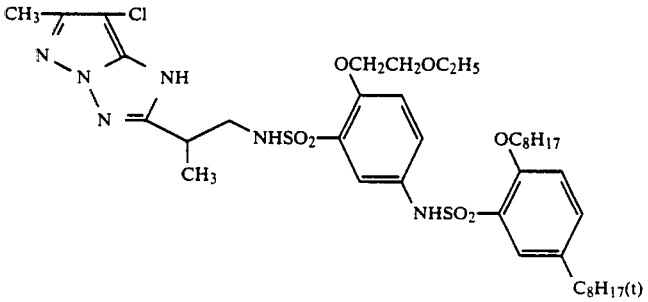
(ExC) Cyan Coupler:
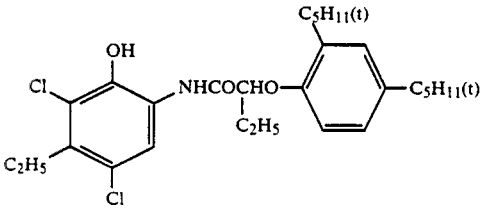
(Cpd-1) Discoloration Inhibitor:
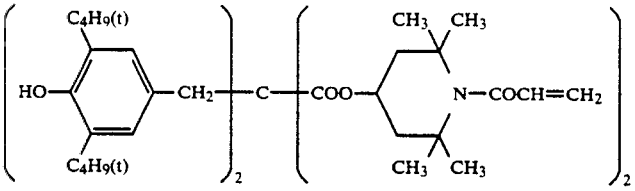
(Cpd-2) Color Mixing Inhibitor:
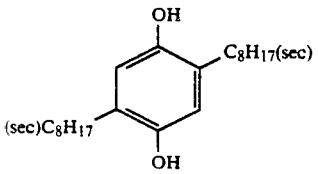
(Cpd-3) Discoloration Inhibitor:
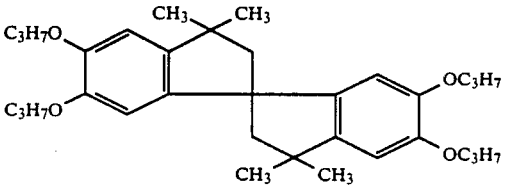
(Cpd-4) Discoloration Inhibitor:
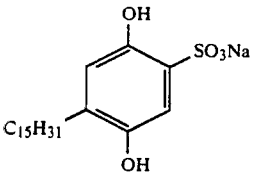
(Cpd-5) Color Mixing Inhibitor:
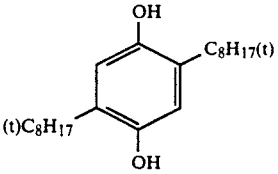
(Cpd-6) Discoloration Inhibitor:
A 5:8:9 (by weight) mixture of

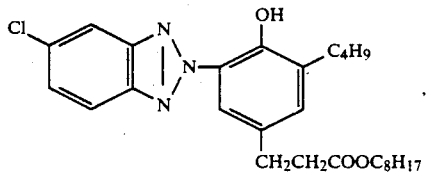
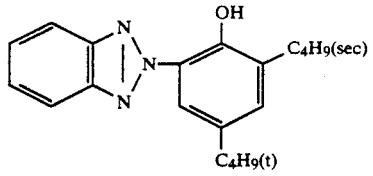
(Cpd-7) Polymer:
$\leftarrow CH_2-\underset{\underset{CONHC_4H_9(t)}{|}}{CH}\rightarrow_n$
Average Mol. Wt.: 80,000
(UV-1) Ultraviolet Absorbent:
A 2:9:8 (by weight) mixture of
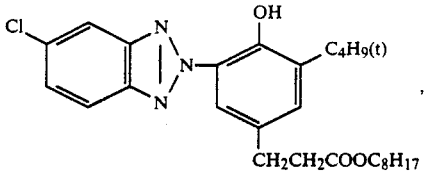
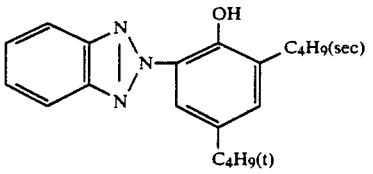
(Solv-1) Solvent:
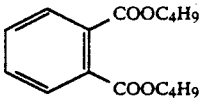
(Solv-3) Solvent:
$O=P\leftarrow O-C_9H_{19}(iso))_3$
(Cpd-8)
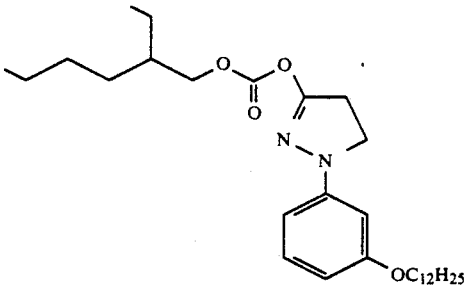
(Cpd-9)
-continued
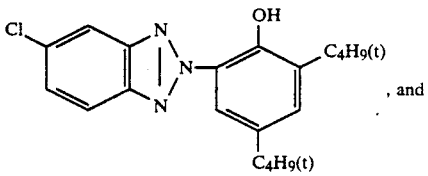
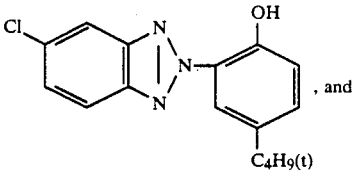
(Solv-2) Solvent:
A 2:1 (by volume) mixture of
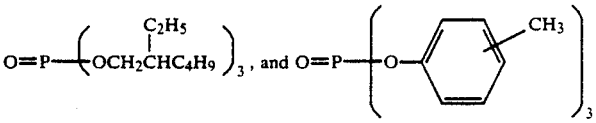
(Solv-4) Solvent:
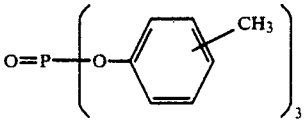

-continued

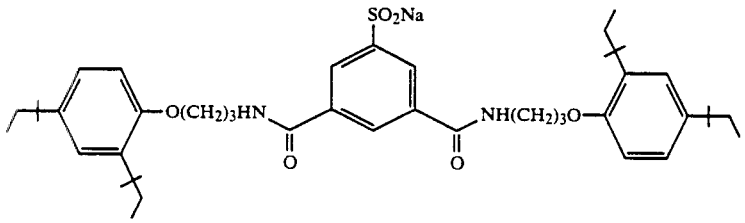

For irradiation prevention, each emulsion layer contained dyes of formulae:

Samples 402 to 408 were prepared in the same manner as for Sample 401, except for replacing the discoloration inhibitor (Cpd-3) used in the 3rd layer of Sample 401 with 1/5 the molar amount of each of the compounds of the present invention and the comparative compounds shown in Table 4 below.

Each of the samples was exposed to light and processed in the same manner as described in Example 3 and tested for light-fastness (irradation time: 50 hours) according to the same method as in Example 2. The results obtained are shown in Table 4.

TABLE 4

| Sample No. | Discoloration Inhibitor | Magenta Density (%) | Background Stain | Remark |
|---|---|---|---|---|
| 401 | Cpd-3 | 86 | 0.15 | Comparison |
| 402 | (A)* | 92 | 0.27 | " |
| 403 | (B)* | 94 | 0.33 | " |
| 404 | 1 | 96 | 0.16 | Invention |
| 405 | 2 | 95 | 0.12 | " |
| 406 | 4 | 96 | 0.13 | " |
| 407 | 8 | 97 | 0.15 | " |
| 408 | 15 | 94 | 0.18 | " |

Note:
*The same comparative compounds as used in Example 1.

It can be seen from Table 4 that the dye images of Samples 402 to 408 are stabilized to a greater extent than that of Sample 401. However, Samples 402 and 403 have a problem of high background density. These results indicate the effectiveness of the discoloration inhibitors according to the present invention.

When each of Samples 401 to 408 was subjected to the following processing steps, and the processed sample was tested for light-fastness of the dye image in the same manner as above, results similar to Table 4 were obtained.

| Processing Step: | Temperature | Time |
|---|---|---|
| Color development | 38° C. | 1' 40" |
| Blix | 30–34° C. | 1' 00" |
| Rinsing (1) | 30–34° C. | 20" |
| Rinsing (2) | 30–34° C. | 20" |
| Rinsing (3) | 30–34° C. | 20" |
| Drying | 70–80° C. | 50" |

The rinsing was carried out in a counter-current system from (3) toward (1).

| Color Developing Solution Formulation: | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine(1,4-diaza-bicyclo[2,2,2]octane) | 5.0 g |
| Potassium bromide | 0.5 g |
| Potassium carbonate | 30 g |
| N-Ethyl-N-(β-methane sulfonamidoethyl)-3-methyl-4-aminoaniline sulfate | 5.5 g |
| Diethylhydroxylamine | 4.0 g |
| Brightening agent ("WHITEX-CK" produced by Chiba Geigy A. G.) | 1.5 g |
| Water to make | 1,000 ml [pH = 10.25 (25° C.)] |
| **Blix Bath Formulation:** | |
| Water | 400 ml |
| Ammonium thiosulfate (70%) | 200 ml |
| Sodium sulfite | 20 g |
| Ammonium ethylenediaminetetra-acetato farrate | 60 g |
| Disodium ethylenediaminetetra-acetate | 10 g |
| Water to make | 1,000 ml (pH = 7.00) |
| **Rinsing Solution Formulation:** | |
| Deionized water (Ca and Mg contents each was reduced to 3 ppm or less) | |

EXAMPLE 5

A multilayer silver halide light-sensitive material, having the following layers on a paper support having laminated on both sides thereof with polyethylene was prepared (Sample 501). The coating composition for each emulsion layer was prepared as follows.

Coating Composition for 1st Layer

In 27.2 ml of ethyl acetate and 7.7 ml (8.0 g) of a high-boiling solvent (Solv-1) were dissolved 19.1 g of a yellow coupler (ExY-1) and 4.4 g of a discoloration inhibitor (Cpd-1), and the solution was emulsified and dispersed in 185 ml of a 10% aqueous gelatin solution containing 8 ml of a 10% aqueous sodium dodecylbenzenesulfonate solution.

The above prepared coupler dispersion and the silver halide emulsions EM7 and EM8 were mixed and dissolved, and a gelatin concentration of the solution was adjusted so as to have the formulation hereinafter shown to prepare a coating composition.

Coating compositions for the 2nd to 7th layers were prepared in the same manner as described above.

Each of the layers further contained 1-oxy-3,5-dichloro-S-triazine sodium salt as a gelatin hardening agent, and (Cpd-2) as a thickener.

Layer Structure

Support

A polyethylene laminate paper support. The polyethylene layer on the side to be coated contained a white pigment (titanium dioxide}and a bluing dye.

| 1st Layer (Blue-Sensitive Layer): | |
|---|---|
| Monodispersed silver chlorobromide | 0.15 g of Ag/m$^2$ |

-continued

| | |
|---|---|
| emulsion (EM7) spectrally sensitized by sensitizing dye (ExS-1) | |
| Monodispersed silver chlorobromide emulsion (EM8) spectrally sensitized by sensitizing dye (ExS-1) | 0.15 g of Ag/m$^2$ |
| Gelatin | 1.86 g/m$^2$ |
| Yellow coupler (ExY-1) | 0.82 g/m$^2$ |
| Discoloration inhibitor (Cpd-1) | 0.19 g/m$^2$ |
| Solvent (Solv-1) | 0.35 g/m$^2$ |
| 2nd Layer (Color Mixing Preventing Layer): | |
| Gelatin | 0.99 g/m$^2$ |
| Color mixing inhibitor (Cpd-3) | 0.05 g/m$^2$ |
| 3rd Layer (Green-Sensitive Layer): | |
| Monodispersed silver chlorobromide emulsion (EM9) spectrally sensitized by sensitizing dyes (ExS-2 and ExS-3) | 0.12 g of Ag/m$^2$ |
| Monodispersed silver chlorobromide emulsion (EM10) spectrally sensitized by sensitizing dyes (ExS-2 and ExS-3) | 0.24 g of Ag/m$^2$ |
| Gelatin | 1.24 g/m$^2$ |
| Magenta coupler (ExM-1) | 0.39 g/m$^2$ |
| Discoloration inhibitor (Cpd-4) | 0.25 g/m$^2$ |
| Discoloration inhibitor (Cpd-5) | 0.12 g/m$^2$ |
| Solvent (Solv-2) | 0.25 g/m$^2$ |
| 4th Layer (Ultraviolet Absorbing Layer): | |
| Gelatin | 1.60 g/m$^2$ |
| Ultraviolet absorbents (Cpd-6/Cpd-7/Cpd-8 = 3/2/6: by weight ratio) | 0.70 g/m$^2$ |
| Color mixing inhibitor (Cpd-9) | 0.05 g/m$^2$ |
| Solvent (Solv-3) | 0.42 g/m$^2$ |
| 5th Layer (Red-Sensitive Layer): | |

-continued

| | |
|---|---|
| Monodispersed silver chlorobromide emulsion (EM11) spectrally sensitized by sensitizing dyes (ExS-4 and ExS-5) | 0.07 g of Ag/m$^2$ |
| Monodispersed silver chlorobromide emulsion (EM12) spectrally sensitized by sensitizing dyes (ExS-4 and ExS-5) | 0.16 g of Ag/m$^2$ |
| Gelatin | 0.92 g/m$^2$ |
| Cyan coupler (ExC-1) | 1.46 g/m$^2$ |
| Cyan coupler (ExC-2) | 1.84 g/m$^2$ |
| Discoloration inhibitors (Cpd-7/Cpd-8/Cpd-10 = 3/4/2: by weight ratio) | 0.17 g/m$^2$ |
| Polymer for dispersion (Cpd-11) | 0.14 g/m$^2$ |
| Solvent (Solv-1) | 0.20 g/m$^2$ |
| 6th Layer (Ultraviolet Absorbing Layer): | |
| Gelatin | 0.54 g/m$^2$ |
| Ultraviolet absorbents (Cpd-6/Cpd-8/Cpd-10 = 1/5/3: by weight ratio) | 0.21 g/m$^2$ |
| Solvent (Solv-4) | 0.08 g/m$^2$ |
| 7th Layer (Protective Layer): | |
| Gelatin | 1.33 g/m$^2$ |
| Acryl-modified polyvinyl alcohol (degree of modification: 17%) | 0.17 g/m$^2$ |
| Liquid paraffin | 0.03 g/m$^2$ |

Each layer contained Cpd-12 and Cpd-13 as irradiation preventing dyes. Further, each layer contained Alkanol XC (E. I. du Pont de Numours) a sodium alkylbenzenesulfonate, a succinate and Magefacx F-120 (Dainippon Ink, Inc.) as emulsion dispersant or coating aid. In addition, each layer contained Cpd-14 and Cpd-15 as stabilizers of silver halide.

Details of the emulsions used are as follows.

| Emulsion | Form | Grain Diameter | Br Containing Ratio (mol %) | Variation Coefficient |
|---|---|---|---|---|
| EM7 | Cube | 1.1 | 1.0 | 0.10 |
| EM8 | Cube | 0.8 | 1.0 | 0.10 |
| EM9 | Cube | 0.45 | 1.5 | 0.09 |
| EM10 | Cube | 0.34 | 1.5 | 0.09 |
| EM11 | Cube | 0.45 | 1.5 | 0.09 |
| EM12 | Cube | 0.34 | 1.6 | 0.10 |

Variation coefficient = Standard Deviation/Average Grain Diameter

ExY-1

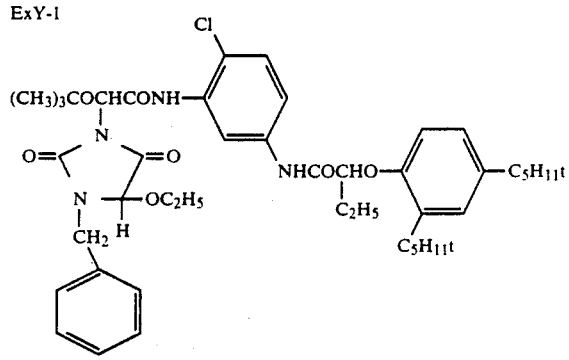

-continued
ExM-1
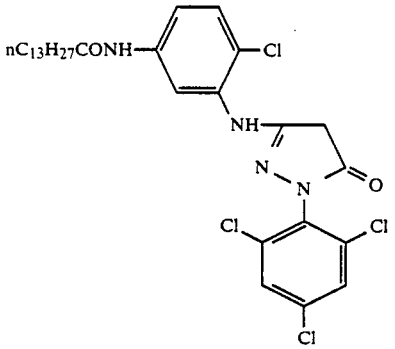
ExC-1
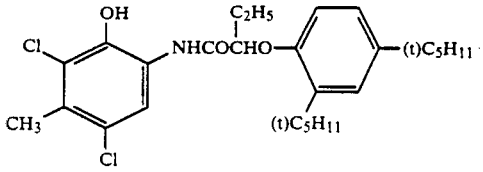
ExC-2
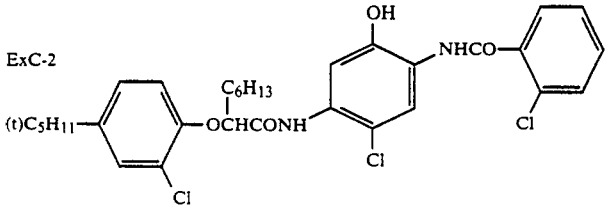
Cpd-1
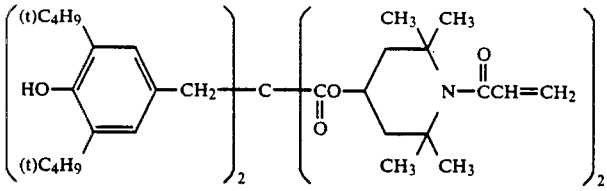
Cpd-2
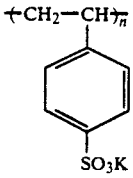
Cpd-3
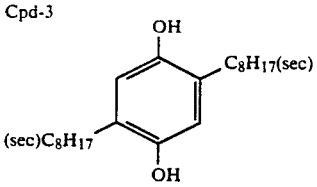

-continued
Cpd-4
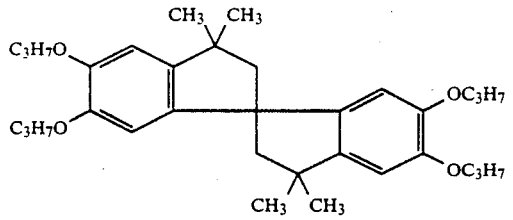
Cpd-5
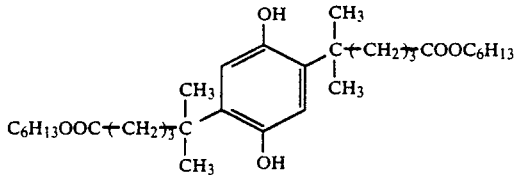
ExS-1
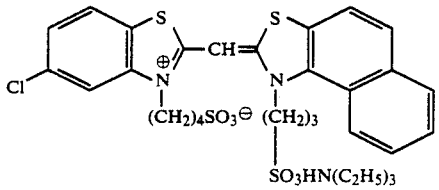
ExS-2
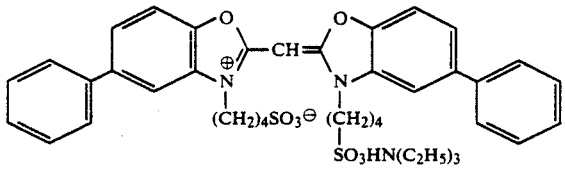
ExS-3
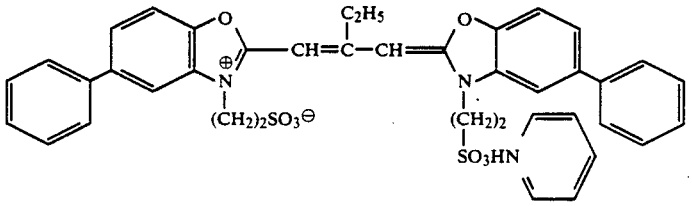
ExS-4
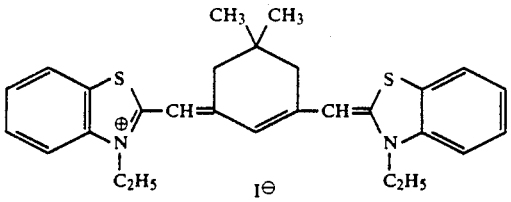

-continued
ExS-5
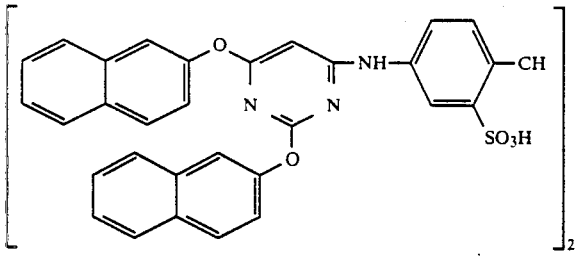
Cpd-6
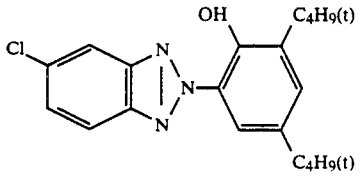
Cpd-7
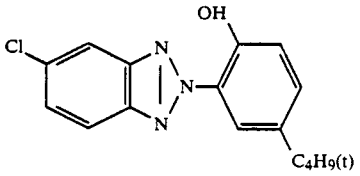
Cpd-8
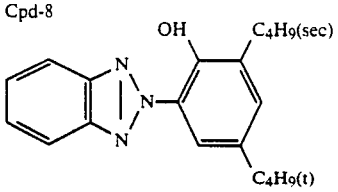
Cpd-9
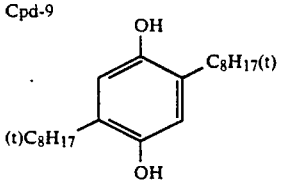
Cpd-10
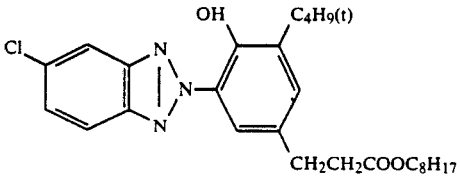
Cpd-11
$\leftarrow CH_2-\underset{\underset{CONHC_4H_9(t)}{|}}{CH}\rightarrow_n$ (n = 100~1000)
Average Molecular Weight: 100,000

-continued
Cpd-12
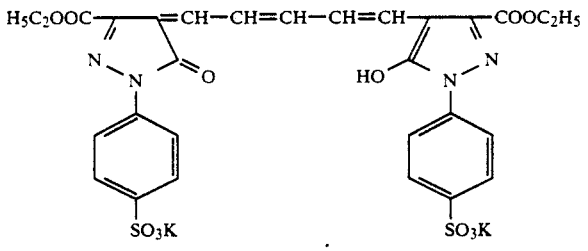
Cpd-13
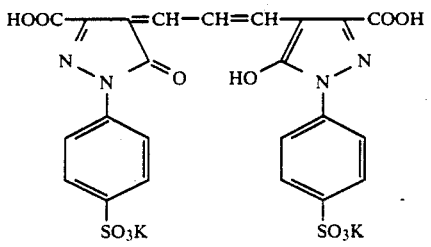
Cpd-14
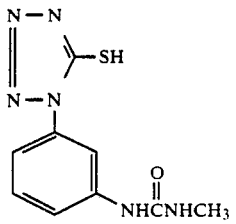
Cpd-15
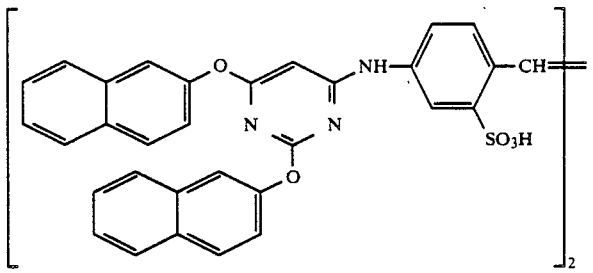
(Solv-1) Solvent
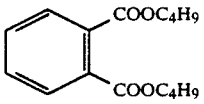
(Solv-2) Solvent
A 1:1 (by volume) mixture of
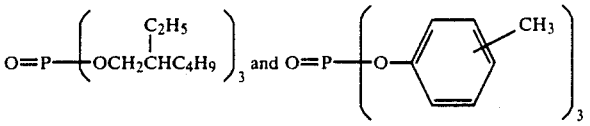
(Solv-3) Solvent
$O{=}P{+}O{-}C_9H_{19}(iso))_3$ -continued (Solv-4) Solvent

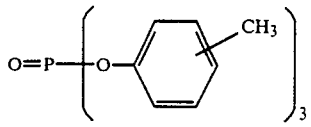

Samples 502 to 508 were prepared in the same manner as Sample 501, except for replacing the discoloration inhibitor (Cpd-5), used in the 3rd layer of Sample 501, with 1/5 the molar amount of each of the compounds shown in Table 5 below.

Each of Samples 501 to 508 was subjected to the following processing and the processed sample was tested for light-fastness (irradiation time: 100 hours) according to the same method as in Example 2. The results obtained are shown in Table 5.

| Processing Step: | Temperature | Time |
|---|---|---|
| Color development | 35° C. | 45" |
| Blix | 30–36° C. | 45" |
| Stabilizing (1) | 30–37° C. | 20" |
| Stabilizing (2) | 30–37° C. | 20" |
| Stabilizing (3) | 30–37° C. | 20" |
| Stabilizing (4) | 30–37° C. | 30" |
| Drying | 70–85° C. | 60" |

The stabilizing was carried out in a counter-current system from (4) toward (1).

| Color Developing Solution Formulation: | |
|---|---|
| Water | 800 ml |
| Ethylenediaminetetraacetic acid | 2.0 g |
| Triethanol amine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-diethylhydroxylamine | 4.2 g |
| 5,6-dihydroxylbenzene-1,2,4-trisulfonic acid | 0.3 g |
| Brightening agent (4,4'-diaminostilbene-type) | 2.0 g |
| Water to make | 1,000 ml [pH = 10.10 (25° C.)] |
| **Blix Bath Formulation:** | |
| Water | 400 ml |
| Ammonium thiosulfate (70%) | 100 ml |
| Sodium sulfite | 18 g |
| Ammonium ethylenediaminetetra-acetato farrate | 55 g |
| Disodium ethylenediaminetetra-acetate | 3 g |
| Glacial acetic acid | 8 g |
| Water to make | 1,000 ml [pH = 5.5 (25° C.)] |
| **Stabilizing Bath Formulation:** | |
| Formalin (37%) | 0.1 g |
| Formalin-sulfinic acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1,000 ml [pH = 4.0 (25° C.)] |

TABLE 5

| Sample No. | Discoloration Inhibitor | Magenta Density (%) | Background Stain | Remark |
|---|---|---|---|---|
| 501 | Cpd-5 | 63 | 0.13 | Comparison |
| 502 | (A)* | 71 | 0.28 | " |
| 503 | (B)* | 77 | 0.35 | " |
| 504 | 1 | 81 | 0.14 | Invention |
| 505 | 2 | 80 | 0.10 | " |
| 506 | 4 | 93 | 0.11 | " |
| 507 | 8 | 90 | 0.12 | " |
| 508 | 15 | 88 | 0.11 | " |

Note:
*The same comparative compounds as used in Example 1.

It can be seen from Table 5 that the dye images of Samples 502 to 508 are stabilized over that of Sample 501. However, Samples 502 and 503 have a problem of high background density. These results indicate the effectiveness of the discoloration inhibitors according to the present invention.

While the invention has been described in detail and with reference to specific embodiments thereof, it will be apparent to one skilled in the art that various changes and modifications can be made therein without departing from the spirit and scope thereof.

We claim:

1. A silver halide photographic material comprising a support having provided thereon at least one silver halide emulsion layer, wherein said silver halide photographic material contains a compound having discoloration inhibitory activity represented by formula (I):

$$PWR\text{-}(Time)_t\text{-}MCAP \quad (I)$$

wherein PWR represents a group capable of releasing $(Time)_t$-MCAP upon being reduced; Time represents a group which is released from PWR in the form of $(Time)_t$-MCAP and then releases MCAP represents a water soluble transition metal complex having discoloration inhibitory activity and MCAP is dissolved out of said silver halide photographic material after being released; and wherein said compound further comprises an organic group attached to the PWR moiety, so that said compound is immobile in the layer wherein it is incorporated.

2. A silver halide photographic material as in claim 1, wherein said compound is represented by formula (II):

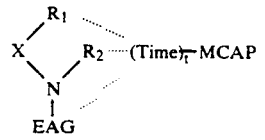

(II)

wherein X represents an oxygen atom, a sulfur atom or a nitrogen-containing group of formula —N($R_3$)—; $R_1$, $R_2$, and $R_3$ each represents a chemical bond or a group other than a hydrogen atom; EAG represents an electron accepting group; or $R_1$, $R_2$, $R_3$ and EAG may be connected to each other to form a ring; Time represents a group capable of releasing MCAP upon cleavage of the N—X bond as a trigger followed by a subsequent reaction; MCAP and t are as defined in claim 1; when t is 0, Time represents a chemical bond; and the dotted lines indicates that at least one thereof represents a chemical bond.

3. A silver halide photographic material as in claim 2, wherein said compound is represented by formula (III):

(III)

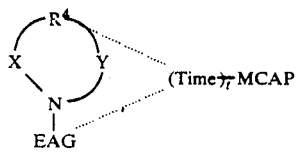

wherein Y represents a divalent linking group; $R_4$ represents an atom group forming a 5- to 8-membered nitrogen-containing monocyclic or condensed heterocyclic ring together with X and Y; and X, EAG, Time, t, MCAP and the dotted lines are as defined in claim 2.

4. A silver halide photographic material as in claim 2, wherein X is an oxygen atom.

5. A silver halide photographic material as in claim 3, wherein X is an oxygen atom.

6. A silver halide photographic material as in claim 1, wherein said transition metal complex is represented by formulae (IV) or (V):

(IV)

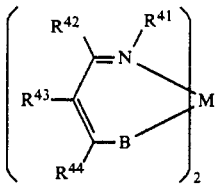

(V)

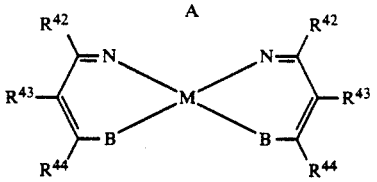

wherein $R^{41}$ represents a hydrogen atom, a hydroxyl group, an aliphatic group, or an aromatic group; $R^{42}$ and $R^{44}$ each represents a hydrogen atom, an aliphatic group, or an aromatic group; $R^{43}$ represents a hydrogen atom or an aliphatic group; or $R^{43}$ and $R^{44}$ are connected to form a ring; A represents a divalent linking group; B represents an oxygen atom or a sulfur atom; and M represents Cu, Co, Ni, Pd or Pt; with the proviso that at least one of $R^{41}$, $R^{42}$, $R^{43}$, $R^{44}$ and A represents a group connected to $(Time)_t$ and at least one of $R^{41}$, $R^{42}$, $R^{43}$, $R^{44}$, and A represents a carboxyl group, a sulfo group, or a group having a carboxyl or sulfo group.

7. A silver halide photographic material as in claim 6, wherein said transition metal complex is represented by formulae (IVa) or (Va):

(IVa)

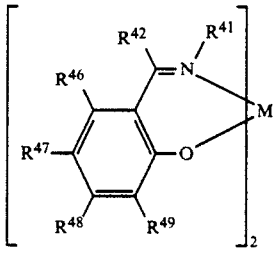

(Va)

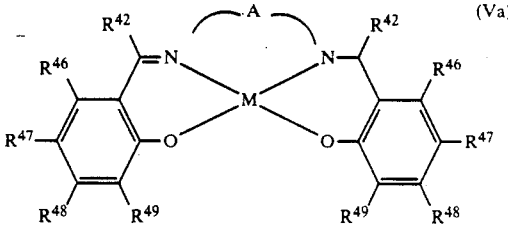

wherein $R^{41}$, $R^{42}$, A and M are as defined in claim 8; $R^{46}$, $R^{47}$, $R^{48}$, and $R^{49}$ each represents a hydrogen atom, a hydroxyl group, a cyano group, a halogen atom, a carboxyl group, a sulfo group, or a substituted or unsubstituted alkyl group or substituted or unsubstituted aryl group which is bonded to the benzene ring either directly or via a divalent linking group; or a pair of $R^{42}$ and $R^{46}$, a pair of $R^{46}$ and $R^{47}$, a pair of $R^{47}$ and $R^{48}$, or a pair of $R^{48}$ and $R^{49}$ are connected to each other to form a 5- or 6-membered ring; With the proviso that at least one Of $R^{41}$, $R^{42}$, $R^{46}$, $R^{47}$, $R^{48}$, $R^{49}$, and A represents a group connected to $(Time)_t$ and at least one of $R^{41}$, $R^{42}$, $R^{46}$, $R^{47}$, $R^{48}$, $R^{49}$, and A represents a carboxyl group, a sulfo group, or a group having a carboxyl or sulfo group.

8. A silver halide photographic material as in claim 1, wherein said photographic material contains a coupler or a dye and wherein said compound represented by formula (I) is present in an amount ranging from about 0.01 mol to about 10 mols per mol of said coupler or said dye.

9. A silver halide photographic material as in claim 1, further comprising a reducing substance having an oxidation potential of at least 0.8 volts.

10. A silver halide photographic material as in claim 9, further comprising an electron transport agent.

11. A silver halide photographic material as in claim 1, further comprising at least one coupler in an amount of from $2\times10^{-3}$ mole to $5\times10^{-1}$ mole per mole of silver.

* * * * *